US011653729B2

(12) United States Patent
Tran et al.

(10) Patent No.: US 11,653,729 B2
(45) **Date of Patent: *May 23, 2023**

(54) WALLET WITH CARD HOLDING MECHANISMS

(71) Applicant: Dango Products, LLC, Portola Valley, CA (US)

(72) Inventors: Thuan Tran, San Jose, CA (US); Charlie Carroll, Palo Alto, CA (US); Binh Tran, Santa Clara, CA (US)

(73) Assignee: Dango Products, LLC, Portola Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/716,875

(22) Filed: Apr. 8, 2022

(65) Prior Publication Data

US 2022/0225742 A1 Jul. 21, 2022

Related U.S. Application Data

(63) Continuation-in-part of application No. 17/470,825, filed on Sep. 9, 2021, now Pat. No. 11,337,498, which (Continued)

(51) Int. Cl.
*A45C 13/30* (2006.01)
*A45C 1/06* (2006.01)

(52) U.S. Cl.
CPC ..... *A45C 1/06* (2013.01); *A45C 13/30* (2013.01); *A45C 2001/065* (2013.01); *A45C 2001/067* (2013.01)

(58) Field of Classification Search
CPC ..... A45C 1/06; A45C 13/30; A45C 2001/065; A45C 2001/067

(Continued)

(56) References Cited

U.S. PATENT DOCUMENTS 1,415,276 A 5/1922 Edward
1,463,619 A * 7/1923 Gardner ..... A63F 1/06 206/39.6

(Continued)

FOREIGN PATENT DOCUMENTS

| | | |
|---|---|---|
| CA | 2471793 | 6/2003 |
| KR | 101356236 | 1/2014 |
| KR | 20140003803 U | 6/2014 |

OTHER PUBLICATIONS

Dango Products—"Wallet Collections"—Available from Internet <URL: www.dangoproducts.com/collections/wallets>—Available at least as of Oct. 19, 2017—Retrieved from Internet Archive Wayback Machine <URL: https://web.archive.org/web/20171019082039/www.dangoproducts.com/collections/wallets> on Oct. 23, 2020.

(Continued)

*Primary Examiner* — Sue A Weaver
(74) *Attorney, Agent, or Firm* — Gallium Law; Wesley Schwie, Esq.; Isabel Fox

(57) ABSTRACT

The disclosure includes a wallet comprising an open-sided shell, a flexible member coupled to the open-sided shell, and a pull tab coupled to the external surface of the flexible member. The disclosure also includes a wallet comprising an open-sided shell, a flexible member coupled to the open-sided shell, a stretchable band configured to wrap around the open-sided shell and the flexible member, and a radio frequency identification (RFID) protection plate coupled to the open-sided shell. In some embodiments, the RFID protection plate is configured to securably couple at least one personal card between the RFID protection plate and the open-sided shell. The disclosure includes a wallet comprising an open-sided shell, a first protruding portion coupled to the open-sided shell, and a second protruding portion coupled to the open-sided shell.

20 Claims, 59 Drawing Sheets

Related U.S. Application Data is a continuation of application No. 17/227,204, filed on Apr. 9, 2021, now Pat. No. 11,178,947, application No. 17/716,875 is a continuation-in-part of application No. 16/659,627, filed on Oct. 22, 2019, said application No. 17/227,204 is a continuation-in-part of application No. 16/659,627, filed on Oct. 22, 2019.

(58) Field of Classification Search
USPC ..... 150/143, 147
See application file for complete search history.

(56) References Cited

U.S. PATENT DOCUMENTS 1,585,051 A * 5/1926 Skoglund ..... A45C 13/02 206/804
1,832,625 A * 11/1931 Gardner, Jr. ..... A45C 1/06 150/149
D187,240 S 2/1960 Harkins
3,461,469 A 8/1969 Morrision
D256,852 S 9/1980 Mcgahee
4,305,497 A 12/1981 Pacilio
D266,479 S 10/1982 Hayakawa
4,691,456 A 9/1987 Ackeret
4,705,086 A 11/1987 O'Neill
4,763,821 A 8/1988 Powell
4,774,779 A 10/1988 Ackeret
4,932,520 A 6/1990 Ciarcia
D314,865 S 2/1991 Tuisku
5,038,926 A 8/1991 Van Der Toorn
D322,039 S 12/1991 Chien
5,077,869 A 1/1992 Haase
D337,656 S 7/1993 Hostert
5,234,351 A 8/1993 Dixon
5,279,019 A 1/1994 Knickle
5,328,026 A 7/1994 Newman
D360,815 S 8/1995 Padden
D366,146 S 1/1996 Bertrand
D374,388 S 10/1996 Padden
5,573,164 A 11/1996 Law
5,592,767 A 1/1997 Treske
D384,499 S 10/1997 Gaestel
5,740,624 A 4/1998 Baseley
D398,446 S 9/1998 Hosea
D404,567 S 1/1999 Akutsu
5,901,764 A 5/1999 Ritter
5,929,427 A 7/1999 Harada
5,944,080 A 8/1999 Podwika
D416,581 S 11/1999 Cheng
6,009,584 A 1/2000 Padden
6,044,967 A 4/2000 Painsith
6,076,665 A 6/2000 Chuang
6,089,289 A 7/2000 Florjancic
D431,105 S 9/2000 Ling
6,145,994 A 11/2000 Ng
D434,624 S 12/2000 Padden
6,276,414 B1 5/2001 Bibb
D444,060 S 6/2001 Elsener
D447,438 S 9/2001 Dilibero
6,347,875 B1 2/2002 Painsith
D462,000 S 8/2002 Hightower
6,427,837 B1 8/2002 Shields
6,460,698 B1 10/2002 Wang
6,823,910 B1 11/2004 Elnekaveh
6,851,147 B2 2/2005 Abrahall
D517,390 S 3/2006 Cheng
D525,162 S 7/2006 Suman
7,334,616 B2 2/2008 Kaminski
7,546,860 B1 * 6/2009 Mehdizadeh ..... A45C 11/18 150/147
7,556,073 B2 * 7/2009 Lyons ..... A45C 1/06 150/147
7,568,250 B2 8/2009 Menard-Flanagan
7,604,028 B2 10/2009 Bridgefarmer
7,617,928 B1 11/2009 Murphy
D632,695 S 2/2011 Berntsen
7,918,335 B1 * 4/2011 Kitchen ..... A45C 11/18 150/132
7,921,890 B2 4/2011 Ho
7,971,324 B2 7/2011 Preston-Hall
8,047,363 B2 11/2011 Sheba
8,251,210 B2 8/2012 Schmidt
D685,990 S 7/2013 Zhang
D690,931 S 10/2013 Minn
8,567,459 B2 10/2013 Kitchen
D695,013 S 12/2013 Minn
D701,043 S 3/2014 Minn
8,726,952 B2 5/2014 Jambunathan
D707,091 S 6/2014 Barr
8,763,795 B1 7/2014 Oten
8,776,846 B1 7/2014 Thompson
D716,043 S 10/2014 Wilk
8,863,793 B2 10/2014 Black
D718,525 S 12/2014 Kim
D719,350 S 12/2014 Daoura
8,899,411 B2 12/2014 Van Geer
9,125,464 B2 9/2015 Minn
9,125,465 B2 9/2015 Beckley
D743,760 S 11/2015 Barr
D745,274 S 12/2015 Minn
D751,877 S 3/2016 Shlaferman
D755,764 S 5/2016 Dong
9,339,094 B2 5/2016 Tucker-Skow
D765,487 S 9/2016 Barr
D768,382 S 10/2016 Wu
D768,383 S 10/2016 Wu
D770,775 S 11/2016 Robertson
D772,678 S 11/2016 Haarburger
D775,824 S 1/2017 King
D780,449 S 3/2017 King
9,615,641 B2 4/2017 Yeung
9,648,931 B2 5/2017 Sha
9,661,908 B2 5/2017 Mayer
D792,749 S 7/2017 Faro
D798,591 S 10/2017 King
D799,301 S 10/2017 Cetera
9,775,328 B1 10/2017 Fidrych
9,815,212 B2 11/2017 Barr
D805,770 S 12/2017 Justiss
D805,873 S 12/2017 Cetera
D806,386 S 1/2018 King
D808,158 S 1/2018 King
D808,765 S 1/2018 Kisling
D809,792 S 2/2018 Moon
9,907,375 B1 3/2018 Kitchen
D814,182 S 4/2018 Haarburger
D814,183 S 4/2018 Haarburger
D815,932 S 4/2018 Lee
D815,935 S 4/2018 Barak
D817,196 S 5/2018 Haarburger
D817,316 S 5/2018 Srour
D827,408 S 9/2018 Stefanczyk-Lacor
10,080,409 B2 9/2018 King
D831,349 S 10/2018 Deng
10,123,596 B2 11/2018 King
D835,408 S 12/2018 Justiss
D835,409 S 12/2018 Justiss
D835,410 S 12/2018 Chan
D836,914 S 1/2019 Reinhart
10,206,473 B2 2/2019 Haarburger
D842,070 S 3/2019 Kisling
D845,623 S 4/2019 Sullivan
D856,956 S 8/2019 Liu
10,368,618 B2 8/2019 Richards
D860,645 S 9/2019 Wu
D861,339 S 10/2019 Moon
D866,177 S 11/2019 Leh
D866,178 S 11/2019 Jin
D866,276 S 11/2019 Shlaferman
D866,964 S 11/2019 Tran
D868,463 S 12/2019 Tran
10,512,316 B2 12/2019 Haarburger
D875,490 S 2/2020 Barr
D877,513 S 3/2020 Duncan

(56) References Cited

U.S. PATENT DOCUMENTS

| | | | | |
|---|---|---|---|---|
| D877,594 | S | 3/2020 | Liang | |
| D878,891 | S | 3/2020 | Polczynski | |
| D878,893 | S | 3/2020 | Kao | |
| D879,580 | S | 3/2020 | Spater | |
| 10,595,611 | B2 | 3/2020 | Berkley | |
| D881,671 | S | 4/2020 | Kao | |
| D884,338 | S | 5/2020 | Liu | |
| D884,339 | S | 5/2020 | Li | |
| D884,792 | S | 5/2020 | Swallow | |
| D887,708 | S | 6/2020 | Tran | |
| D887,709 | S | 6/2020 | Fenton | |
| D890,525 | S | 7/2020 | Leh | |
| D891,767 | S | 8/2020 | Lamb | |
| D893,975 | S | 8/2020 | Tran | |
| D895,276 | S | 9/2020 | Leh | |
| D895,961 | S | 9/2020 | Swan | |
| D895,963 | S | 9/2020 | Anderson | |
| D896,506 | S | 9/2020 | Anderson | |
| 10,791,808 | B2 | 10/2020 | Kane | |
| D904,016 | S | 12/2020 | Jacobsen | |
| D904,143 | S | 12/2020 | Hollinger | |
| D908,351 | S | 1/2021 | Hoffman | |
| D908,352 | S | 1/2021 | Pirker | |
| D909,059 | S | 2/2021 | Leh | |
| D915,765 | S | 4/2021 | Quittner | |
| D917,879 | S | 5/2021 | Chui | |
| D918,002 | S | 5/2021 | Borenstein | |
| D930,634 | S | 9/2021 | Azodi | |
| D930,981 | S | 9/2021 | Ghazzaoui | |
| D932,182 | S | 10/2021 | Foy | |
| D933,360 | S | 10/2021 | Oing | |
| D934,560 | S | 11/2021 | Tran | |
| 11,178,947 | B2 | 11/2021 | Tran | |
| 11,284,689 | B1 | 3/2022 | Duncan | |
| D950,240 | S | 5/2022 | Tran | |
| D950,241 | S | 5/2022 | Tran | |
| 11,337,498 | B2 * | 5/2022 | Tran | A45C 11/182 |
| 2002/0179463 | A1 | 12/2002 | Newman | |
| 2004/0148837 | A1 | 8/2004 | Lewis | |
| 2005/0035006 | A1 | 2/2005 | Dohner | |
| 2007/0109130 | A1 | 5/2007 | Edenfield | |
| 2008/0314483 | A1 | 12/2008 | Armstrong | |
| 2009/0199940 | A1 | 8/2009 | Toner | |
| 2011/0308972 | A1 * | 12/2011 | Streem | A45C 13/02 206/39 |
| 2012/0228168 | A1 * | 9/2012 | Kitchen | A45C 11/182 206/307 |
| 2013/0056119 | A1 * | 3/2013 | Henriette | A45C 1/06 150/147 |
| 2013/0135103 | A1 | 5/2013 | Holloway | |
| 2013/0276943 | A1 | 10/2013 | Minn et al. | |
| 2014/0143958 | A1 | 5/2014 | Barr | |
| 2015/0083289 | A1 | 3/2015 | Johnson | |
| 2015/0240524 | A1 | 8/2015 | Olroyd | |
| 2015/0257499 | A1 | 9/2015 | Muir | |
| 2015/0282579 | A1 | 10/2015 | Piro | |
| 2016/0206065 | A1 | 7/2016 | Ehrlich | |
| 2016/0324283 | A1 | 11/2016 | Kane | |
| 2016/0374443 | A1 | 12/2016 | Kim | |
| 2017/0035169 | A1 | 2/2017 | Haarburger | |
| 2017/0055654 | A1 | 3/2017 | King | |
| 2017/0119115 | A1 | 5/2017 | King | |
| 2017/0135452 | A1 | 5/2017 | Kane | |
| 2017/0224077 | A1 | 8/2017 | Mayer | |
| 2017/0265610 | A1 | 9/2017 | Smith | |
| 2018/0027935 | A1 | 2/2018 | Laatz | |
| 2018/0064223 | A1 | 3/2018 | Singer | |
| 2018/0311804 | A1 | 11/2018 | Weinberger | |
| 2018/0325228 | A1 | 11/2018 | Leimer | |
| 2018/0368547 | A1 | 12/2018 | Grannan | |
| 2019/0008253 | A1 | 1/2019 | Deng | |
| 2019/0318667 | A1 | 10/2019 | Freeman | |
| 2019/0365066 | A1 | 12/2019 | Hill | |
| 2020/0077758 | A1 | 3/2020 | Hoffman | |
| 2020/0229557 | A1 | 7/2020 | Tran | |
| 2020/0305564 | A1 | 10/2020 | Myers | |
| 2020/0379509 | A1 | 12/2020 | Coward | |
| 2021/0112935 | A1 | 4/2021 | Tran | |
| 2021/0330045 | A1 | 10/2021 | Tran | |
| 2021/0337945 | A1 | 11/2021 | Popoff | |

OTHER PUBLICATIONS

Onward Innovation—"RFID Carbon Fiber Cash Strap Wallet"—Downloaded Jun. 11, 2022—Available from Internet <URL: https://onwardinnovation.com/products/rfid-carbon-fiber-cash-strap-wallet>.

Ridge—"Aluminum—Black"—Downloaded Apr. 9, 2021—Available from Internet <URL: https://ridge.com/products/aluminum-black?>.

Titan X—"Titan X | Pro Edition"—Downloaded Jun. 11, 2022—Available from Internet <URL: https://titanxwallet.com/products/edition>.

Alpine Swiss—"Alpine Swiss Genuine Leather Super Thing Slim Cash Strap Front Pocket Wallet"—Downloaded Apr. 9, 2021—Available from Internet <URL: https://www.alpineswiss.com/alpine-swiss-genuine-leather-super-thin-slim-cash-strap-front-pocket-wallet/>.

Simple Zone—"Carbon Fiber Wallet for Men, Simple Zone RFID Blocking Slim Minimalist Card Holder Wallet with Money Clip and Cash Strap"—First available Jun. 18, 2020—Downloaded Apr. 9, 2021—Available from Internet <URL: https://www.amazon.com/Carbon-Simple-Zone-Blocking-Minimalist/dp/B08BG4G8GJ>.

Dango Products—"M1 Tactical Bifold Wallet—Spec-Ops—Blueline"—Downloaded Apr. 9, 2021—Available from Internet <URL: https://www.dangoproducts.com/products/t01-tactical-bifold-wallet-blueline-spec-ops?variant=21433891881044>.

Dango Products—"Dango M1 Maverick Wallet—CNC—Machined Aluminum, RFID Blocking, Made in USA"—First available Jan. 12, 2019—Downloaded Jun. 11, 2022—Available from Internet <URL: https://www.amazon.com/dp/B07MMDRGCV>.

Dango Products—"Dango Products—M1 Maverick Bifold Wallet"—Video by user Dango Products—First available Nov. 29, 2018—Downloaded May 24, 2021—Available from Internet <URL: https://www.youtube.com/watch?v=kqF_xCWWLOU>.

Muradin—"Muradin Dapper Leather Bifold Wallet—Genuine Tactical Wallet—Card Wallet for Men—RFID-Blocking Aluminum Metal Wallet"—First available Nov. 22, 2020—Downloaded May 24, 2021—Available from Internet <URL: https://www.amazon.com/MURADIN-Dapper-Leather-Bifold-Wallet/dp/B07ZPXH81N?th=1 >.

Dango Products—"A10 Adapt Wallet"—Downloaded May 25, 2021—Available from Internet <URL: https://www.dangoproducts.com/collections/a-series-wallets/products/a10-adapt-wallet>.

Hanker—"Carbon Fiber Aluminum Metal Minimalist Wallet RFID Blocking Credit Card Holder Money Clip"—First available Feb. 7, 2019—Downloaded May 25, 20219—Available from Internet <URL: https://www.amazon.com/Carbon-Aluminum-Minimalist-Wallet-Blocking/dp/B07NHK6P55>.

Eelv—"ELV Badge Holder Wallet, Aluminium ID Badge Card Holder Heavy Duty with Quick Release Button, Metal Clip for Offices ID, School ID, Driver Licence, Wallet, Holds 1-4 Cards"—First available Jan. 21, 2019—Downloaded Jun. 11, 2022—Available from Internet <URL: https://www.amazon.com/ELV-Aluminum-Release-Offices-License/dp/B07MZJYVBX/>.

Elephant Wallet—"N Wallet Carbon Fiber—Fabric Rubber"—Downloaded Mar. 17, 2021—Available from Internet <URL: https://elephantwallet.com/products/n-wallet-carbon-fiber>.

Elephant Wallet—"How Does It Work (X Wallet)"—Downloaded Mar. 17, 2021—Available from Internet <URL: https://elephantwallet.com/pages/how-does-it-work>.

Wallet Gear—"Bifold Leather Wallet with Elastic Band"—Downloaded Mar. 17, 2021—Available from Internet <URL: https://www.walletgear.com/bifold-leather-wallet-with-elastic-band.html>.

Curated Basics—"Elastic Band Minimalist Wallet"—Downloaded Mar. 17, 2021—Available from Internet <URL: https://www.curatedbasics.com/products/elastic-band>.

(56) References Cited

OTHER PUBLICATIONS

Dango Products—"Dango D03 Dapper Bifold EDC Wallet—Made in USA—Genuine Leather, Slim, Minimalist, Metal, RFID Blocking"—Downloaded Jun. 11, 2022—Available at least as of Apr. 22, 2021 (first review)—Available from Internet <URL: https:/www.amazon.com/Dango-D03-Dapper-Bifold-Wallet/dp/B0925CV8CK?ref_=ast_sto_dp&th=1>.

Dango Products—"D03 Dapper Bifold Wallet"—Downloaded Jun. 11, 2022—Available from Internet <URL: https://www.dangoproducts.com/products/d03-dapper-wallet>.

Dango Products—"Dango Products: D03 Dapper Bifold Wallet"—Video by user Dango Products—First available Apr. 20, 2021—Downloaded Nov. 24, 2021—Available from Internet <URL: https://www.youtube.com/watch?v=QSLs3ABQcoY>.

Dango Products—"A10 Bifold Pen Adapter"—Video by user Dango Products—First available Jul. 15, 2020—Downloaded Nov. 24, 2021—Available from Internet <URL: https://www.youtube.com/watch?v=7y6fXT8Y0SI>.

Dango Products—"A10 Adapt Bifold Pen Wallet"—Downloaded Jun. 11, 2022—Available from Internet <URL: https://www.dangoproducts.com/products/a10-adapt-bifold-pen-wallet>.

Dango Products—"Dango M1 Maverick Rail EDC Wallet—Made in USA—All-Metal, Minimalist, Slim, RFID Blocking"—First Available Oct. 9, 2019—Downloaded Nov. 24, 2021—Available from Internet <URL: https://vww.amazon.com/Dango-M1-Maverick-Rail-Wallet/dp/B07YWJWK9Z>.

Dango Products—"Dango M1 Maverick Rail Wallet"—First Available Oct. 7, 2019—Downloaded Nov. 24, 2021—Available from Internet <URL: https://www.youtube.com/watch?v=5xTPdgAZkL8>.

Dango Products—"M1 Maverick Rail Wallet"—Downloaded Nov. 24, 2021—Available from Internet <URL: https://www.dangoproducts.com/products/m1-maverick-rail-wallet.

Anvi Original—"MiniCap 1.0/2.0 Mens RFID Blocking Front Pocket Minimalist Slim Wallet With Pull Tab Money Clip"—First available Sep. 14, 2018—Downloaded Nov. 11, 2021—Available from Internet <URL: https://www.amazon.com/Minicap1-0-Blocking-Pocket-Minimalist-Wallet/dp/B07HCD1BRR>.

Leatheram—"Handmade pull up card holder, leather credit card case with pull tab, minimalist wallet, thin minimal wallet"—Available at least as of Dec. 14, 2019—Downloaded Jun. 11, 2022—Available from Internet <URL: https://www.etsy.com/listing/235786494/>.

Enigma—"Muradin Chocolate Front Pocket Wallet for Men Travel Tactical bifold RFID Blocking Aluminum Metal Leather Money Cards Holder Ideal Men's Gift"—Available at least as of Jul. 6, 2021—Downloaded Jun. 11, 2022—Available from Internet <URL: https://www.amazon.com/MURADIN-Chocolate-Tactical-Blocking-Aluminum/dp/B097SKPGJP>.

Nite Ize—"Nite Ize Financial Tool, Multi Tool Money Clip, Minimalist Wallet, Money Clip, Multi Tool, and Credit Card Holder Combo, Stainless Steel"—First available Mar. 1, 2018—Downloaded Jun. 11, 2022—Available from Internet <URL: https://www.amazon.com/gp/product/B078KZSGKR>.

Safe Price—"Stainless Steel Men Money Clip Elastic Band Slim Credit Card Holder Wallet Purse (Silver)"—First available Sep. 20, 2017—Downloaded Jul. 29, 2021—Available from Internet <URL: https://www.amazon.com/Stainless-Elastic-Credit-Holder-Wallet/dp/B075S95PQ7?th=1>.

Micrometalinc—"Titanium Money Clip | Bottle Opener | CNC: 65MC43753F2 | 1x Money Clip"—Available at least as of May 13, 2020—Downloaded Jun. 11, 2022—Available from Internet < URL: https://www.etsy.com/listing/974788562>.

TI-EDC—"TI-EDC Titanium Slim Cash Money Clip Wallet Credit Card Holder and Bottle Opener"—First Available Dec. 10, 2013—Downloaded Jun. 11, 2022—Available from Internet <URL: https://www.amazon.com/TI-EDC-Titanium-Wallet-Credit-Holder/dp/B00H7UHZZY>.

Cheers All—"Beer Opener Money Clip"—Downloaded Jun. 11, 2022—Available from Internet <URL: https://cheersall.com/products/beer-opener-money-clip>.

Nomatic—Wallet—Downloaded Jun. 11, 2022—Available from Internet <URL: https://www.nomatic.com/products/wallet.

Distil—Wally Bifold Classic—Downloaded Jun. 11, 2022—Available from Internet <URL: https://distilunion.com/products/wally-bifold>.

Enigma—Enigma Dapper PU Leather Bifold Front Pocket Slim Wallet for Men, Aluminum Metal Travel Tactical RFID Blocking Card Holder Money Clip, Ideal Men's Gift—Available at least as of Jul. 13, 2021—Downloaded Jun. 11, 2022—Available from Internet < https://www.amazon.com/ENIGMA-Leather-Aluminum-Tactical-Blocking/dp/B097RCJJVJ>.

Dango Products—"M1 Maverick Bifold Wallet Spec-Ops Edition"—First Available Nov. 29, 2018—Downloaded Nov. 23, 2021—Available from Internet <URL: https://www.youtube.com/watch?v=KSFzWMDOTAc>.

Dango Products—"MT01 Clasp Multi-Tool"—First Available Mar. 19, 2019—Downloaded Nov. 23, 2021—Available from Internet <URL: https://www.youtube.com/watch?v=7SVGTLoDUsE>.

Dango Products—"A10 Adapt Wallet"—Downloaded Jun. 11, 2022—Available from internet <URL: https://www.dangoproducts.com/collections/a-series-wallets/products/a10-adapt-wallet>.

Dango Products—"A10 Adapt Wallet"—First available: Jul. 15, 2020—Downloaded Jun. 11, 2022—Available from internet <URL: https://www.youtube.com/watch2v-EheKLMq84-8>.

* cited by examiner

WALLET WITH CARD HOLDING MECHANISMS

CROSS-REFERENCE TO RELATED APPLICATIONS

The entire contents of the following application are incorporated by reference herein: U.S. application Ser. No. 17/470,825; filed Sep. 9, 2021; issued as U.S. Pat. No. 11,337,498 on May 24, 2022; and entitled WALLET WITH CARD HOLDING MECHANISMS.

The entire contents of the following application are incorporated by reference herein: U.S. application Ser. No. 17/227,204; filed Apr. 9, 2021; issued as U.S. Pat. No. 11,178,947 on Nov. 23, 2021; and entitled WALLET WITH CARD HOLDING MECHANISMS.

The entire contents of the following application are incorporated by reference herein: U.S. application Ser. No. 16/250,310; filed Jan. 17, 2019; issued as U.S. Pat. No. 11,439,214 on Sep. 13, 2022; and entitled WALLET.

The entire contents of the following application are incorporated by reference herein: U.S. application Ser. No. 16/659,627; filed Oct. 22, 2019; published Apr. 22, 2021 as US 2021/0112935; and entitled WALLET.

BACKGROUND

Field

Various embodiments disclosed herein generally relate to wallets. More specifically, the present disclosure relates to wallets with a rail system, an elastic band, and at least one pocket.

Description of Related Art

Wallets are designed to carry articles such as credit cards, currency, business cards, pictures, identification cards (such as a driver's license or work ID), plus assorted other paper items. The most common type of wallet has a bifold design including one or more compartments and is made to be carried in a pocket or bag. Wallets are, in general, made from fabric and/or leather goods and sewn to form storage pockets. They may also utilize a metal clip of sorts intended to hold paper currency. These storage pockets are typically sewn to hold one, or a few, cards, Each pocket adds a layer of material, increasing the overall thickness of the wallet and limiting the number of cards a wallet can carry. As a result, typical wallets often become bulky in size and more difficult and uncomfortable to carry, especially in a pocket. Traditional wallets may also stretch and loosen over time, leaving the credit and/or identification cards, currency, etc. vulnerable to being lost. There is therefore a need for an improved type of wallet to hold a high capacity of cards and currency while maintaining a slim profile.

SUMMARY

The disclosure includes a wallet comprising an open-sided shell having a personal card receiving surface and a back surface facing opposite the personal card receiving surface, the open-sided shell configured to securably couple at least one personal card along the personal card receiving surface within an internal portion of the open-sided shell. In many embodiments, the wallet further comprises a flexible member including an internal surface and an external surface facing opposite the internal surface, the flexible member defining a bottom half and a top half located opposite the bottom half, wherein the internal surface of the bottom half is coupled to the back surface of the open-sided shell. The wallet may include an elastic band having a first end coupled to a first side surface of the top half of the flexible member, and a second end located opposite the first end whereby the second end is coupled to a second side surface of the top half of the flexible member, the second side surface located opposite the first side surface. The elastic band may be configured to move between a first position whereby the elastic band wraps around the internal surface of the top half of the flexible member, and a second position whereby the elastic band wraps around the external surface of the top half of the flexible member.

In some embodiments, the wallet defines an open position, a closed position, and a clamshell position. When the wallet is in the open position, the flexible member may be configured to lay substantially flat such that the top half of the internal surface of the flexible member and the personal card receiving surface of the open-sided shell both substantially face a same direction, and the elastic band may be configured to be in at least one of the first position and the second position. When the wallet is in the closed position, the top half of the internal surface of the flexible member may be folded over the personal card receiving surface of the open-sided shell such that the top half of the internal surface of the flexible member faces the personal card receiving surface of the open-sided shell, and the elastic band may be configured to be in at least one of the first position and the second position. When the wallet is in the clamshell position, the top half of the internal surface of the flexible member may be folded over the personal card receiving surface of the open-sided shell such that the top half of the internal surface of the flexible member faces the personal card receiving surface of the open-sided shell, and when the wallet is in the clamshell position the elastic band may be configured to move to a third position whereby the elastic band wraps around the open-sided shell and the bottom half of the flexible member.

In many embodiments, the open-sided shell comprises a first side wall, a second side wall located opposite the first side wall, and a bottom side wall extending between the first side wall and the second side wall, whereby the first side wall, the second side wall, and the bottom side wall are configured to retain the at least one personal card in place with respect to the personal card receiving surface. The first side wall may comprise a first retention tab configured to move away from the second side wall to thereby receive the at least one personal card, the first side wall defining a first top portion and a first bottom portion located adjacent the bottom side wall, the first retention tab located adjacent the first top portion. The second side wall may comprise a second retention tab configured to move away from the first side wall to thereby receive the personal card, the second side wall defining a second top portion and a second bottom portion located adjacent the bottom side wall, the second retention tab located adjacent the second top portion. In some embodiments, the first retention tab comprises a first protruding portion configured to secure the at least one personal card in place with respect to the personal card receiving surface, the first protruding portion located adjacent the first top portion, and the second retention tab comprises a second protruding portion configured to secure the at least one personal card in place with respect to the personal card receiving surface, the second protruding portion located adjacent the second top portion.

The first retention tab and the second retention tab may be configured to move between a locked position and a receiving position, wherein when the first retention tab and the second retention tab are in the locked position the first retention tab and the second retention tab may be located a first distance from each other, wherein when the first retention tab and second retention tab are in the receiving position the first retention tab and the second retention tab may be located a second distance from each other, and wherein the first distance may be less than the second distance. In many embodiments, when the open-sided shell receives the at least one personal card, the first retention tab moves away from the second side wall and the second retention tab moves away from the first side wall to thereby receive the at least one personal card. When the open-sided shell securably couples the at least one personal card within the internal portion, the first retention tab may move towards the second side wall and the second retention tab may move towards the first side wall to thereby securably lock the at least one personal card within the internal portion of the open-sided shell. In many embodiments, the first retention tab defines a first cantilever arm physically spaced from a remaining portion of the first side wall, and the second retention tab defines a second cantilever arm physically spaced from a remaining portion of the second side wall.

In some embodiments, the bottom side wall comprises a first bottom side wall portion, a second bottom side wall portion, and an open clearance area located between the first bottom side wall portion and the second bottom side wall portion, whereby the open clearance area is configured to receive a user's finger to thereby push the at least one personal card away from the bottom side wall. The first bottom side wall portion may define a first width and the second bottom side wall portion may define a second width, wherein the second width may be greater than the first width.

The first side wall and the second side wall may be elongate along a first direction, and the bottom side wall may be elongate along a second direction perpendicular to the first direction. In some embodiments, the first side wall defines a first back portion located adjacent to the personal card receiving surface, and a first front portion located opposite the first back portion. The second side wall may define a second back portion located adjacent to the personal card receiving surface, and a second front portion located opposite the second back portion. In some embodiments, the bottom side wall defines a third back portion located adjacent to the personal card receiving surface, and a third front portion located opposite the third back portion. The open-sided shell may comprise a front retaining surface protruding along the second direction from the first front portion of the first side wall, along the second direction from the second front portion of the second side wall, and along the first direction from the third front portion of the bottom side wall. The front retaining surface may be spaced from the personal card receiving surface.

In many embodiments, the front retaining surface extends around at least a portion of a perimeter of the personal card receiving surface, wherein the front retaining surface comprises a left side retaining surface and a right side retaining surface. The left side retaining surface may extend from a first location located below the first retention tab down along the first side wall to the first bottom portion of the first side wall and along the bottom side wall to a second location adjacent an open clearance area. The right side retaining surface may extend from a third location adjacent the open clearance area along the bottom side wall to the second bottom portion of the second side wall and up along the second side wall to a fourth location located below the second retention tab. In some embodiments, the second location of the left side retaining surface defines a first angle, and the third location of the right side retaining surface defines a second angle. The second angle may be greater than the first angle. In some embodiments, the left side retaining surface defines a left side height and a left side width, and the right side retaining surface defines a right side height and a right side width. The left side height and the right side height may be substantially equal, and the left side width may be less than the right side width.

In some embodiments, the at least one personal card comprises a front surface, a back surface located opposite the front surface, a first side edge, a second side edge located opposite the first side edge, a top edge, and a bottom edge located opposite the top edge. When the at least one personal card is securably coupled to the open-sided shell with the back surface facing the personal card receiving surface, the front retaining surface may be configured to cover at least a portion of the front surface along the first side edge, at least a portion of the front surface along the second side edge, and at least a portion of the front surface along the bottom edge.

The wallet may further comprise a first aperture located along a first side portion of the open-sided shell and a second aperture located along a second side portion of the open-sided shell, the first aperture located opposite the second aperture. When the wallet is in the clamshell position, the elastic band may wrap around the first aperture and the second aperture. In some embodiments, the first side wall and the second side wall are elongate along a first direction, and the bottom side wall is elongate along a second direction perpendicular to the first direction, and the elastic band wraps around at least one of the flexible member and the open-sided shell along the second direction.

The wallet may also include an identification window coupled to the top half of the flexible member and located along the internal surface of the flexible member, and the identification window may be configured to receive an identification card. When the elastic band is in the first position the elastic band may at least partially cover the identification window, and when the elastic band is in the second position the elastic band may not cover the identification window. In many embodiments, the identification window includes an aperture configured to allow a user to view and directly contact the internal surface of the flexible member located beneath the identification window.

In some embodiments, the internal portion of the open-sided shell defines an internal width measuring at least 3.375", and an internal height measuring at least 2.125". The open-sided shell may define a first width, and the flexible member may define a second width that is less than the first width.

The disclosure includes a wallet comprising an open-sided shell having a personal card receiving surface and a back surface facing opposite the personal card receiving surface, the open-sided shell configured to securably couple at least one personal card along the personal card receiving surface within an internal portion of the open-sided shell. In some embodiments, the open-sided shell further comprises a first side wall, a second side wall located opposite the first side wall, and a bottom side wall extending between the first side wall and the second side wall, whereby the first side wall, the second side wall, and the bottom side wall are configured to retain the at least one personal card in place with respect to the personal card receiving surface. The wallet may also include a flexible member including an internal surface and an external surface facing opposite the internal surface, and the flexible member may define a bottom half and a top half located opposite the bottom half. In some embodiments, the internal surface of the bottom half is coupled to the back surface of the open-sided shell, and the internal surface of the top half is configured to retain and receive an identification card. The wallet may further comprise a pull tab coupled to the external surface of the flexible member and configured to extend from an opening in the external surface of the flexible member, and the pull tab may be configured to facilitate removal of the at least one personal card from a pocket coupled to the external surface of the flexible member.

In some embodiments, the bottom side wall comprises a first bottom side wall portion and a second bottom side wall portion, wherein the first bottom side wall portion defines a first width and the second bottom side wall portion defines a second width, wherein the second width is greater than the first width. The wallet may further comprise an open clearance area located along a bottom portion of the open-sided shell, and the open clearance area may be configured to receive a user's finger to thereby push the at least one personal card away from the bottom portion such that the at least one personal card may be removed from the wallet. In some embodiments, the open clearance area is located between the first bottom side wall portion and the second bottom side wall portion.

The wallet may further comprise a stretchable band configured to wrap around the open-sided shell and the bottom half of the flexible member, and the stretchable band may be configured to securably couple at least one personal card against at least one of the personal card receiving surface and the external surface of the flexible member. In some embodiments, the first side wall comprises a first aperture and a second aperture, the first aperture configured to receive an attaching mechanism to thereby couple the wallet to at least one of a key, a lanyard, and a tether, and the second side wall comprises a third aperture, the second aperture and the third aperture configured to receive the stretchable band.

In some embodiments, the wallet includes a first protruding portion and a second protruding portion. The first protruding portion may be coupled to the first side wall and may be configured to move away from the second side wall to thereby receive the at least one personal card. In some embodiments, the first side wall defines a first top portion and a first bottom portion located adjacent the bottom side wall, and the first protruding portion is located adjacent the first top portion. The second protruding portion may be coupled to the second side wall and may be configured to move away from the first side wall to thereby receive the at least one personal card. In some embodiments, the second side wall defines a second top portion and a second bottom portion located adjacent the bottom side wall, and the second protruding portion is located adjacent the second top portion. The first protruding portion and the second protruding portion may be configured to move between a locked position and a receiving position. In some embodiments, when the first protruding portion and the second protruding portion are in the locked position, the first protruding portion and the second protruding portion are located a first distance from each other. When the first protruding portion and second protruding portion are in the receiving position, the first protruding portion and the second protruding portion may be located a second distance from each other. In some embodiments, the first distance is less than the second distance.

In some embodiments, the pull tab defines a first portion and a second portion, and the pull tab is configured to move between a first position and a second position. In the first position, the first portion of the pull tab may be configured to extend from the opening in the external surface of the flexible member and the second portion of the pull tab may be located at least partially within the flexible member, and the at least one personal card may be located within the pocket. In the second position, the first portion of the pull tab and the second portion of the pull tab may be configured to extend from the opening in the external surface of the flexible member, and the at least one personal card may be configured to at least partially extend from the pocket.

The disclosure includes a wallet comprising an open-sided shell having a personal card receiving surface and a back surface facing opposite the personal card receiving surface, the open-sided shell configured to securably couple at least one personal card along the personal card receiving surface within an internal portion of the open-sided shell. In some embodiments, the open-sided shell comprises a first side wall, a second side wall located opposite the first side wall, and a bottom side wall extending between the first side wall and the second side wall, whereby the first side wall, the second side wall, and the bottom side wall are configured to retain the at least one personal card in place with respect to the personal card receiving surface.

The wallet may further comprise a flexible member including an internal surface and an external surface facing opposite the internal surface. In some embodiments, the flexible member defines a bottom half and a top half located opposite the bottom half, wherein the internal surface of the bottom half may be coupled to the back surface of the open-sided shell. The wallet may also include a stretchable band configured to wrap around the open-sided shell and the bottom half of the flexible member, and the stretchable band may be configured to securably couple at least one personal card against at least one of the personal card receiving surface and the external surface of the flexible member. In some embodiments, the wallet further comprises a radio frequency identification (RFID) protection plate coupled to the open-sided shell, wherein the RFID protection plate is located between the personal card receiving surface and the stretchable band.

The first side wall and the second side wall may be elongate along a first direction, and the bottom side wall may be elongate along a second direction perpendicular to the first direction. In some embodiments, the stretchable band wraps around the open-sided shell and the bottom half of the flexible member along the second direction. The RFID protection plate may be configured to move along a third direction perpendicular to the first direction and the second direction to securably couple the at least one personal card between the RFID protection plate and the personal card receiving surface. In some embodiments, the stretchable band is configured to extend along the third direction to couple at least one of at least one personal card and at least one paper bill between the stretchable band and the bottom half of the flexible member.

At least one of the open-sided shell and the RFID protection plate may comprise an open clearance area located along a bottom portion of at least one of the open-sided shell and the RFID protection plate. In some embodiments, the open clearance area is configured to receive a user's finger to thereby push the at least one personal card away from the bottom portion such that the at least one personal card may be removed from the wallet.

The wallet may further comprise an interior pocket coupled to the top half of the flexible member and located along the internal surface of the flexible member, and the interior pocket may be configured to receive and retain the at least one personal card. In some embodiments, the wallet includes a first exterior pocket coupled to the top half of the flexible member and located along the external surface of the flexible member opposite the interior pocket, the first exterior pocket configured to receive and retain the at least one personal card. The wallet may also include a second exterior pocket coupled to the bottom half of the flexible member and located along the external surface of the flexible member opposite the open-sided shell, the second exterior pocket configured to receive and retain the at least one personal card. In some embodiments, the interior pocket and the first exterior pocket are coupled to the top half of the flexible member via stitching extending along a perimeter of the top half of the flexible member, and the second exterior pocket is coupled to the flexible member via stitching and is coupled to the open-sided shell via a plurality of rivets, wherein the stitching and the plurality of rivets extend around a perimeter of the bottom half of the flexible member.

The disclosure includes a wallet comprising an open-sided shell having a first personal card receiving surface and a second personal card receiving surface facing opposite the first personal card receiving surface. The open-sided shell may be configured to securably couple at least one personal card along the first personal card receiving surface and the second personal card receiving surface within an internal portion of the open-sided shell. In some embodiments, the first personal card receiving surface comprises a first side wall, a second side wall located opposite the first side wall, and a first bottom side wall extending between the first side wall and the second side wall, whereby the first side wall, the second side wall, and the first bottom side wall are configured to retain the at least one personal card in place with respect to the first personal card receiving surface.

The wallet may further comprise a first protruding portion coupled to the first side wall and configured to move away from the second side wall to thereby receive the at least one personal card. In some embodiments, the first side wall defines a first top portion and a first bottom portion located adjacent the first bottom side wall, and the first protruding portion is located adjacent the first top portion. The wallet may also include a second protruding portion coupled to the second side wall and configured to move away from the first side wall to thereby receive the at least one personal card. In some embodiments, the second side wall defines a second top portion and a second bottom portion located adjacent the bottom side wall, and the second protruding portion is located adjacent the second top portion. The second personal card receiving surface may comprise a third side wall, a fourth side wall located opposite the third side wall, and a second bottom side wall extending between the third side wall and the fourth side wall.

In some embodiments, the wallet includes a stretchable band configured to wrap around the open-sided shell, the stretchable band configured to securably couple at least one personal card against at least one of the first personal card receiving surface and the second personal card receiving surface. The wallet may further comprise a radio frequency identification (RFID) protection plate coupled to the open-sided shell, wherein the RFID protection plate may be located between the second personal card receiving surface and the stretchable band, and wherein the RFID protection plate may be configured to securably couple the at least one personal card between the RFID protection plate and the second personal card receiving surface. In some embodiments, at least one of the open-sided shell and the RFID protection plate comprises an open clearance area located along a bottom portion of at least one of the open-sided shell and the RFID protection plate. The open clearance area may be configured to receive a user's finger to thereby push the at least one personal card away from the bottom portion such that the at least one personal card may be removed from the wallet.

The wallet may further comprise at least one aperture located along a perimeter of the open-sided shell, and the at least one aperture may be configured to receive an attaching mechanism to thereby couple the wallet to at least one of a key, a lanyard, and a tether. In some embodiments, the wallet also includes a pocket configured to receive the at least one personal card, the pocket configured to detachably couple to the open-sided shell adjacent the second personal card receiving surface. The pocket may comprise an opening configured to receive a pull tab, wherein the pull tab may be configured to facilitate removal of the at least one personal card from the pocket.

BRIEF DESCRIPTION OF THE DRAWINGS

These and other features, aspects, and advantages are described below with reference to the drawings, which are intended to illustrate, but not to limit, the invention. In the drawings, like reference characters denote corresponding features consistently throughout similar embodiments.

DETAILED DESCRIPTION

Figure 1A:
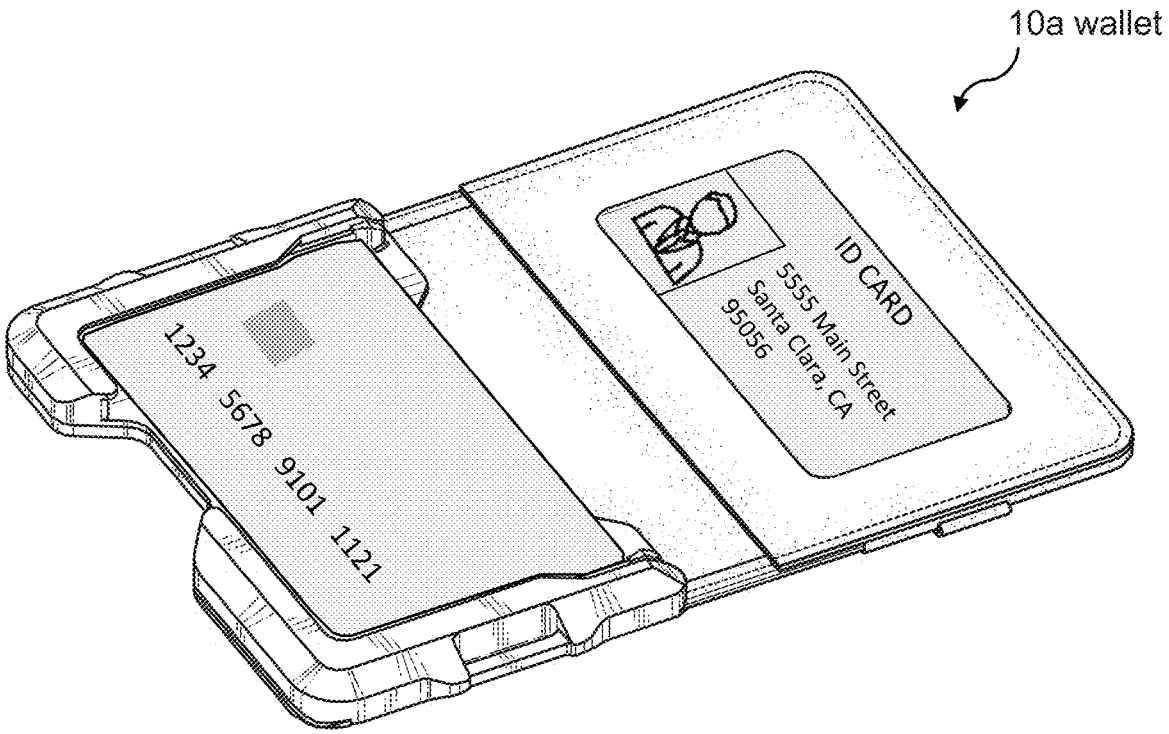
FIG. 1A illustrates a perspective view of a wallet in open position, according to some embodiments.

Although certain embodiments and examples are disclosed below, inventive subject matter extends beyond the specifically disclosed embodiments to other alternative embodiments and/or uses, and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components.

For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

REFERENCE NUMERALS

10—wallet
12—open-sided shell
13—open-sided shell
14—personal card receiving surface
15—personal card receiving surface
16—back surface
17—back surface
18—at least one personal card
20—internal portion (of open-sided shell)
21—internal portion (of open-sided shell)
22—flexible member
24—internal surface (of flexible member)
26—external surface (of flexible member)
28—bottom half (of flexible member)
30—top half (of flexible member)
32—elastic band
34*a*—first end (of elastic band)
34*b*—second end (of elastic band)
36*a*—first side surface (top half of flexible member)
36*b*—second side surface (top half of flexible member)
38—first position (of elastic band)
40—second position (of elastic band)
42—third position (of elastic band)
44—open position (wallet)
46—closed position (wallet)
48—clamshell position (wallet)
50*a*—first side wall
50*b*—second side wall
50*c*—bottom side wall
51*a*—first side wall
51*b*—second side wall
51*c*—bottom side wall
52*a*—first retention tab
52*b*—second retention tab
53*a*—first retention tab
53*b*—second retention tab
54*a*—first top portion (first side wall)
54*b*—second top portion (second side wall)
56*a*—first bottom portion (first side wall)
56*b*—second bottom portion (second side wall)
58*a*—first protruding portion
58*b*—second protruding portion
60—locked position
62—receiving position
64*a*—first distance
64*b*—second distance
66*a*—first cantilever arm
66*b*—second cantilever arm

68*a*—first bottom side wall portion
68*b*—second bottom side wall portion
70—open clearance area
71—open clearance area
72*a*—first back portion (first side wall)
72*b*—second back portion (second side wall)
72*c*—third back portion (bottom side wall)
73—second back portion (second side wall)
74*a*—first front portion (first side wall)
74*b*—second front portion (second side wall)
74*c*—third front portion (bottom side wall)
75—second front portion (second side wall)
76—front retaining surface
77—front retaining surface
78*a*—left side retaining surface
78*b*—right side retaining surface
80*a*—first location
80*b*—second location
80*c*—third location
80*d*—fourth location
82*a*—first angle
82*b*—second angle
84*a*—left side height
84*b*—right side height
86*a*—left side width
86*b*—right side width
88—front surface (personal card)
92*a*—first side edge (personal card)
92*b*—second side edge (personal card)
92*c*—top edge (personal card)
92*d*—bottom edge (personal card)
94*a*—first aperture
94*b*—second aperture
96*a*—first side portion (open-sided shell)
96*b*—second side portion (open-sided shell)
98—identification window
100—aperture (of identification window)
102*a*—internal width (open-sided shell)
102*b*—internal height (open-sided shell)
104—first width (open-sided shell)
106—second width (flexible member)
108—first external pocket
110—second external pocket
112—rivets
113—rivets
114—pocket
116—stitching
118—open-sided shell
120—personal card receiving surface
122—back surface
124—internal portion (of open-sided shell)
126—first side wall
128—second side wall
130—bottom side wall
132—flexible member
134—internal surface
136—external surface
138—bottom half
140—top half
142—pull tab
144*a*—first portion (pull tab)
144*b*—second portion (pull tab)
146—opening (in external surface)
148—pocket
150*a*—first position
150*b*—second position
152*a*—first bottom side wall portion
152*b*—second bottom side wall portion
154—open clearance area
156—stretchable band
158*a*—first protruding portion
158*b*—second protruding portion
160—open-sided shell
162—personal card receiving surface
164—back surface
166—internal portion (of open-sided shell)
168—first side wall
170—second side wall
172—bottom side wall
174—flexible member
176—internal surface
178—external surface
180—bottom half
182—top half
184—stretchable band
186—RFID protection plate
188—open clearance area
190—bottom portion (RFID plate)
192—interior pocket
194—first exterior pocket
196—second exterior pocket
198—plurality of rivets
200—open-sided shell
202—first personal card receiving surface
204—second personal card receiving surface
206—internal portion (of open-sided shell)
208—first side wall
210—second side wall
212—first bottom side wall
214—third side wall
216—fourth side wall
218—second bottom side wall
220*a*—first protruding portion
220*b*—second protruding portion
222—stretchable band
224—RFID protection plate
226—open clearance area
228—bottom portion (RFID plate)
230—at least one aperture
232—pocket
234—opening
236—pull tab

INTRODUCTION

The disclosure includes multiple embodiments of a wallet. In some embodiments, the wallet comprises a bifold-style wallet with an elastic band configured to wrap around the wallet. In other embodiments, the wallet comprises a single pocket wallet. Multiple embodiments may include a rail system configured to hold multiple personal cards, such as credit cards, identification cards, business cards, membership cards (e.g., grocery store rewards card, gym membership, library card), gift cards, and the like. Multiple embodiments may also be configured to hold paper currency, coupons, photographs, and other paper items.

Figure 1B:
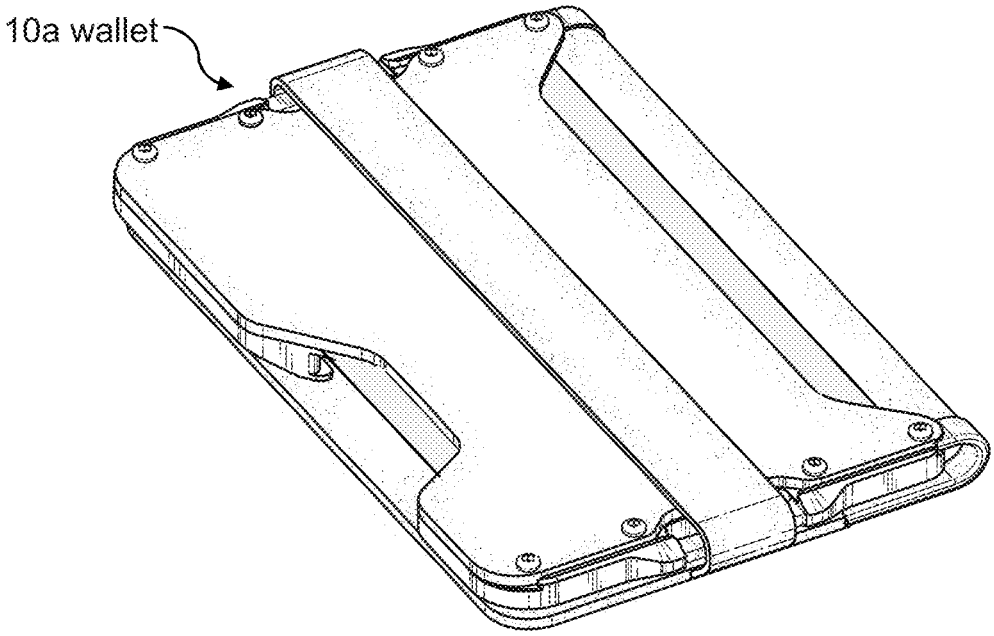
FIG. 1B illustrates a perspective view of a wallet in a clamshell position, according to some embodiments.
Figure 1C:
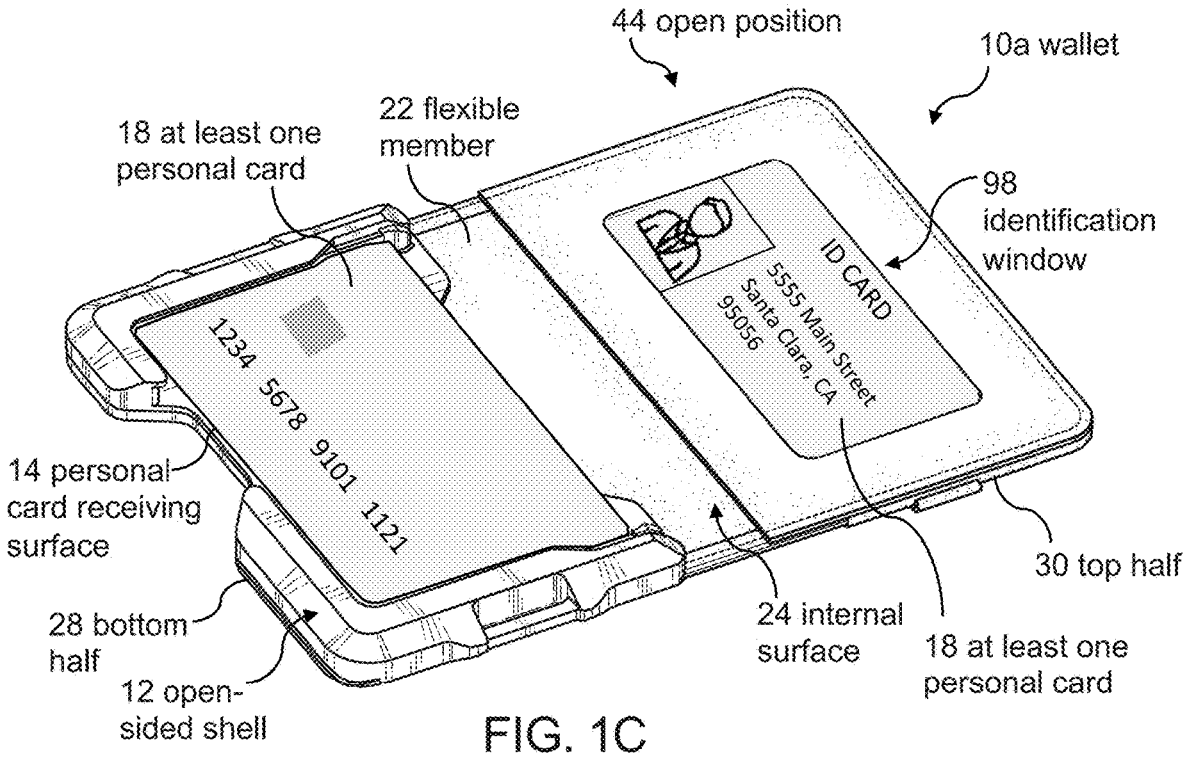
FIG. 1C illustrates a perspective view of a wallet in open position, according to some embodiments.

FIGS. 1A and 1B show different perspective views of a wallet 10*a*, according to some embodiments. FIG. 1C corresponds to FIG. 1A, and shows a bifold-style wallet 10*a* in an open position 44. As illustrated, the wallet 10*a* may include a flexible member 22 comprising a bottom half 28 and a top half 30, as well as an open-sided shell 12 coupled to the bottom half 28 of the flexible member 22. In many embodiments, the open-sided shell 12 includes a personal card receiving surface 14 configured to receive at least one personal card 18, as shown in FIG. 1C. As such, the personal card receiving surface 14 may not be visible beneath the at least one personal card 18. In some embodiments, the open-sided shell 12 is configured to hold up to five personal cards. Depending on the type of card, the open-sided shell 12 may be configured to hold more than five personal cards. FIG. 1C also shows that the top half 30 of the flexible member 22 may include an identification window 98 configured to hold at least one personal card 18. In many embodiments, the identification window 98 is configured to hold a single personal card. The identification window 98 may be configured to hold more than one personal card. As demonstrated, both the identification window 98 and the open-sided shell 12 may be located on an internal surface 24 of the flexible member 22.

Figure 1D:
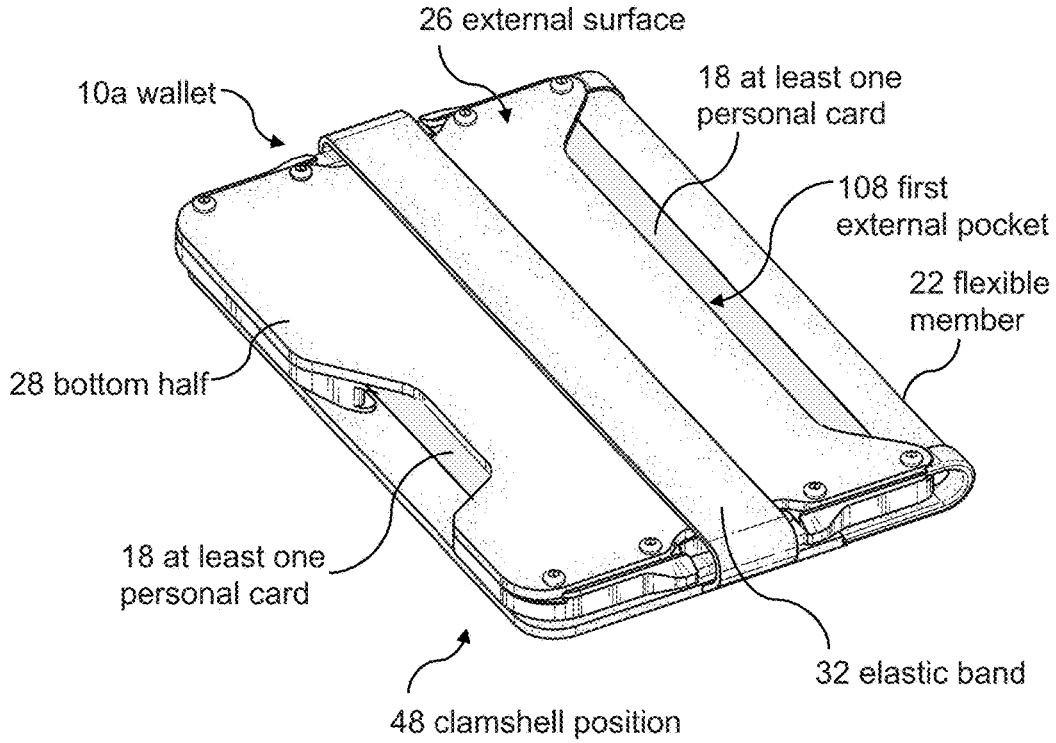
FIG. 1D illustrates a perspective view of a wallet in a clamshell position, according to some embodiments.

FIG. 1D corresponds to FIG. 1B, and shows the wallet 10*a* in a clamshell position 48. In many embodiments, the clamshell position 48 is defined as the wallet 10*a* in a closed position with an elastic band 32 wrapped around the wallet 10*a*, thereby keeping the wallet 10*a* closed. It should be noted that the elastic band 32 may comprise any flexible material, including rubber, elastic, or any suitable stretchable material. In many embodiments, the elastic band 32 comprises a single continuous piece. FIG. 1D also shows that, in many embodiments, the wallet 10*a* includes a first external pocket 108. Similar to the identification window 98 and the open-sided shell 12, the first external pocket 108 may be configured to hold at least one personal card 18. The first external pocket 108 may be located on the external surface 26 of the bottom half 28 of the flexible member 22, opposite the open-sided shell 12, which may be located on the internal surface 24, as indicated in FIG. 1C.

Figure 2:
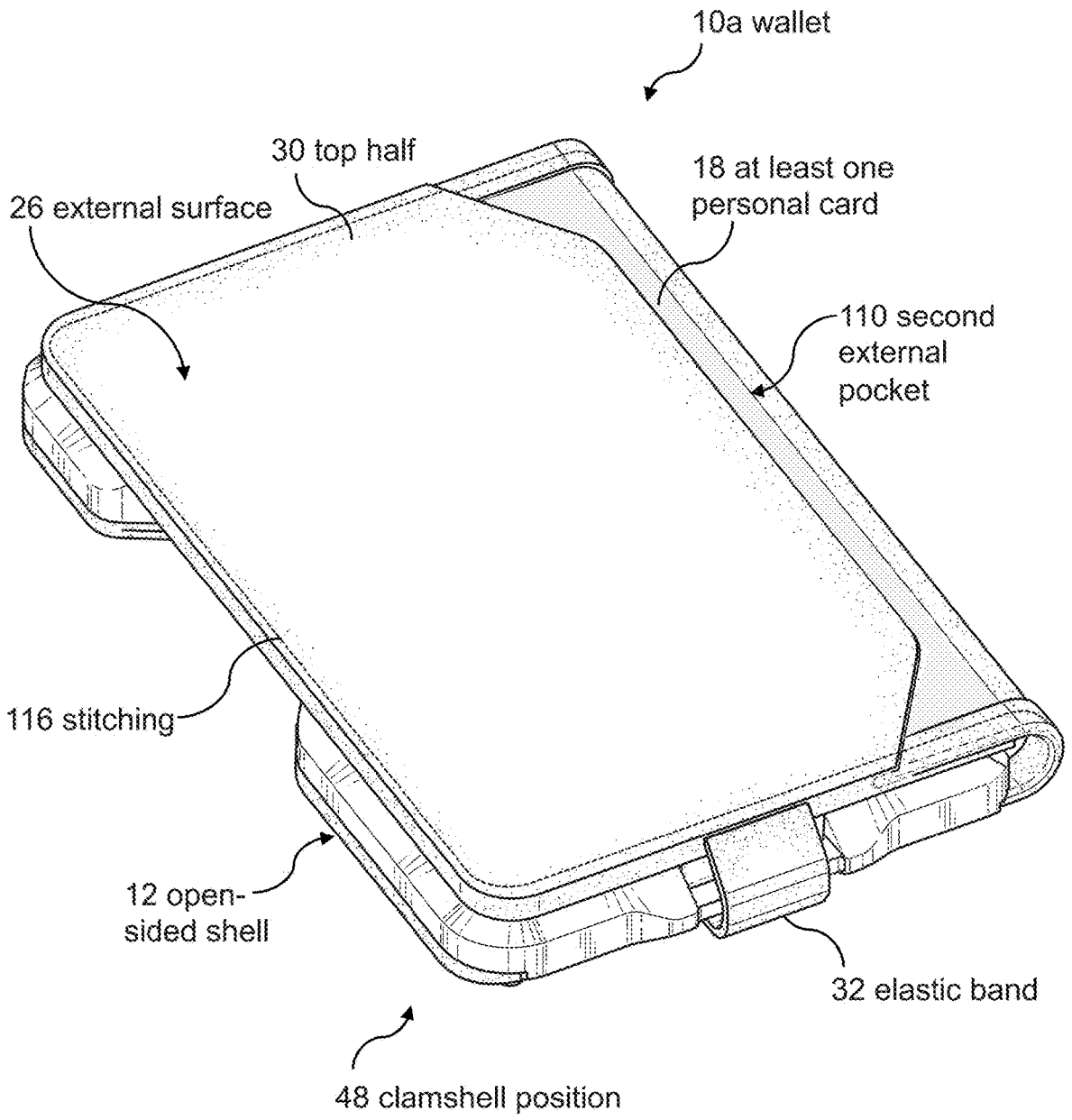
FIG. 2 illustrates a perspective view of a wallet in a clamshell position, according to some embodiments.

FIG. 2 also shows the wallet 10*a* in the clamshell position 48, but includes a perspective view of the top half 30 rather than the bottom half 28, as in FIG. 1D. As shown, the top half 30 may include a second external pocket 110 configured to hold at least one personal card 18. In many embodiments, the second external pocket 110 is located on the external surface 26 of the wallet 10*a*, opposite the identification window 98, which is located on the internal surface 24 of the wallet 10*a*. FIG. 2 also includes the elastic band 32, which may be coupled to the top half 30 and configured to wrap around the bottom half 28 of the wallet 10*a*, thereby holding the top half 30 against the bottom half 28 in the clamshell position 48. It should be noted that "top half 30" and "bottom half 28" indicate opposite portions of the wallet 10*a*. A "dividing line" may be imagined as extending through the flexible member 22 between the open-sided shell 12 and identification window 98 and/or between the first external pocket 108 and the second external pocket 110. As such, the "dividing line" may comprise the portion of the flexible member 22 configured to fold when the wallet 10*a* is in the clamshell position 48 and/or the closed position 46 (shown in FIG. 10). It should also be noted that the wallet 10*a* may be configured to "backbend," or bend in an opposite direction as compared to what is illustrated in the Figures. For example, the first and second external pockets 108, 110 may comprise internal pockets, and the open-sided shell 12 and the identification window 98 may be located on an external portion, when the wallet 10*a* is in a backbended position. In some embodiments, the elastic band 32 is configured to wrap around the wallet 10*a* to keep it closed in a backbended position.

Figure 7:
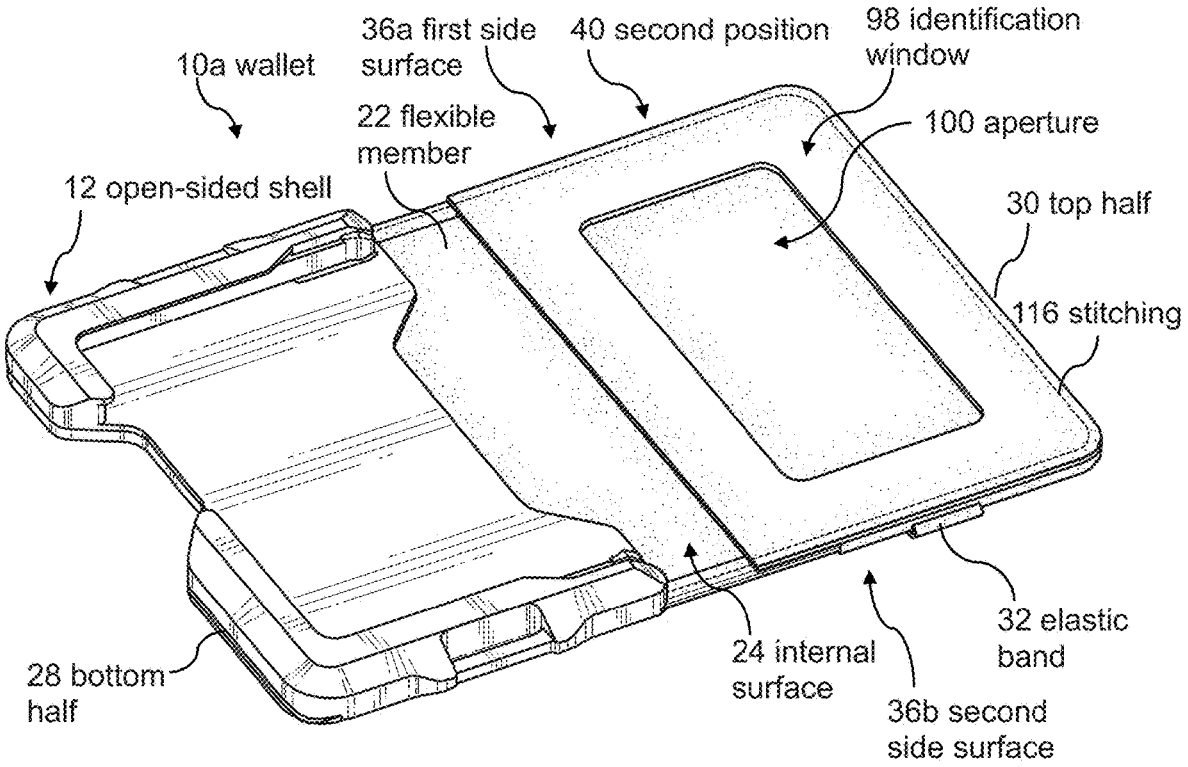

FIG. 2 also shows the stitching 116 of the wallet 10*a*. In many embodiments, substantially an entire perimeter of the flexible member 22 is stitched. The stitching 116 may be used to couple the second external pocket 110 to the top half 30 of the flexible member 22, as well as to couple the identification window 98 to the top half 30 of the flexible member 22. Stitching 116 may also be used to couple the first external pocket 108 to the bottom half 28 of the flexible member 22. In some embodiments, the stitching 116 is used to form a finished edge of the flexible member 22, such as in a center portion of the internal surface 24 between the open-sided shell 12 and the identification window 98. The stitching 116 may comprise hand-stitching or machine-stitching. Though not labeled in every Figure, the stitching 116 may be present in many embodiments of the wallet 10*a*, both on the external surface 26 (as shown in FIG. 2), and on the internal surface 24 (as shown in FIG. 7).

Figure 3:
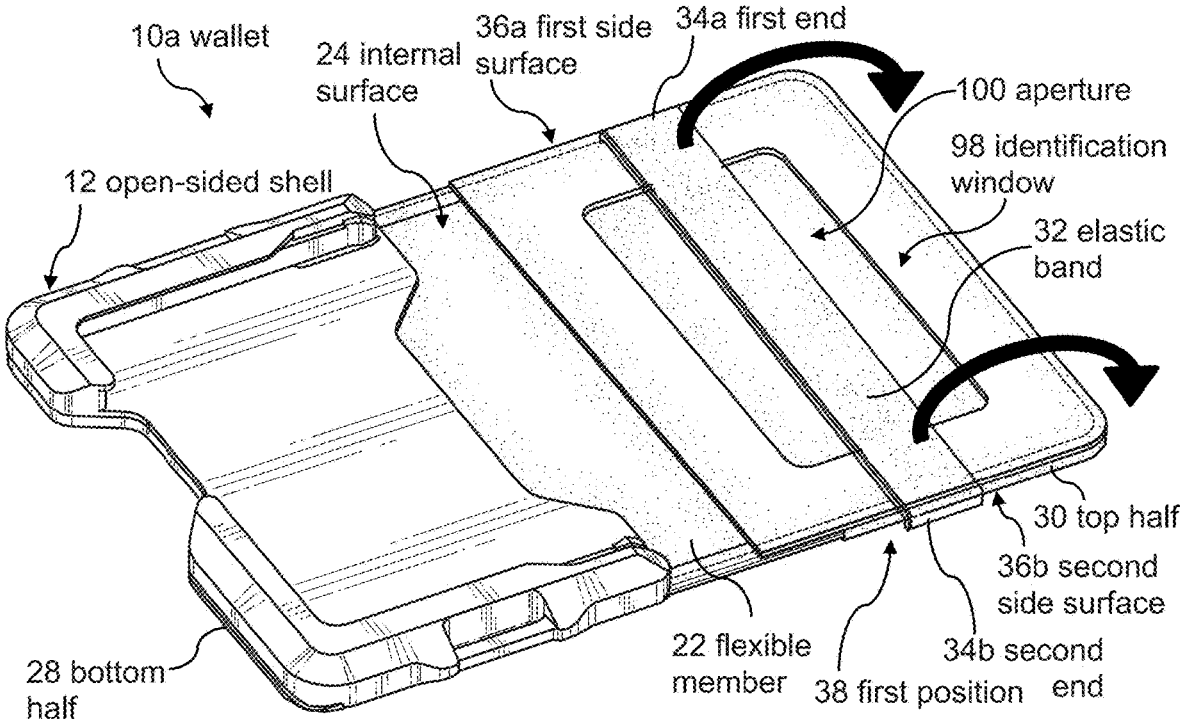
FIGS. 3, 4, 5, 6, 7, and 8 illustrate perspective views of a wallet in an open position, according to some embodiments.
Figure 4:
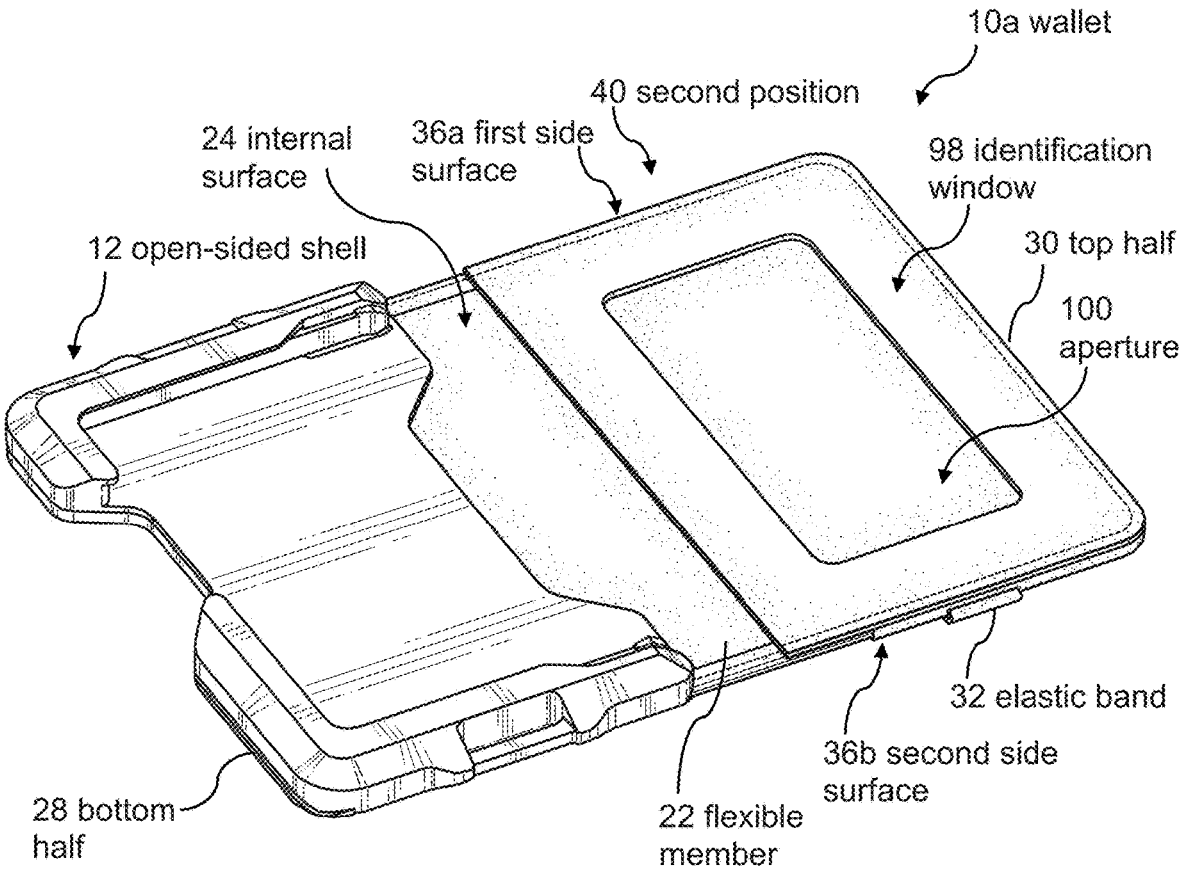

FIGS. 3 and 4 show the wallet 10*a* with the elastic band 32 in the first position 38 and second position 40, respectively. As illustrated, in the first position 38, the elastic band 32 may be configured to wrap around an internal surface 24 of the top half 30 of the flexible member 22, such that the elastic band 32 at least partially covers an aperture 100 of the identification window 98. The arrows in FIG. 3 indicate that the elastic band 32 may be configured to change to a second position 40 such that the band 32 wraps around an external surface 26 of the top half 30 so that it no longer extends across the identification window 98, as demonstrated by FIG. 4. FIG. 3 also shows that, in many embodiments, the elastic band 32 comprises a first end 34*a* coupled to the first side surface 36*a* of the top half 30, and a second end 34*b* coupled to the second side surface 36*b* of the top half 30, where the first side surface 36*a* is located opposite the second side surface 36*b*. The first end 34*a* and second end 34*b* may be defined as respective halves of the elastic band 32. In some embodiments, the first end 34*a* and second end 34*b* define only the small end portions coupled to the first side surface 36*a* and second side surface 36*b*, respectively. Each "end" 34*a*, 34*b* may be defined as any length of the elastic band 32, between 0.1% and 50% of the total length.

Each end 34*a*, 34*b* may be coupled to the respective side surface 36*a*, 36*b* via stitching, adhesive, or any other suitable method and/or combination of methods. Each end 34*a*, 34*b* may be coupled between layers of material of the top half 30. For example, each end 34*a*, 34*b* may be coupled between the identification window 98 and the flexible member 22, or between the flexible member 22 and the second external pocket 110. Alternatively, each end 34*a*, 34*b* may be coupled to the internal surface 24 (e.g. to the identification window 98) or to the external surface 26 (e.g. to the second external pocket 110). In some embodiments, the first end 34*a* is coupled via a different method and/or to a different location than the second end 34*b*. The first and second ends 34*a*, 34*b* may be coupled via substantially the same method and to corresponding locations; for example, both ends 34*a*, 34*b* coupled between layers, both ends 34*a*, 34*b* coupled to the internal surface 24, and/or both ends 34*a*, 34*b* coupled to the external surface 26.

In some embodiments, the elastic band 32 may be configured to hold at least one personal card 18 and/or paper currency (or other similar items). For example, in the first position 38 illustrated in FIG. 3, the elastic band 32 may be used to hold additional cards, currency, etc. against the identification window 98. In the second position illustrated in FIG. 4, the elastic band 32 may be used to hold additional cards, currency, etc. against the external surface 26 of the flexible member 22 (e.g., against the second external pocket 110). The elastic band 32 may also be used to hold additional cards, currency, etc. when the wallet 10*a* is in the clamshell position 48, as will be discussed further with reference to FIG. 9.

FIGS. 3 and 4 also show the aperture 100 of the identification window 98. In many embodiments, the aperture 100 comprises an open aperture, such that a user is able to view and directly contact the internal surface 24 of the flexible member 22 below the identification window 98 through the aperture 100. Stated differently, the aperture 100 may not include a covering (e.g. clear plastic), as is common in many traditional wallet designs. An open aperture 100 may provide easy access to the at least one personal card 18 located in the identification window 98, thereby making it easier for a user to remove the at least one personal card 18. The open aperture 100 may also contribute to reducing the overall size (weight, bulk, etc.) of the wallet 10*a*.

Figure 5:
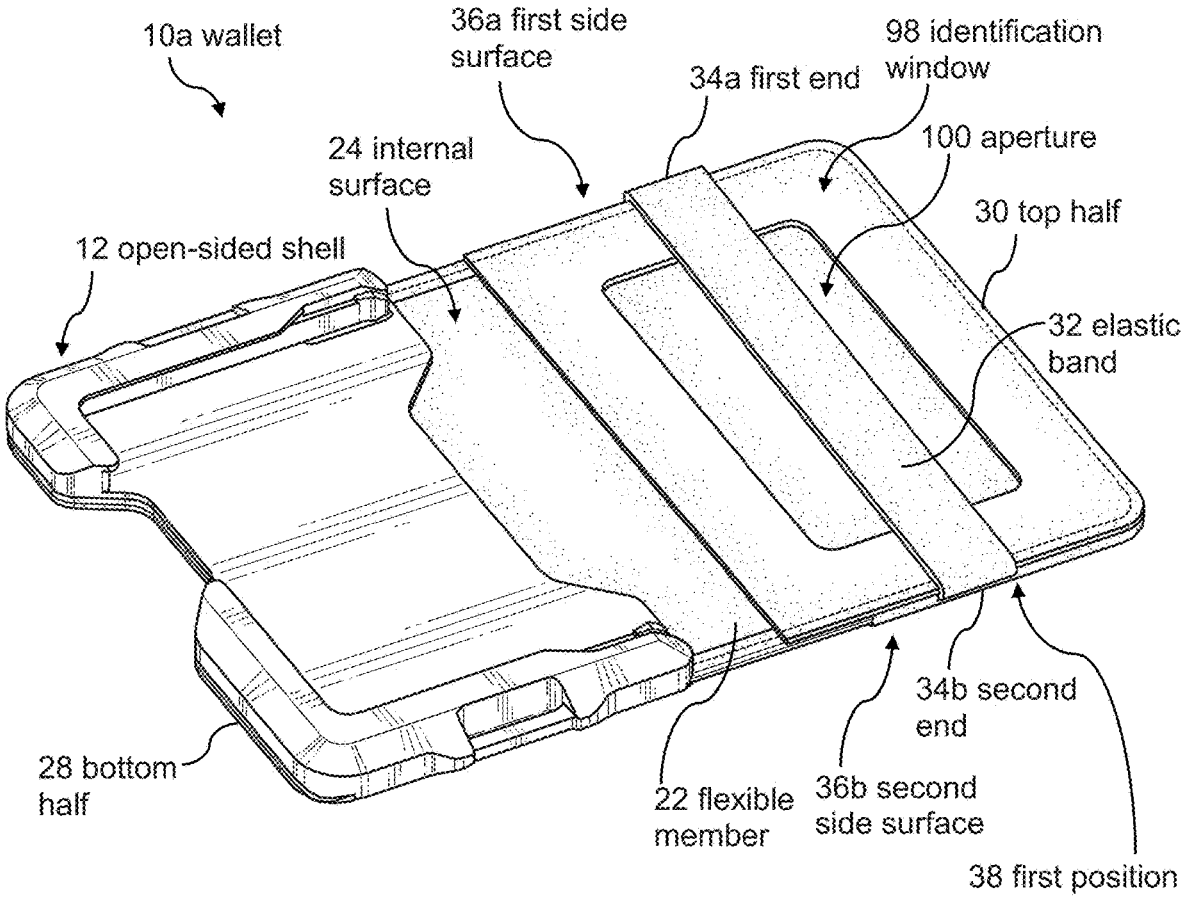
Figure 6:
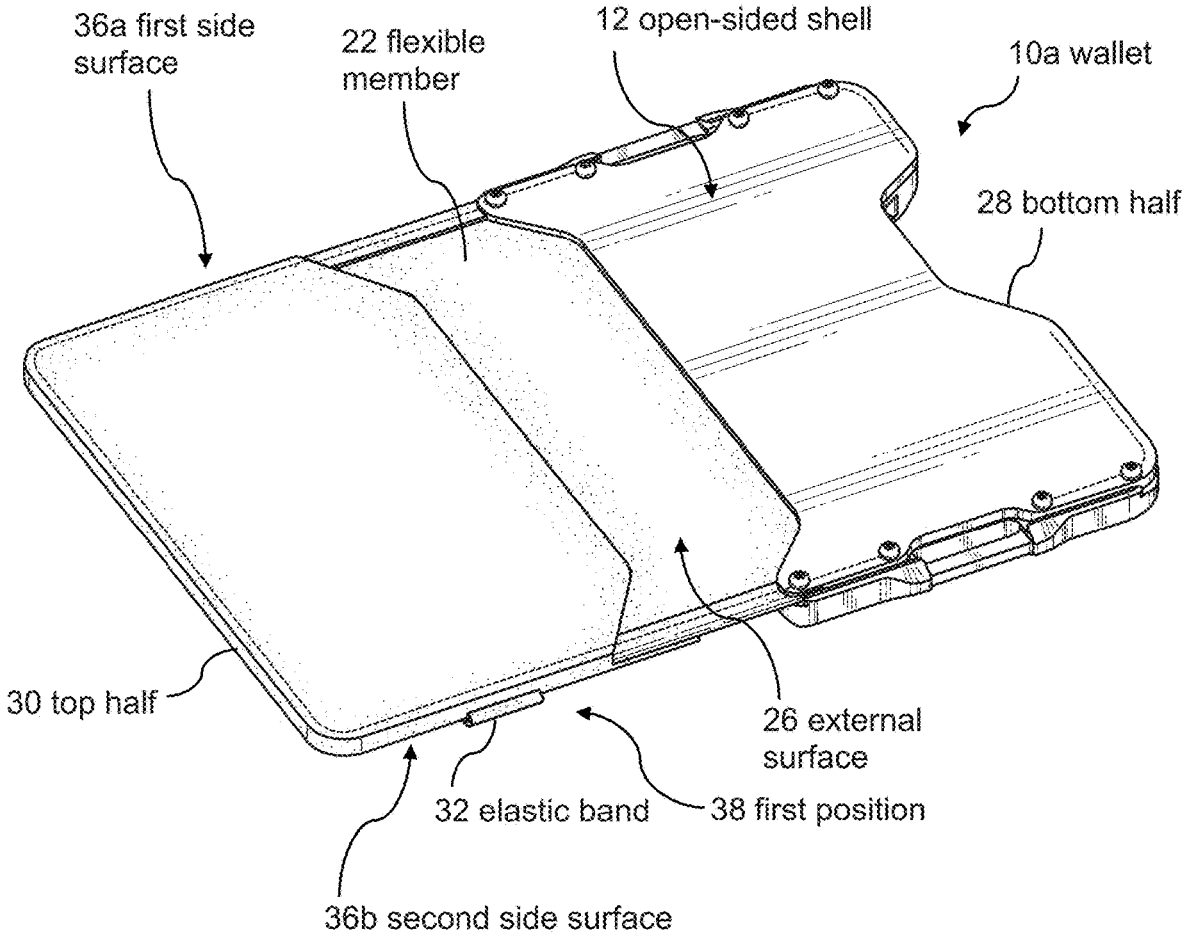

FIG. 5, similar to FIG. 3, shows the wallet 10*a* with the elastic band 32 in the first position 38. As previously mentioned, the elastic band 32 may comprise a first end 34*a* located opposite a second end 34*b*, and, when in the first position 38, the elastic band 32 may be configured to wrap around the internal surface 24 of the top half 30, such that the band 32 extends across the identification window 98. In many embodiments, the elastic band 32 is located near a center portion of the identification window 98, such that when the elastic band 32 is in the first position 38, it extends across substantially the center of the identification window 98 and aperture 100. The elastic band 32 may be off-center with respect to the identification window 98. FIG. 6 shows a back perspective view of the wallet 10*a* with the elastic band 32 in the first position 38. As illustrated, the elastic band 32 is visible coupled to the second side surface 36*b*, but does not extend across the external surface 26 of the flexible member 22.

Figure 8:
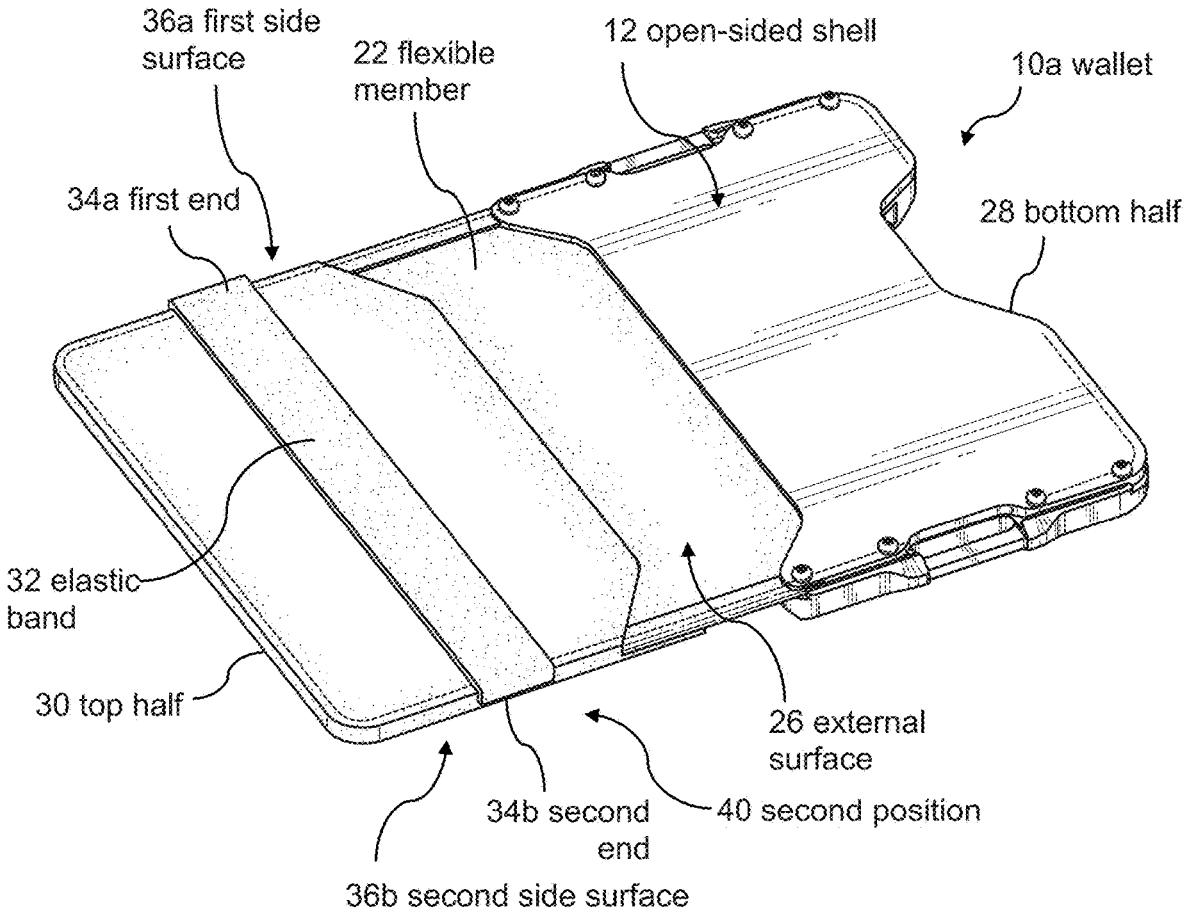

FIG. 7, similar to FIG. 4, shows the wallet 10*a* with the elastic band 32 in the second position 40. As previously stated, when the elastic band 32 is in the second position 40, it may be configured to wrap around an external surface 26 of the top half 30 of the flexible member 22. As such, in the second position 40, the elastic band 32 may not extend across an internal surface 24 of the top half 30, as indicated by FIG. 7. FIG. 8 shows a back perspective view of the wallet 10*a* with the elastic band 32 in the second position 40, and shows the band 32 extending across the external surface 26 of the top half 30. In many embodiments, the elastic band 32 extends from a first end 34*a* coupled to a first side surface 36*a* of the top half 30 to a second end 34*b* coupled to a second side surface 36*b* of the top half 30. The elastic band 32 may be configured to extend across substantially a center portion of the second external pocket 110.

It should be noted that FIGS. 3-8 all illustrate the wallet 10*a* in the open position 44, as shown in FIGS. 1A and 1C. In some embodiments, when the wallet 10*a* is in the open position 44, the flexible member 22 lies substantially flat such that the top half 30 of the internal surface 24 of the flexible member 22 and the personal card receiving surface 14 of the open-sided shell 12 both substantially face the same direction. The direction may be "up," "down," "left," or "right," depending on the orientation of the wallet 10*a*. For example, if the wallet 10*a* is lying flat on a table with the external surface 26 against the table, the direction would be considered "up." If the wallet 10*a* is lying flat on a table with the internal surface 24 against the table, the direction would be considered "down."

Figure 9:
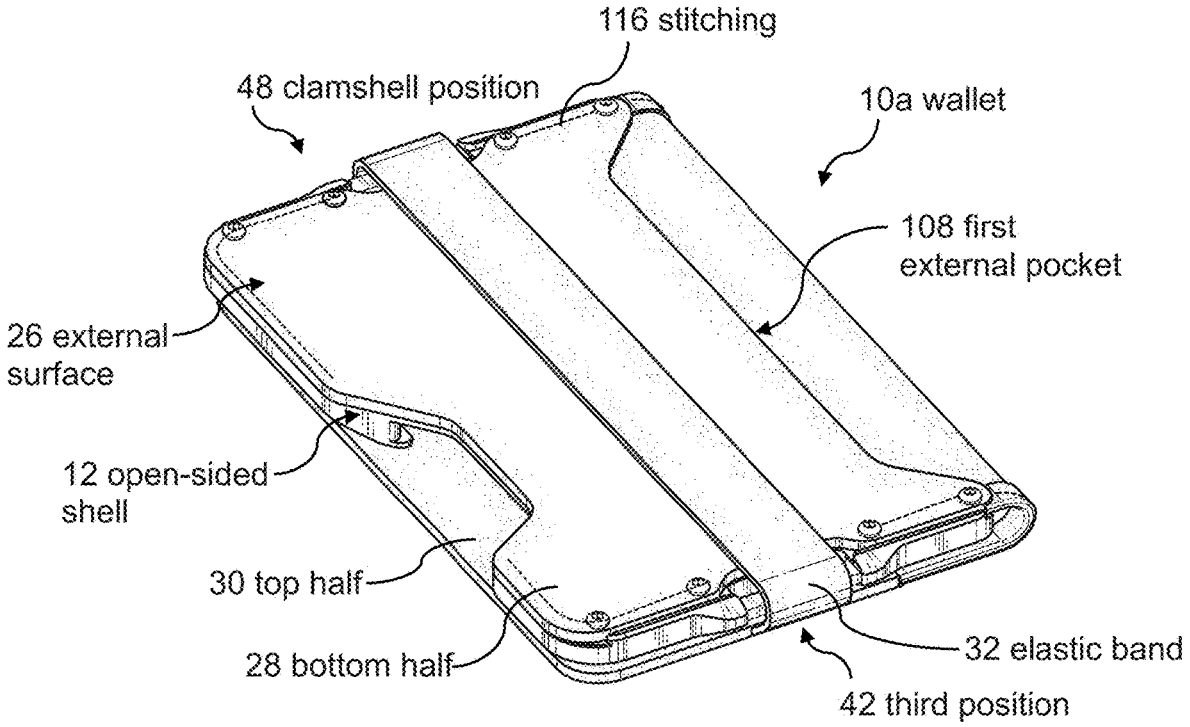
FIGS. 9 and 10 illustrate perspective views of a wallet in a clamshell position and a closed position, respectively, according to some embodiments.

FIG. 9 illustrates a perspective view of the wallet 10*a* in the clamshell position 48, with the elastic band 32 in the third position 42. In contrast to the first position 38 and the second position 40, where the elastic band 32 wraps around just the top half 30 of the flexible member 22, in the third position 42, the elastic band 32 may be configured to wrap around the bottom half 28 of the flexible member 22. As such, in the third position 42, the elastic band 32 may be configured to hold the wallet 10*a* shut (i.e., in the clamshell position 48). FIG. 9 also shows that, in many embodiments, when the elastic band 32 is in the third position 42, the elastic band 32 is configured to extend across the first external pocket 108. The elastic band 32 may be configured to extend across substantially a center portion of the first external pocket 108. As previously discussed, the first external pocket 108 may be coupled to the external surface 26 of the bottom half 28 of the flexible member 22, and located opposite the open-sided shell 12. In many embodiments, when the wallet 10*a* is in the clamshell position 48, the internal surface 24 of the top half 30 of the flexible member 22 is folded over the personal card receiving surface 14 of the open-sided shell 12 such that the internal surface 24 of the top half 30 of the flexible member 22 faces the personal card receiving surface 14. The internal surface 24 of the top half 30 may be configured to contact at least a portion of the open-sided shell 12.

As discussed with reference to FIGS. 3 and 4, the elastic band 32 may be used to hold additional card(s) and/or currency against the wallet 10*a*. For example, when the wallet 10*a* is in the clamshell position 48 as shown in FIG. 9, the elastic band 32 may be configured to hold card(s) and/or currency between the band 32 and the first external pocket 108. In addition, the clamshell position 48 may enable a user to partially open the wallet 10*a* in order to place and/or retrieve card(s) and/or currency between the top half 30 and the bottom half 28, without changing the position of the elastic band 32.

Figure 10:
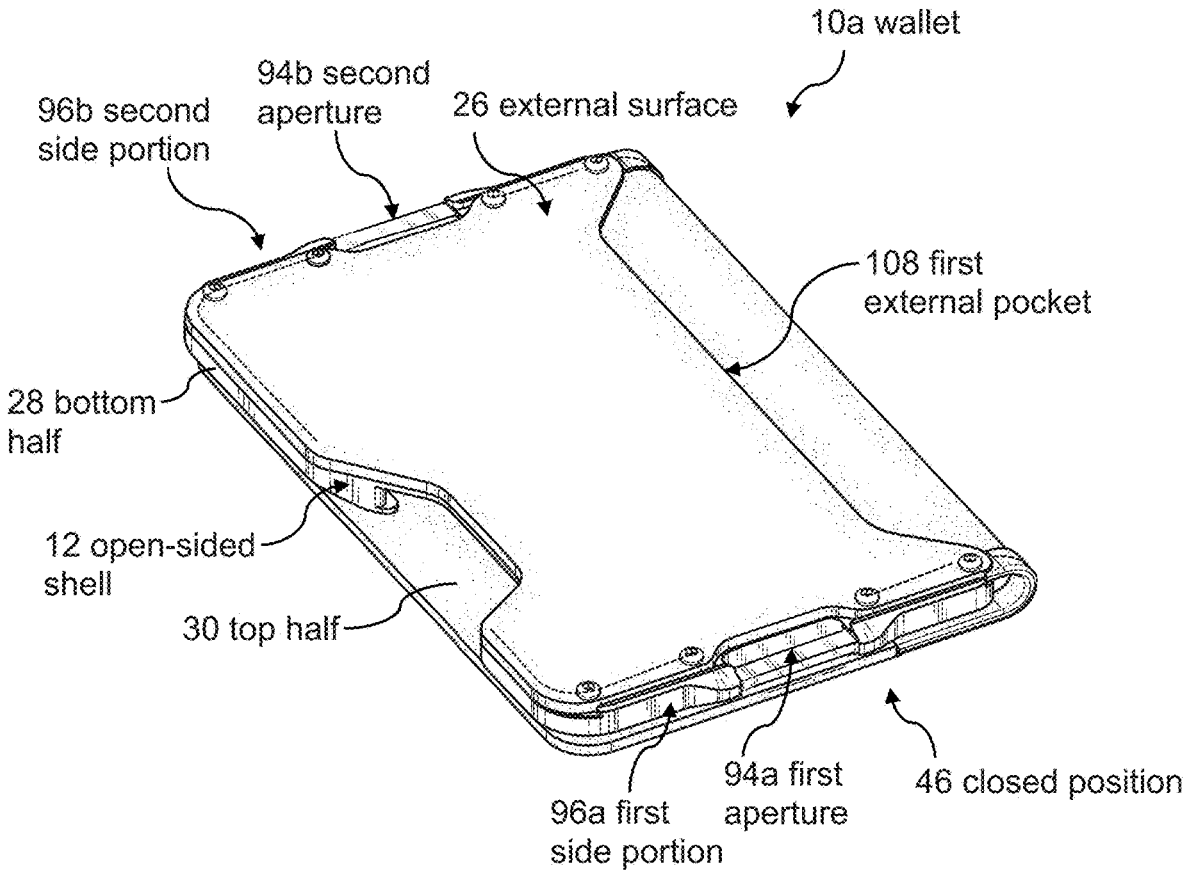

FIG. 10 shows a perspective view of the wallet 10*a* in the closed position 46. Though similar to the clamshell position 48, the closed position 46 does not include the elastic band 32 in the third position 42 wrapped around the bottom half 28. Instead, in many embodiments, when the wallet 10*a* is in the closed position 46, the elastic band 32 is configured to be in either the first position 38 or the second position 40, where the elastic band 32 is wrapped around only the top half 30. When the wallet 10*a* is in the closed position 46, the internal surface 24 of the top half 30 of the flexible member 22 may be folded over the personal card receiving surface 14 of the open-sided shell 12 such that the internal surface 24 of the top half 30 of the flexible member 22 faces the personal card receiving surface 14 of the open-sided shell 12. In some embodiments, the internal surface 24 of the top half 30 is configured to contact at least a portion of the open-sided shell 12.

FIG. 10 also shows that, in some embodiments, the wallet 10*a* includes a first aperture 94*a* and a second aperture 94*b* located opposite the first aperture 94*a*. The first aperture 94*a* may be located along a first side portion 96*a* of the open-sided shell 12 and the second aperture 94*b* may be located along a second side portion 96*b* of the open-sided shell 12, as illustrated in FIG. 10. As shown in FIG. 9, when the wallet 10*a* is in the clamshell position 48, the elastic band 32 may be configured to wrap around the first and second apertures 94*a*, 94*b*. The apertures 94*a*, 94*b* may help hold the elastic band 32 in place around the wallet 10*a* and prevent movement of the band 32 along the first and second side portions 96*a*, 96*b* of the open-sided shell 12. In some embodiments, the composition of each of the first and second apertures 94*a*, 94*b* includes each aperture itself as well as the surrounding structure of the open-sided shell 12. An outermost portion of the open-sided shell may include a central indented portion bordered by raised side walls that create a sort-of channel to help retain the elastic band 32 and prevent unwanted movement. The first and second apertures 94*a*, 94*b* may also be used to couple accessory devices (e.g., keyring/keychain, carabiner, and the like) to the wallet 10*a*.

It should also be noted that, in some embodiments, rather than coupling the elastic band 32 to the top half 30 of the flexible member 22, the elastic band 32 may be configured to couple to the bottom half 28 of the flexible member 22. For example, the elastic band 32 may be configured to couple along the first side portion 96*a* and second side portion 96*b*, and wrap around only the bottom half 28 (in modified first and second positions), or around both the bottom half 28 and top half 30 (in a modified third position). The elastic band 32 may be configured to couple within the first and second apertures 94*a*, 94*b*, or may be configured to couple to the first external pocket 108 adjacent the first and second apertures 94*a*, 94*b*. The elastic band 32 may be configured to couple between the open-sided shell 12 and the bottom half 28 of the flexible member 22 (e.g., on the back surface 16 of the open-sided shell 12).

In many embodiments, as shown in FIGS. 11-18, the open-sided shell 12 of the wallet 10*a* comprises a first side wall 50*a* and a second side wall 50*b* located opposite the first side wall 50*a*. The open-sided shell 12 may also include a bottom side wall 50*c*, which will be discussed in greater detail later in the disclosure. The first side wall 50*a*, second side wall 50*b*, and bottom side wall 50*c* may be configured to retain the at least one personal card 18 in place with respect to the personal card receiving surface 14. In some embodiments, the first side wall 50*a* includes comprises a first retention tab 52*a* configured to move away from the second side wall 50*b* to thereby receive the at least one personal card 18. Similarly, the second side wall 50*b* may comprise a second retention tab 52*b* configured to move away from the first side wall 50*a* to thereby receive the at least one personal card 18. Each of the first and second side walls 50*a*, 50*b* may define a top portion and a bottom portion located adjacent the bottom side wall 50*c*, wherein the retention tabs 52*a*, 52*b* may be located adjacent the respective top portions. The top and bottom portions of each side wall 50*a*, 50*b* will be discussed further later in the disclosure. The previously mentioned "rail system" may include the first side wall 50*a*, second side wall 50*b*, and bottom side wall 50*c*, as well as the first and second retention tabs 52*a*, 52*b*.

Figure 11:
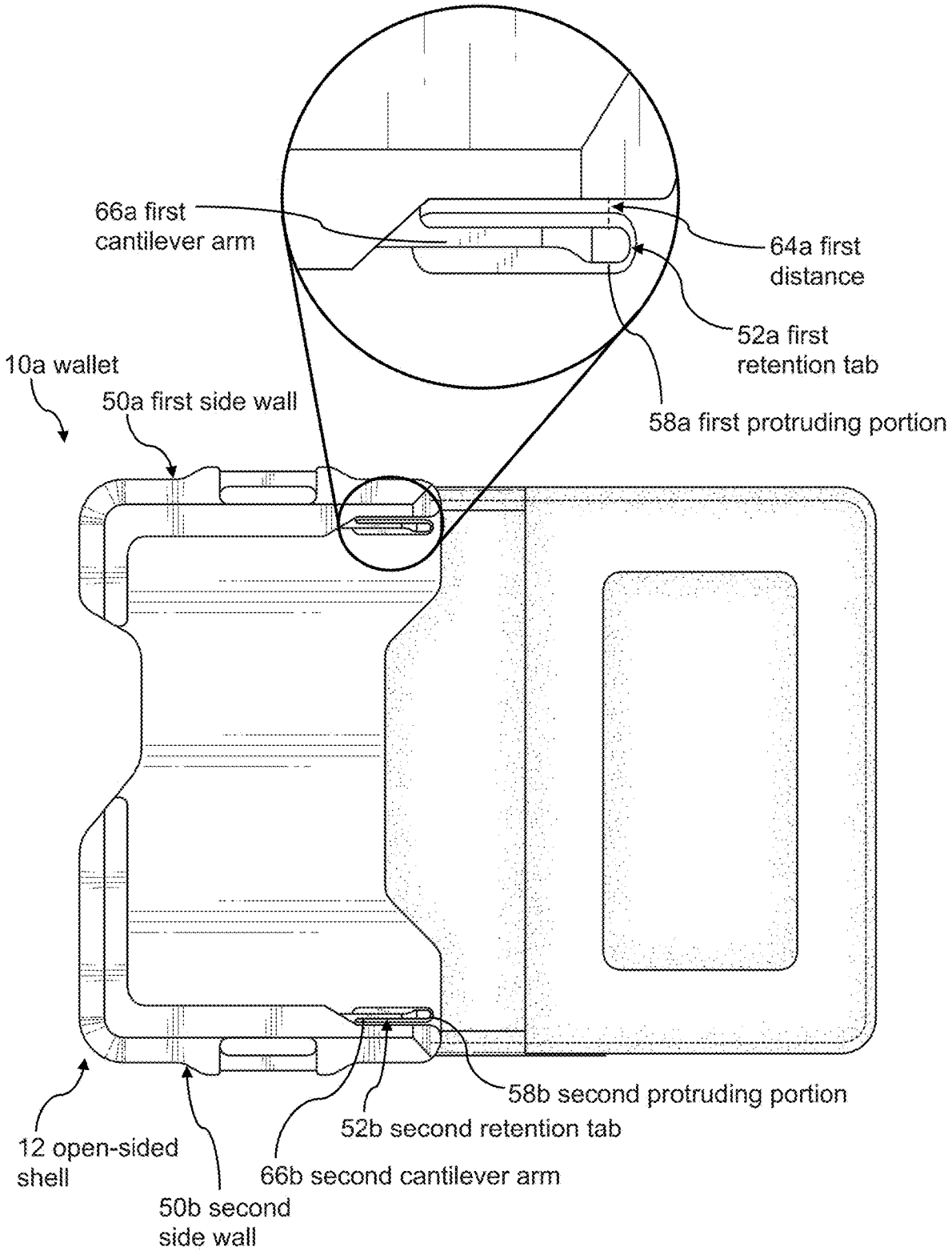
FIG. 11 illustrates a front interior view of a wallet, according to some embodiments.

FIG. 11 illustrates a front interior view of the wallet 10*a*, including an inset view of a first retention tab 52*a*. The inset view shows that, in many embodiments, the first retention tab 52*a* includes a first cantilever arm 66*a* as well as a first protruding portion 58*a*. The first protruding portion 58*a* may be configured to secure the at least one personal card 18 in place with respect to the personal card receiving surface 14. Similarly, in many embodiments, the second retention tab 52*b* comprises a second cantilever arm 66*b* and a second protruding portion 58*b* configured to secure the at least one personal card 18 in place with respect to the personal card receiving surface 14. As illustrated in the inset view of FIG. 11, the first cantilever arm 66*a* may be physically spaced a first distance 64*a* from a remaining portion of the first side wall 50*a*. Accordingly, the second cantilever arm 66*b* may also be physically spaced a first distance 64*a* from a remaining portion of the second side wall 50*b*. In many embodiments, the first and second retention tabs 52*a*, 52*b* are configured to move between a locked position 60, as shown in FIG. 13, and a receiving position 62, as shown in FIG. 12.

Figure 12:
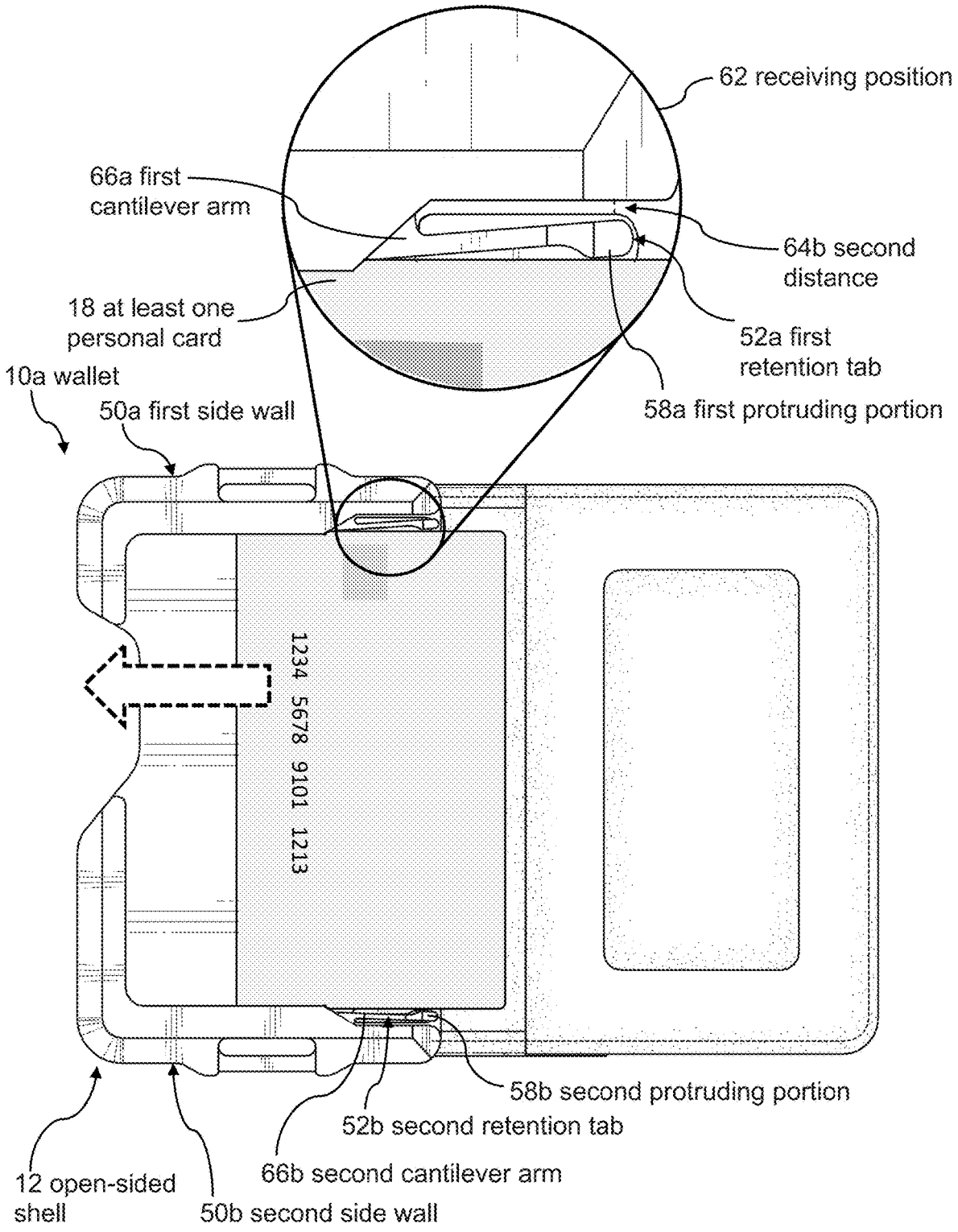
FIGS. 12, 13, 14, 15, 16, 17, and 18 illustrate front interior views of a wallet and at least one personal card, according to some embodiments.

FIG. 12 shows a view similar to FIG. 11, but includes the at least one personal card 18 being inserted into the open-sided shell 12, as indicated by the dashed block arrow. As such, FIG. 12 illustrates the first and second retention tabs 52*a*, 52*b* in the receiving position 62. The inset view of FIG. 12 illustrates that, in the receiving position 62, the first retention tab 52*a* moves toward the remaining portion of the first side wall 50*a*, reducing the size of the gap between the first retention tab 52*a* and the first side wall 50*a*. As shown, in the receiving position 62, the first retention tab 52*a* is spaced a second distance 64*b* from the first side wall 50*a*. Comparing FIG. 12 to FIG. 11 demonstrates that, in many embodiments, the second distance 64*b* is less than the first distance 64*a*, as the first retention tab 52*a* is closer to the first side wall 50*a* in the receiving position 62. In many embodiments, the same is true for the second retention tab 52*b*, as it moves toward the remaining portion of the second side wall 50*b* thereby reducing the size of the gap between the second retention tab 52*b* and the second side wall 50*b*. In the receiving position 62, the second retention tab 52*b* may be located substantially the same second distance 64*b* from the second side wall 50*b* as the second distance 64*b* between the first retention tab 52*a* and the first side wall 50*a*.

Figure 13:
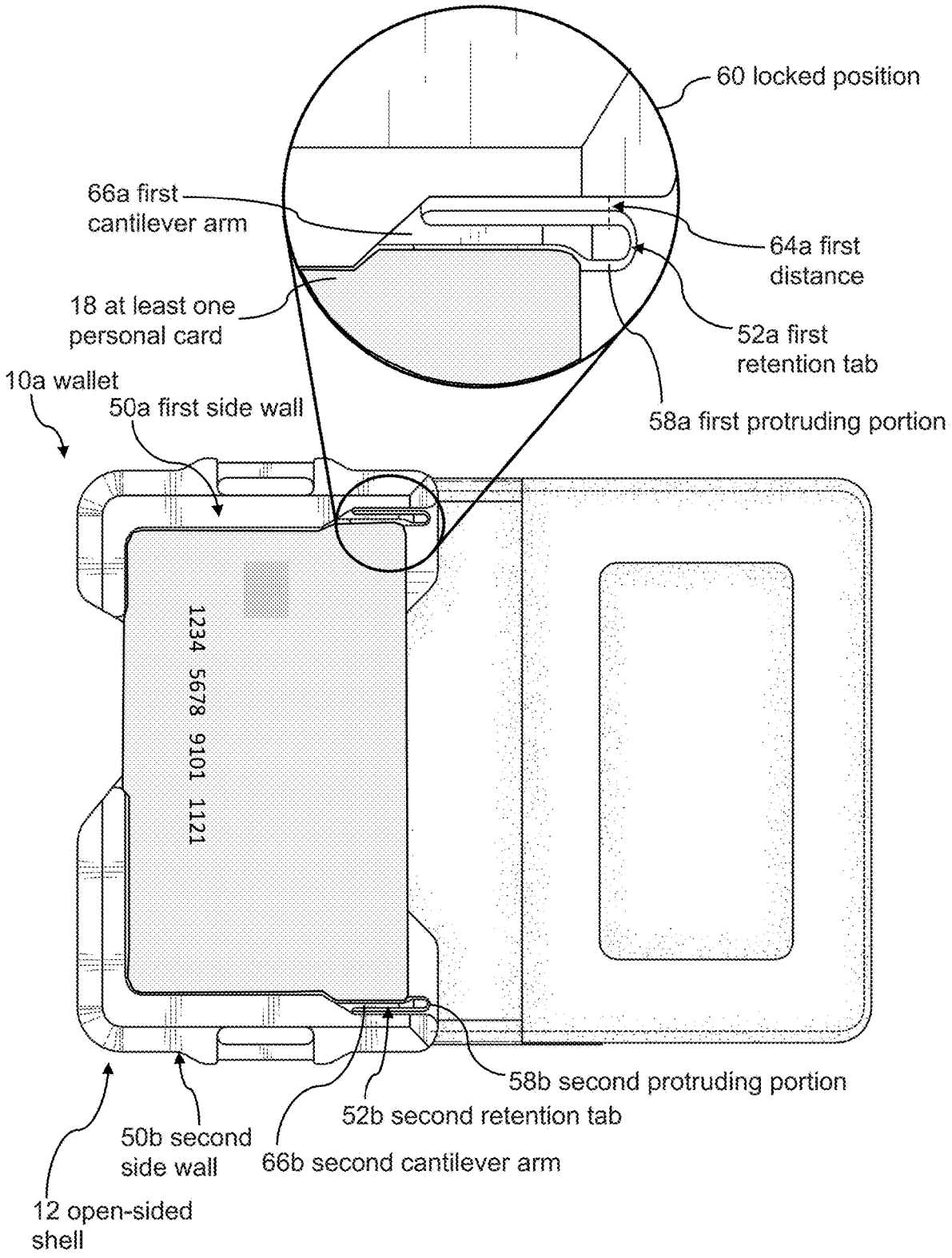

Speaking in terms of distance between the first retention tab 52*a* and the second retention tab 52*b*, in some embodiments, when the first retention tab 52*a* and the second retention tab 52*b* are in a locked position 60 (as shown in FIG. 13), the first retention tab 52*a* is located a first distance from the second retention tab 52*b*. When the first and second retention tabs 52*a*, 52*b* are in the receiving position 62 (as shown in FIG. 12), the first retention tab 52*a* may be located a second distance from the second retention tab 52*b*. In some embodiments, the second distance is greater than the first distance, as the retention tabs 52*a*, 52*b* move away from one another in order to receive the at least one personal card 18. Stated differently, when the open-sided shell 12 receives the at least one personal card 18, the first retention tab 52*a* may be configured to move away from the second side wall 50*b* and the first retention tab 52*b* may be configured to move away from the first side wall 50*a*.

FIG. 13 shows the wallet 10*a* coupled to the at least one personal card 18 in the locked position 60. As indicated by the inset view, in the locked position 60, the first retention tab 52*a* may be configured to move away from the remaining portion of the first side wall 50*a* such that the first retention tab 52*a* returns to the first distance 64*a* from the first side wall 50*a*, as shown in FIG. 11. Accordingly, the first and second retention tabs 52*a*, 52*b* may be configured to reside in the same position when there is no personal card coupled to the wallet 10*a*, as shown in FIG. 11, and when there is at least one personal card 18 securably coupled to the wallet 10*a*, as shown in FIG. 13. In some embodiments, the difference between the first distance 64*a* and second distance 64*b* is about a few millimeters. The first and second retention tabs 52*a*, 52*b* may be configured to flex only as much as needed to receive and/or release the at least one personal card 18. As shown in the inset view, when the at least one personal card 18 is coupled to the wallet 10*a* and the first retention tab 52*a* is in the locked position 60, a corner of the at least one personal card 18 may be configured to fit adjacent the retention tab 52*a* between the first protruding portion 58*a* and the first cantilever arm 66*a*. The corner of the at least one personal card 18 may be configured to fit just below the first protruding portion 58*a*. In many embodiments, the same is true for the second retention tab 52*b*.

Figure 14:
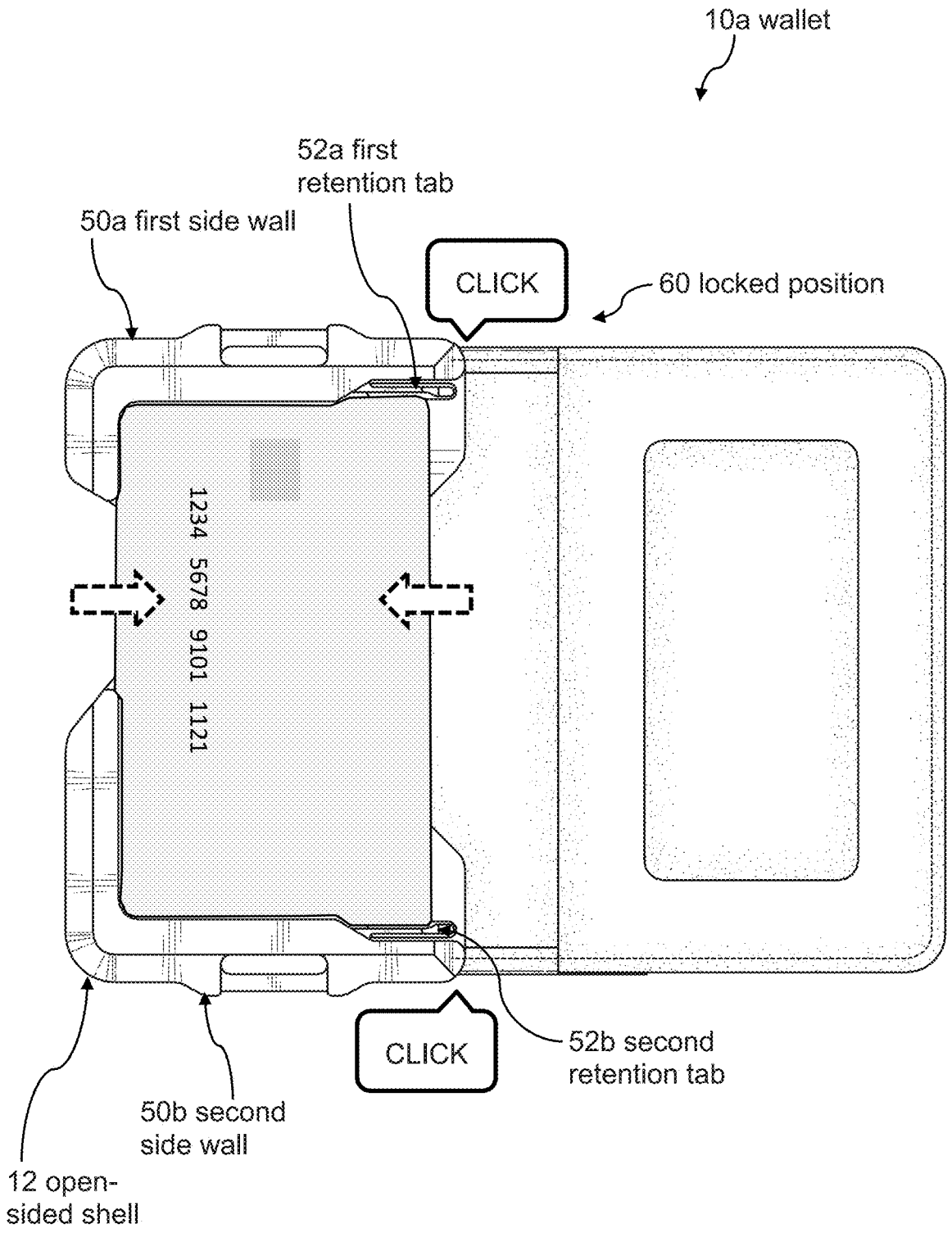

FIG. 14 also shows the wallet 10*a* coupled to the at least one personal card 18 in the locked position 60. In some embodiments, when the open-sided shell 12 securably couples the at least one personal card 18 within an internal portion 20 of the shell 12, the first retention tab 52*a* moves towards the second side wall 50*b* and the second retention tab 52*b* moves towards the first side wall 50*a*. Securably coupling the at least one personal card 18 within the open-sided shell 12 may result in an audible sound, as indicated by each of the "CLICK" word bubbles in FIG. 14. In some embodiments, the audible sound is caused by the first and second retention tabs 52*a*, 52*b* moving back toward one another to their original position, or the position shown in FIGS. 11 and 13. The audible noise may also be caused by the at least one personal card 18 contacting a bottom side wall 50*c* of the open-sided shell 12. The audible noise may be caused by a combination of sources, and the volume of the noise may vary depending on the number of personal cards coupled to the open-sided shell 12.

Figure 15:
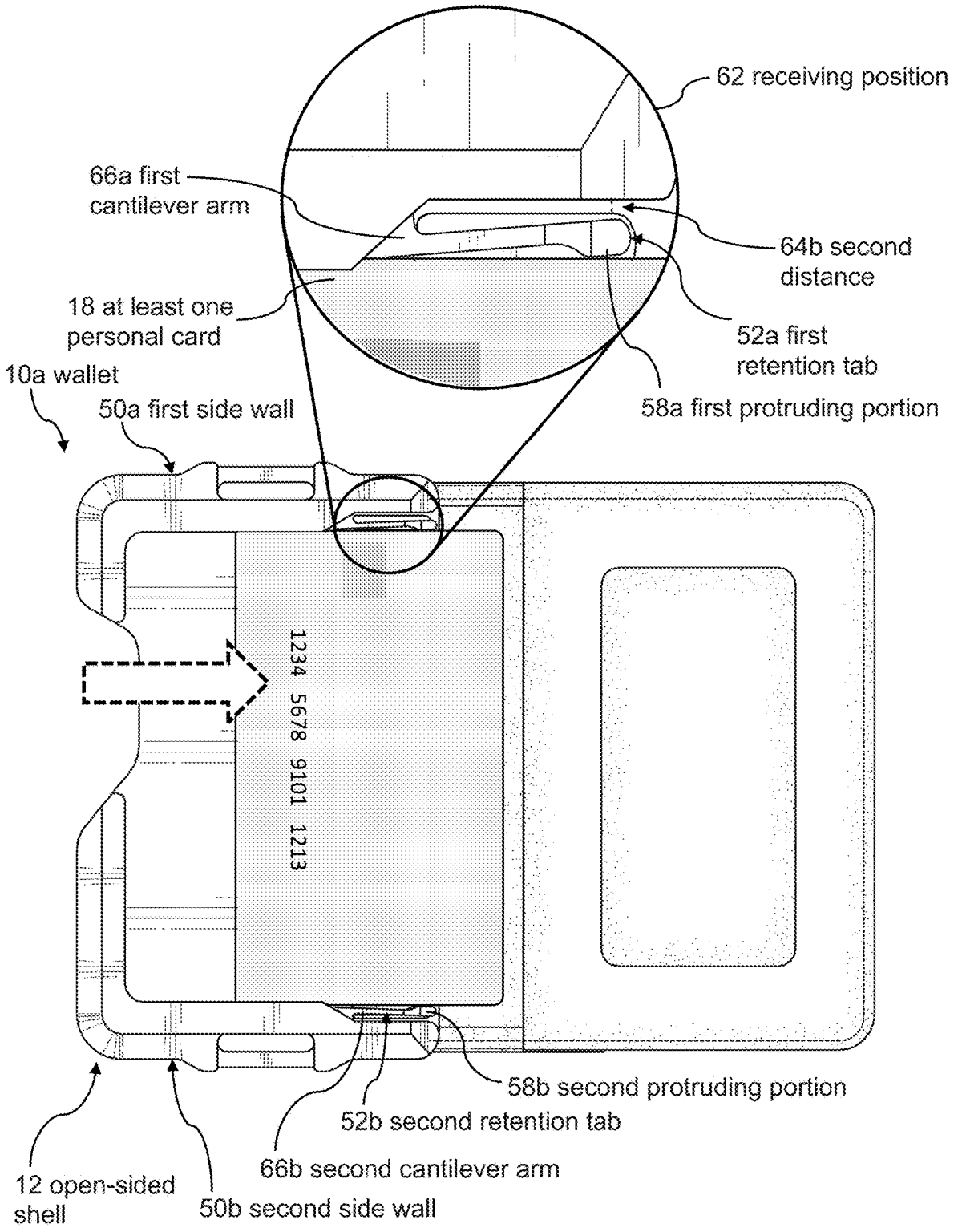

FIG. 15 is similar to FIG. 12, but rather than illustrating the at least one personal card 18 being inserted into the open-sided shell 12, FIG. 15 shows the at least one personal card 18 being removed from the open-sided shell 12, as indicated by the dashed block arrow. In many embodiments, the at least one personal card 18 is removed by pushing the card 18 from an open area in the bottom side wall 50*c*, which will be discussed in greater detail later in the disclosure. The inset view of FIG. 15 shows that the first retention tab 52*a* (and second retention tab 52*b*) assume the receiving position 62 during removal of the at least one personal card 18. Accordingly, during removal of the at least one personal card 18, the first retention tab 52*a* and second retention tab 52*b* move toward the first and second side walls 50*a*, 50*b*, respectively, thereby reducing the gap between each retention tab 52*a*, 52*b* and each side wall 50*a*, 50*b*. As with insertion of the at least one personal card 18, the gap between each retention tab 52*a*, 52*b* and each respective side wall 50*a*, 50*b* may comprise the second distance 64*b*. In some embodiments, the open-sided shell 12 creates an audible noise upon complete removal of the at least one personal card 18.

It should be noted that FIGS. 12-15 illustrate a method of inserting and removing at least one personal card 18 where, in many embodiments, the at least one personal card 18 is contacting the protruding portions 58*a*, 58*b* substantially the entire time until the at least one personal card 18 is securably coupled or completely removed. These FIGS. illustrate only one way to insert and/or remove the at least one personal card 18, which may be thought of as a "straight-on" insertion/removal. During the "straight-on" insertion/removal, the at least one personal card 18 may remain substantially parallel to the personal card receiving surface 14.

Figure 16:
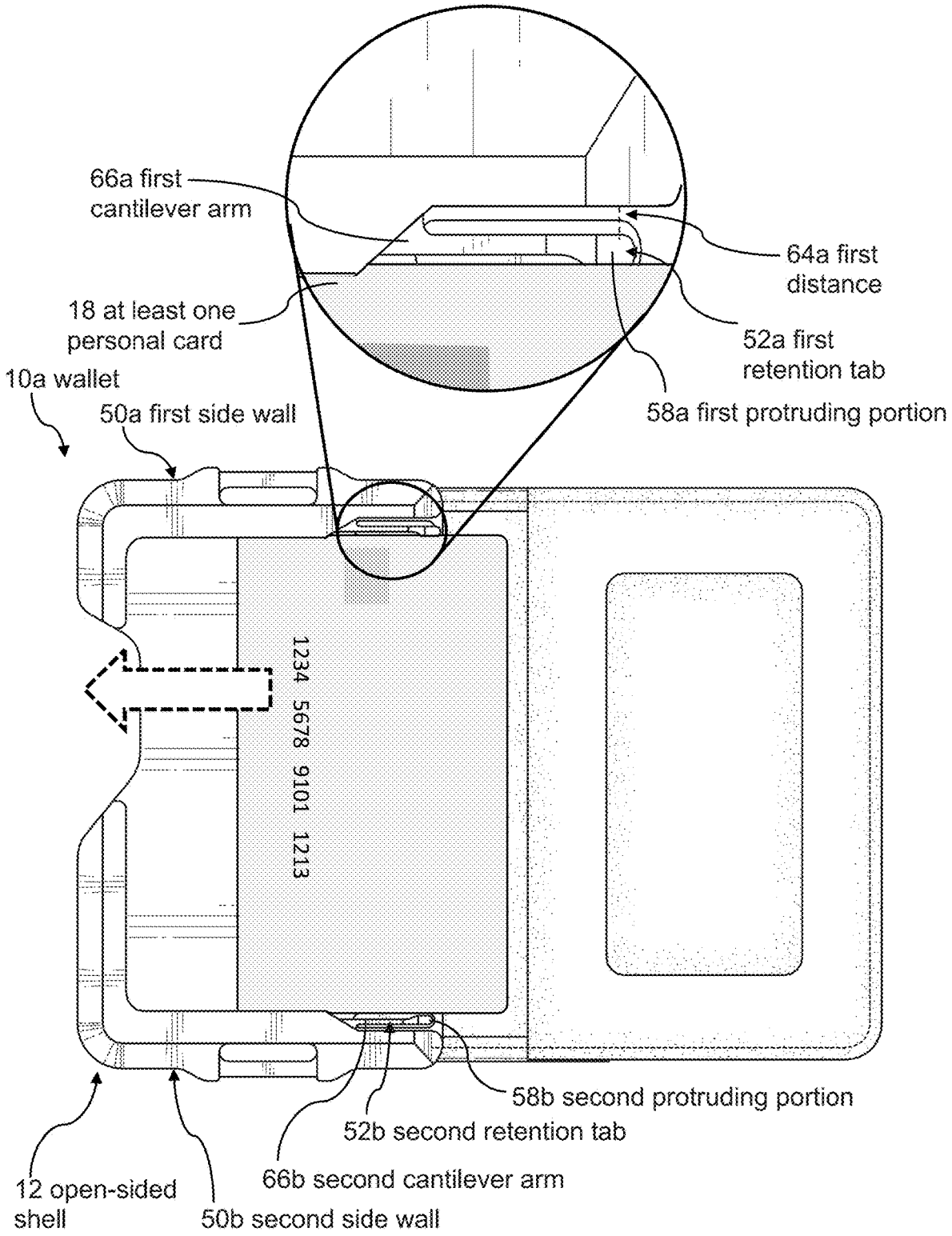
Figure 17:
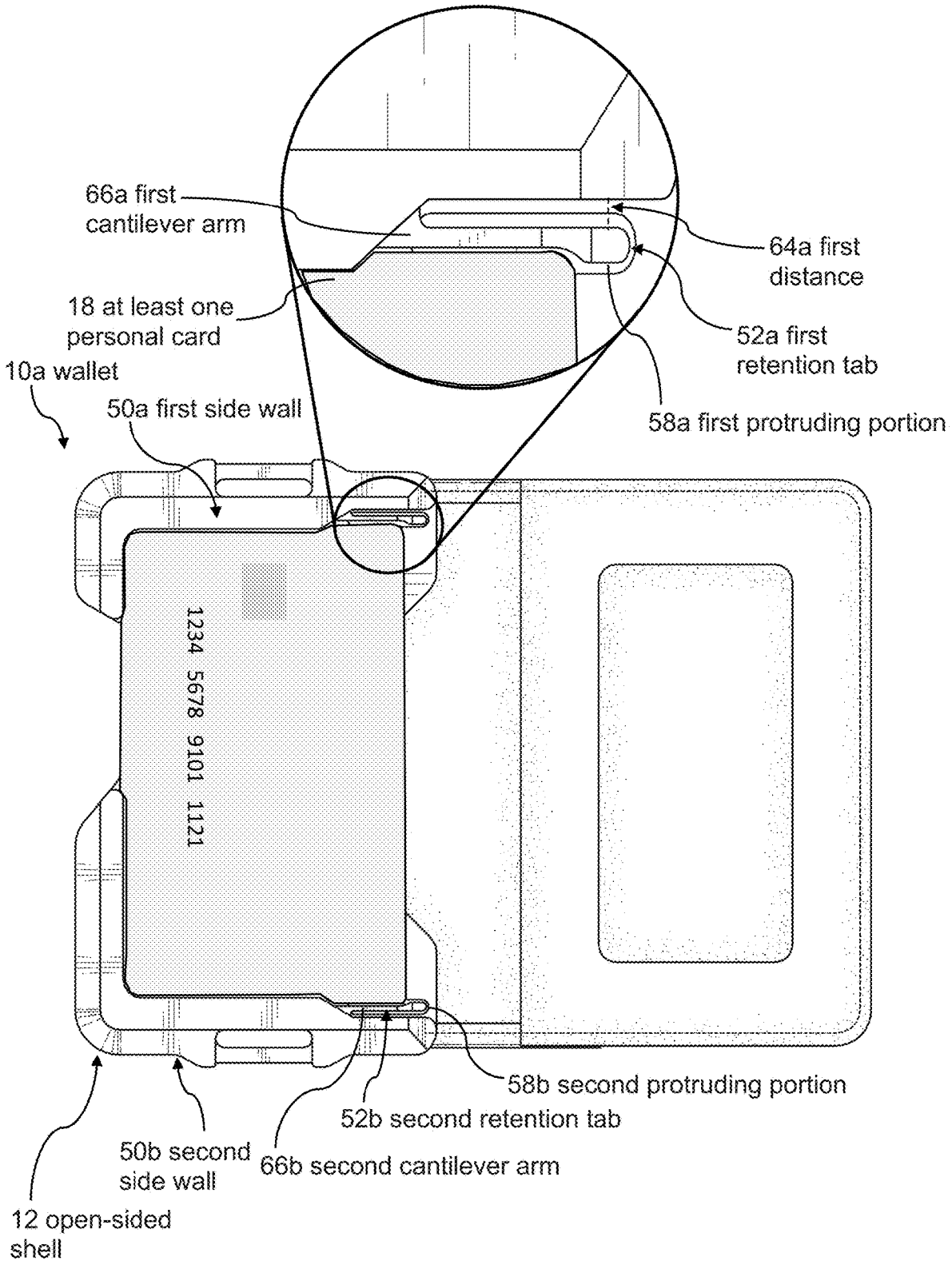
Figure 18:
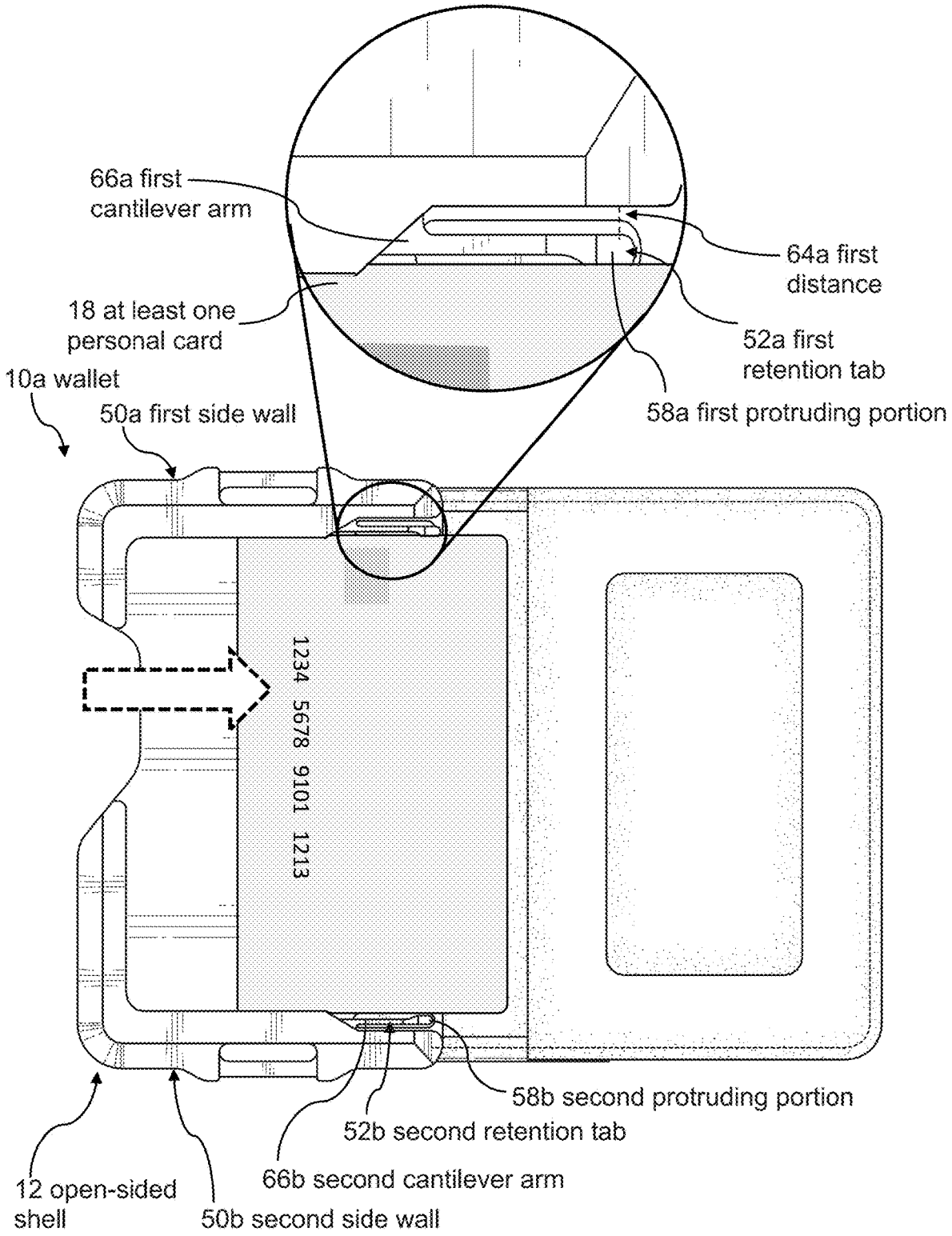

In contrast, FIGS. 16-18 illustrate a different method of inserting and removing at least one personal card 18. Beginning with FIG. 16, the at least one personal card 18 is shown being inserted into the open-sided shell 12. The inset view demonstrates that the first retention tab 52*a* may be configured to not move during insertion of the at least one personal card 18, as the card 18 enters the open-sided shell 12 at an angle over the retention tabs 52*a*, 52*b*, rather than next to the retention tabs 52*a*, 52*b*, as previously described. Depending on the number of personal cards 18 already coupled to the open-sided shell 12, it may be possible that the at least one personal card 18 does not contact either the first or second retention tab 52*a*, 52*b* during insertion and/or removal (shown in FIG. 18) using the "angled" method. In some embodiments, when the at least one personal card 18 is inserted into and/or removed from the open-sided shell 12 using the "angled" method, the at least one personal card 18 may form an angle of up to about 45 degrees with the personal card receiving surface 14. The at least one personal card 18 may form an angle of greater than 45 degrees with the personal card receiving surface 14.

The inset views of FIGS. 16, 17, and 18 further illustrate the static nature of the first retention tab 52*a*, by showing that during insertion of the at least one personal card 18 (FIG. 16), secured coupling of the at least one personal card 18 (FIG. 17), and removal of the at least one personal card 18 (FIG. 18), the first retention tab 52*a* remains at a location a first distance 64*a* from the remaining portion of the first side wall 50*a*. In many embodiments, the second retention tab 52*b* is also static throughout insertion, coupling, and removal of the at least one personal card 18. FIG. 17 also shows that, as illustrated in FIG. 13, the at least one personal card 18 may be configured to fit adjacent the first cantilever arm 66*a* with a corner of the card 18 located just below the first protruding portion 58*a*. In many embodiments, the fit is in the same on the opposite edge of the card 18 adjacent the second cantilever arm 66*b* and second protruding portion 58*b*.

Figure 19:
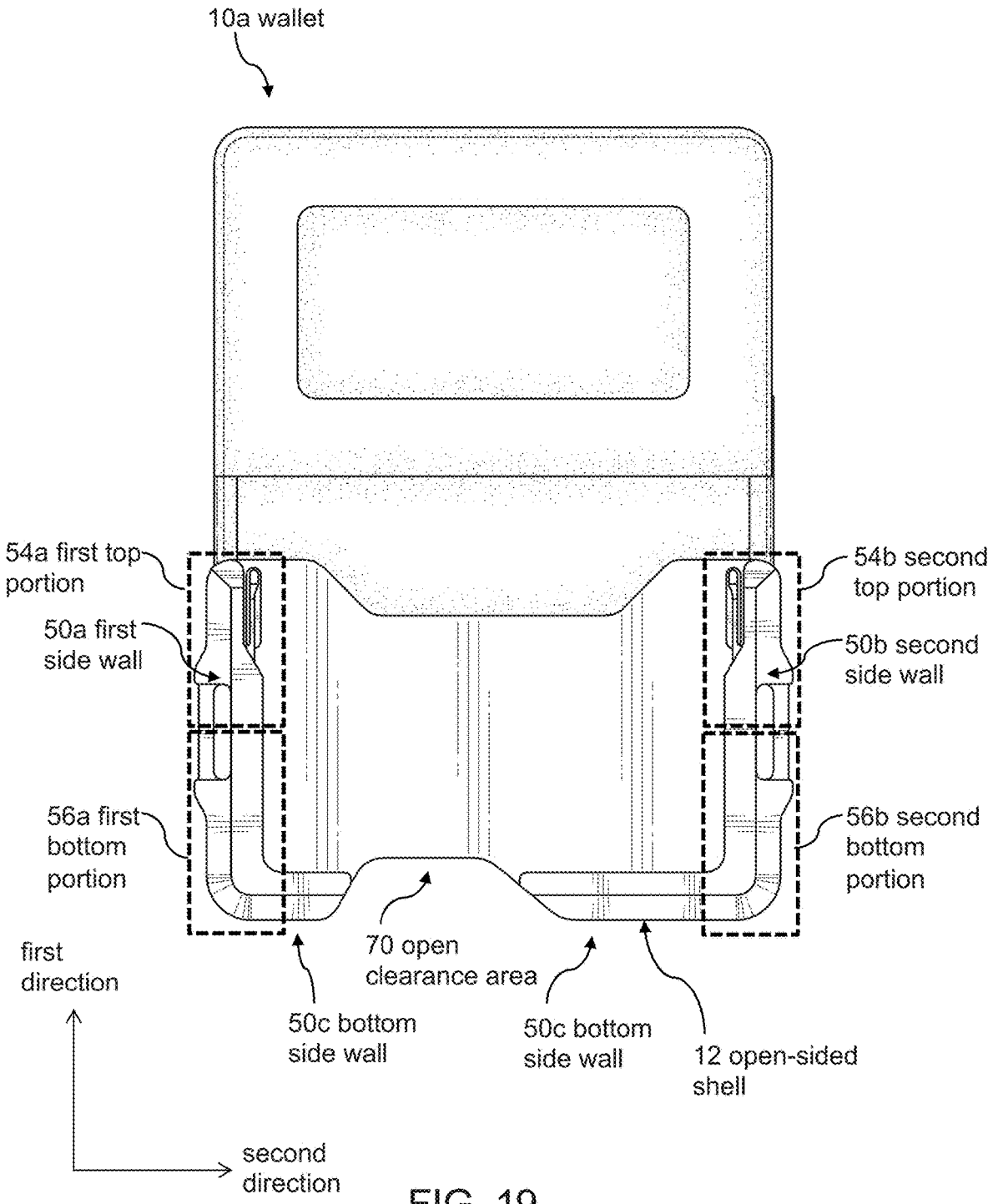
FIG. 19 illustrates a front interior view of a wallet including a first side wall and a second side wall, according to some embodiments.

Turning now to FIG. 19, a front interior view of the wallet 10*a* is shown. FIG. 19 illustrates the first side wall 50*a*, the second side wall 50*b*, and the bottom side wall 50*c* of the open-sided shell 12. In many embodiments, the first side wall 50*a* includes a first top portion 54*a* and a first bottom portion 56*a*. Similarly, the second side wall 50*b* may include a second top portion 54*b* and a second bottom portion 56*b*. In many embodiments, the first and second retention tabs 52*a*, 52*b* are located adjacent the first and second top portions 54*a*, 54*b*, respectively. The first and second bottom portions 56*a*, 56*b* may be configured to couple to the bottom side wall 50*c*. Though illustrated in FIG. 19 as dissecting the first and second apertures 94*a*, 94*b*, it should be noted that the top and bottom portions 54, 56 may be larger or smaller than represented in FIG. 19. For example, in some embodiments, the first and second top portions 54*a*, 54*b* include the portions of the first and second side walls 50*a*, 50*b* located above the apertures 94*a*, 94*b*, while the first and second bottom portions 56*a*, 56*b* include the portions of the first and second side walls 50*a*, 50*b* extending from the top of each aperture 94*a*, 94*b* to the bottom side wall 50*c*. The first and second top portions 54*a*, 54*b* may include the entire aperture 94*a*, 94*b*, while the first and second bottom portions 56*a*, 56*b* extend from below the apertures 94*a*, 94*b* to the bottom side wall 50*c*.

FIG. 19 also includes a directional indicator, comprising a first direction and a second direction perpendicular to the first direction. In many embodiments, the first side wall 50*a* and the second side wall 50*b* are elongate along the first direction, and the bottom side wall 50*c* is elongate along the second direction. Though not shown in FIG. 19, the elastic band 32 may be configured to extend across the top half 30 and/or bottom half 28 of the wallet 10*a* along the second direction, as illustrated in previous Figures.

Figure 20:
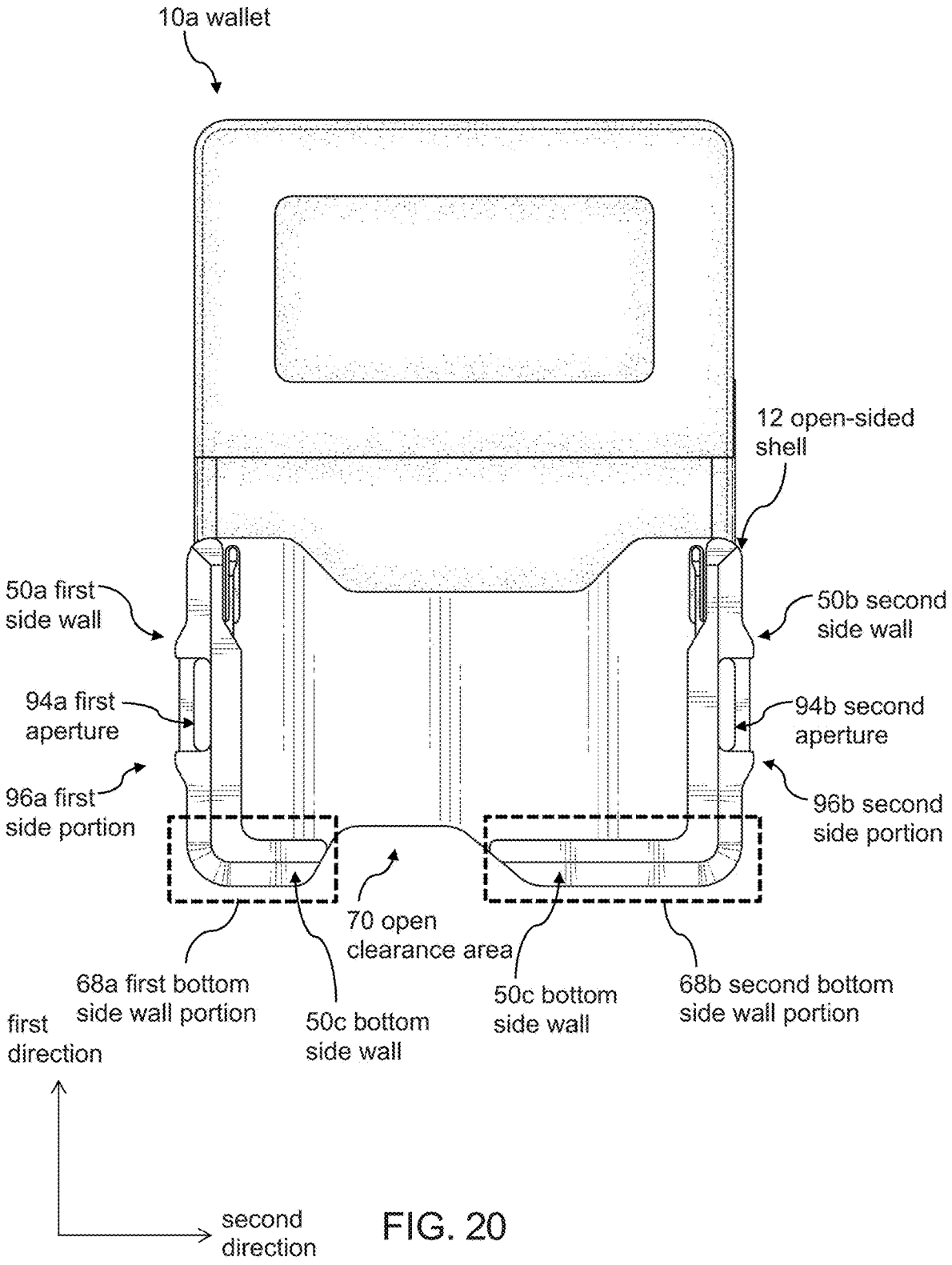
FIG. 20 illustrates a front interior view of a wallet including a bottom side wall, according to some embodiments.

Similar to FIG. 19, FIG. 20 includes more elements of the bottom side wall 50*c*. In many embodiments, the bottom side wall 50*c* comprises a first bottom side wall portion 68*a* and a second bottom side wall portion 68*b*, as well as an open clearance area 70 located between the two portions 68*a*, 68*b*. The open clearance area 70 may be configured to receive a user's finger so that the user may thereby push the at least one personal card 18 away from the bottom side wall 50*c*, and remove the card 18 from the wallet 10*a*. As shown in FIG. 20, in some embodiments, the second bottom side wall portion 68*b* is wider than the first bottom side wall portion 68*a*. The first bottom side wall portion 68*a* may be wider than the second bottom side wall portion 68*b*. In some embodiments, the first and second bottom side wall portions 68*a*, 68*b* are substantially the same width. The first and second bottom side wall portions 68*a*, 68*b* may be substantially the same height.

Figure 21:
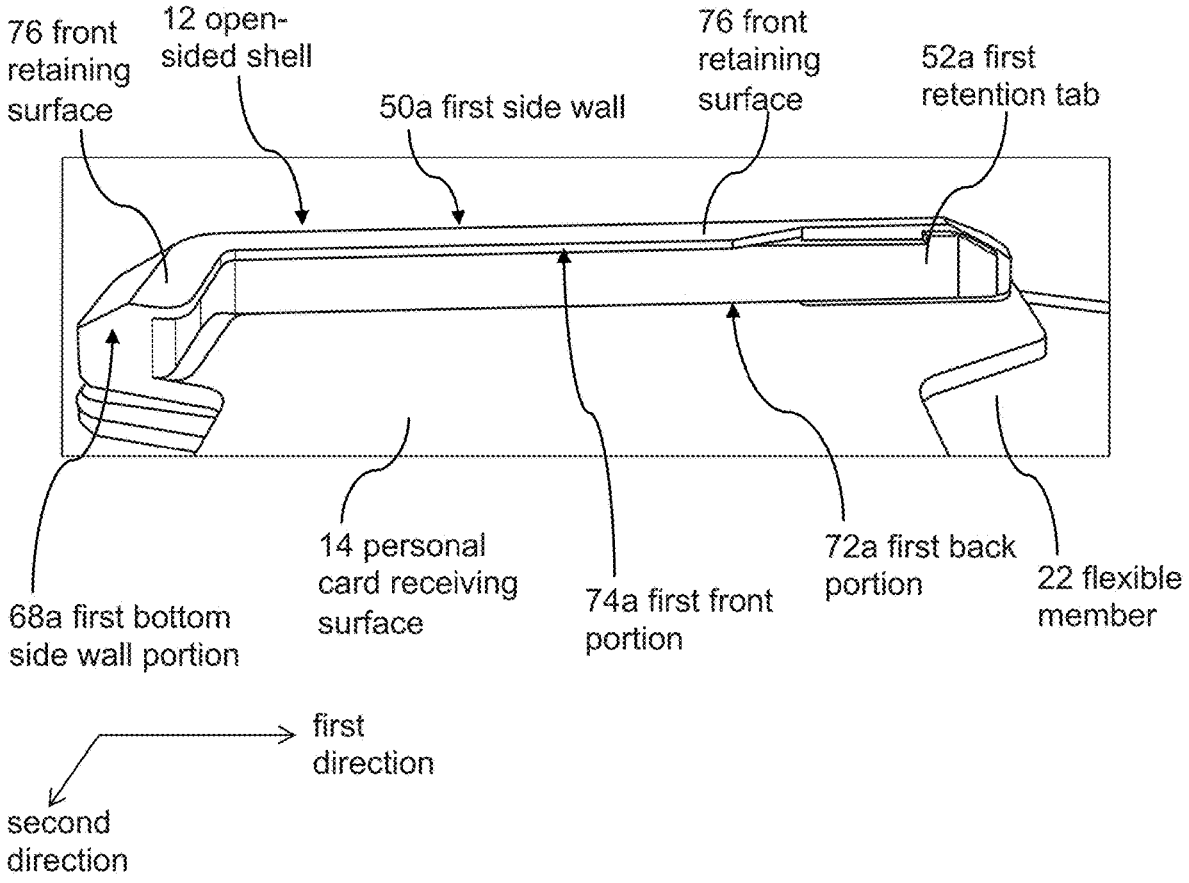
FIG. 21 illustrates a cross-sectional view of a first side wall of a wallet, according to some embodiments.

FIG. 21 shows a cross-sectional view of part of the open-sided shell 12, including the first side wall 50*a* and the first bottom side wall portion 68*a*. In many embodiments, the first side wall 50*a* defines a first back portion 72*a* located adjacent the personal card receiving surface 14 and a first front portion 74*a* located opposite the first back portion 72*a*, as illustrated in FIG. 21. The first front portion 74*a* and first back portion 72*a* may be considered to border a channel, or first interior portion, in the first side wall 50, wherein the at least one personal card 18 is received by the channel/first interior portion. Stated differently, when the at least one personal card 18 is coupled to the open-sided shell 12, an edge of the card 18 may be located between the first back portion 72*a* and the first front portion 74*a*, facing the first interior portion, and kept in place (e.g., prevented from falling out of the wallet 10*a*) by the first front portion 74*a*. In many embodiments, the open-sided shell 12 also includes a front retaining surface 76 that protrudes along the second direction from the first front portion 74*a* of the first side wall 50*a*. The front retaining surface 76 may also extend around at least a portion of a perimeter of the personal card receiving surface 14, as illustrated in FIGS. 21, 22, and 23.

In some embodiments, the open-sided shell 12 comprises a beveled surface. Looking back to FIG. 20, the beveled surface of the open-sided shell 12 may comprise the portion of the open-sided shell 12 including the first and second apertures 94*a*, 94*b*. The beveled surface may extend from the front retaining surface 76 to a side surface of the open-sided shell 12 located adjacent the flexible member 22. In many embodiments, the front retaining surface 76 comprises the top, flat face of the open-sided shell 12 between the beveled surface and the internal portion 20 of the open-sided shell 12 (shown in FIG. 24). The first front portion 74*a* (and second and third front portions 74*b*, 74*c*) may be considered an inner edge of the front retaining surface 76 located opposite an edge of the front retaining surface 76 adjacent the beveled surface of the open-sided shell 12. The use of "flat" when describing the front retaining surface 76 is intended to convey that, in many embodiments, the front retaining surface 76 is parallel to the personal card receiving surface 14. It should also be noted that the front retaining surface 76 may be the portion of the open-sided shell 12 that contacts the internal surface 24 of the top half 30 of the wallet 10*a* when the wallet 10*a* is in the clamshell position 48 and/or closed position 46, as discussed with reference to FIGS. 9 and 10.

Figure 22:
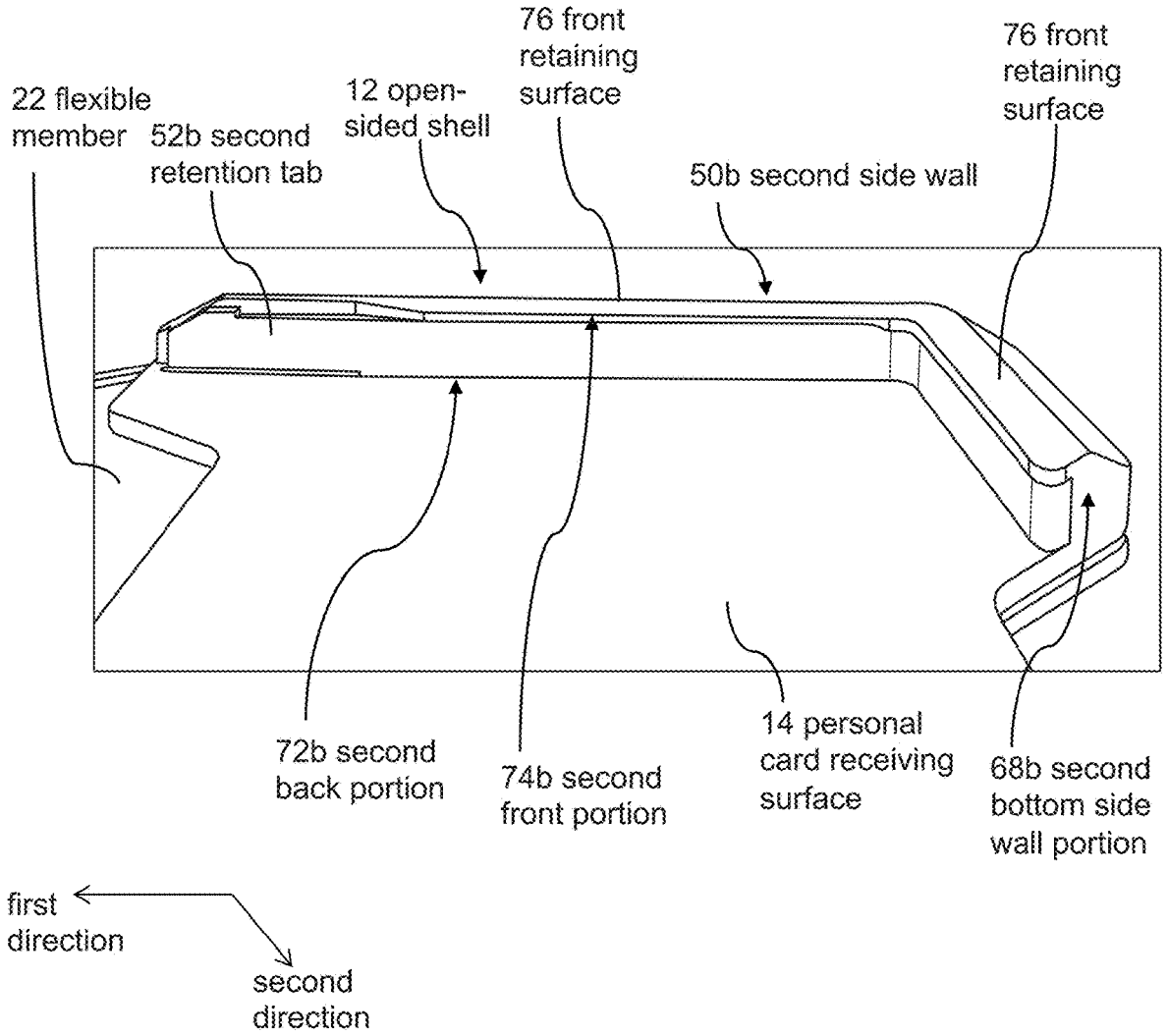
FIG. 22 illustrates a cross-sectional view of a second side wall of a wallet, according to some embodiments.

Similar to the first side wall 50*a*, FIG. 22 illustrates that, in many embodiments, the second side wall 50*b* defines a second back portion 72*b* located adjacent the personal card receiving surface 14 and a second front portion 74*b* located opposite the second back portion 72*b*. As discussed with reference to FIG. 21, the second front portion 74*b* and the second back portion 72*b* may be considered to border a channel, or second interior portion, in the second side wall 50*b* configured to receive the at least one personal card 18 such that an edge of the at least one personal card 18 faces the second interior portion. The front retaining surface 76 may extend along the second direction from the second front portion 74*b* of the second side wall 50*b*.

Figure 23:
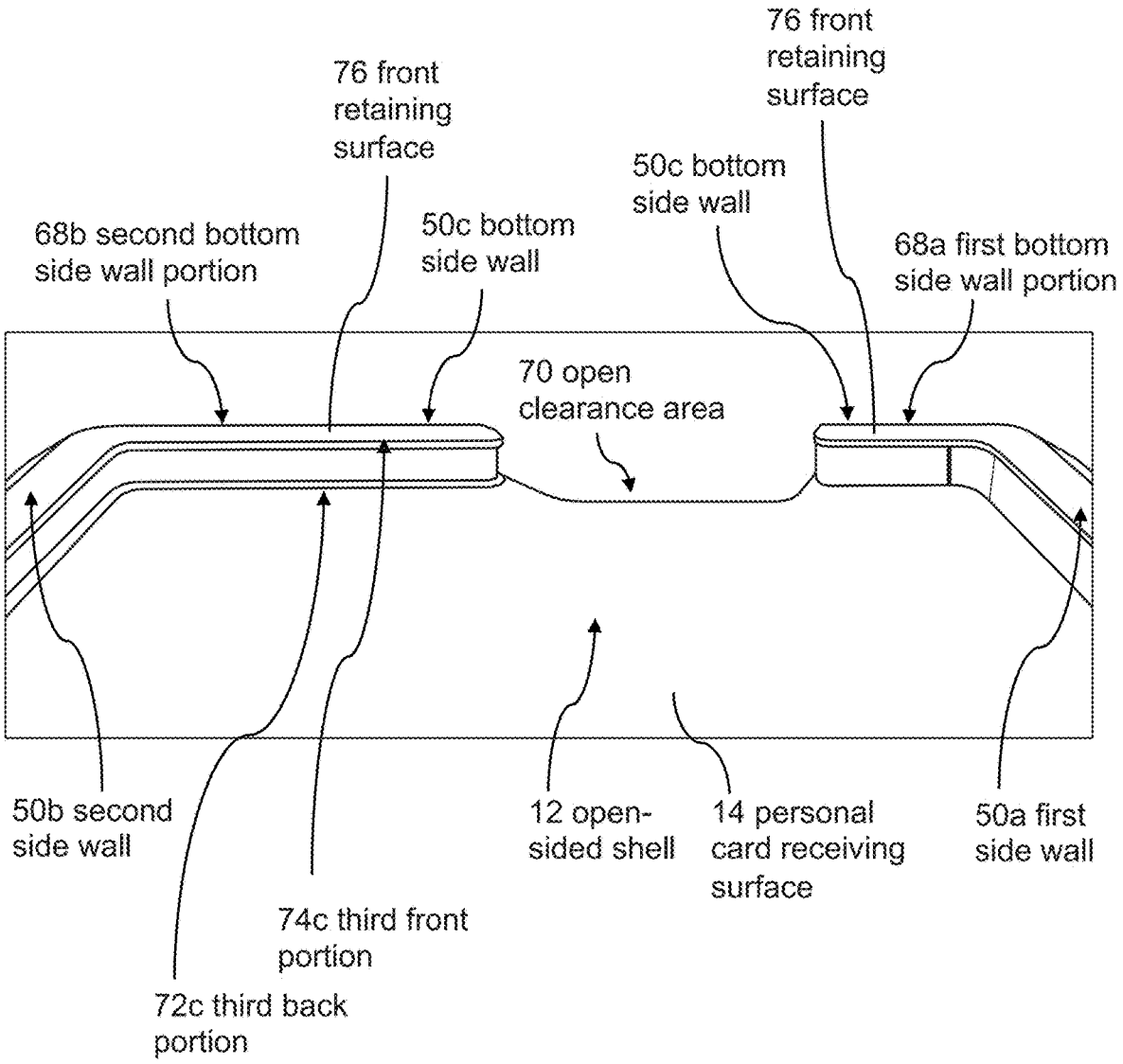
FIG. 23 illustrates a cross-sectional view of a bottom side wall of a wallet, according to some embodiments.

FIG. 23 is similar to FIGS. 21 and 22 and shows a cross-sectional view of the wallet 10*a* including the bottom side wall 50*c*. In many embodiments, the bottom side wall 50*c* defines a third back portion 72*c* located adjacent the personal card receiving surface and a third front portion 74*c* located opposite the third back portion 72*c*. It should be noted that the third front and back portions 74*c*, 72*c* may be located on both the second bottom side wall portion 68*b*, as shown in FIG. 23, as well as the first bottom side wall portion 68*a*. In some embodiments, the front retaining surface 76 protrudes along the first direction from the third front portion 74*c* of the bottom side wall 50*c*. Similar to the channel created by the space between the first back portion 72*a* and first front portion 74*a*, as well as between the second back portion 72*b* and the second front portion 74*b*, the space between the third back portion 72*c* and the third front portion 74*c* may create a channel, or bottom interior portion, configured to receive an edge of the at least one personal card 18 such that when the at least one personal card 18 couples to the open-sided shell 12, a bottom edge is configured to face the bottom interior portion. FIG. 23 also shows the open clearance area 70, and further illustrates how the open clearance area 70 provides access to the at least one personal card 18 coupled to the open-sided shell 12.

Figure 24:
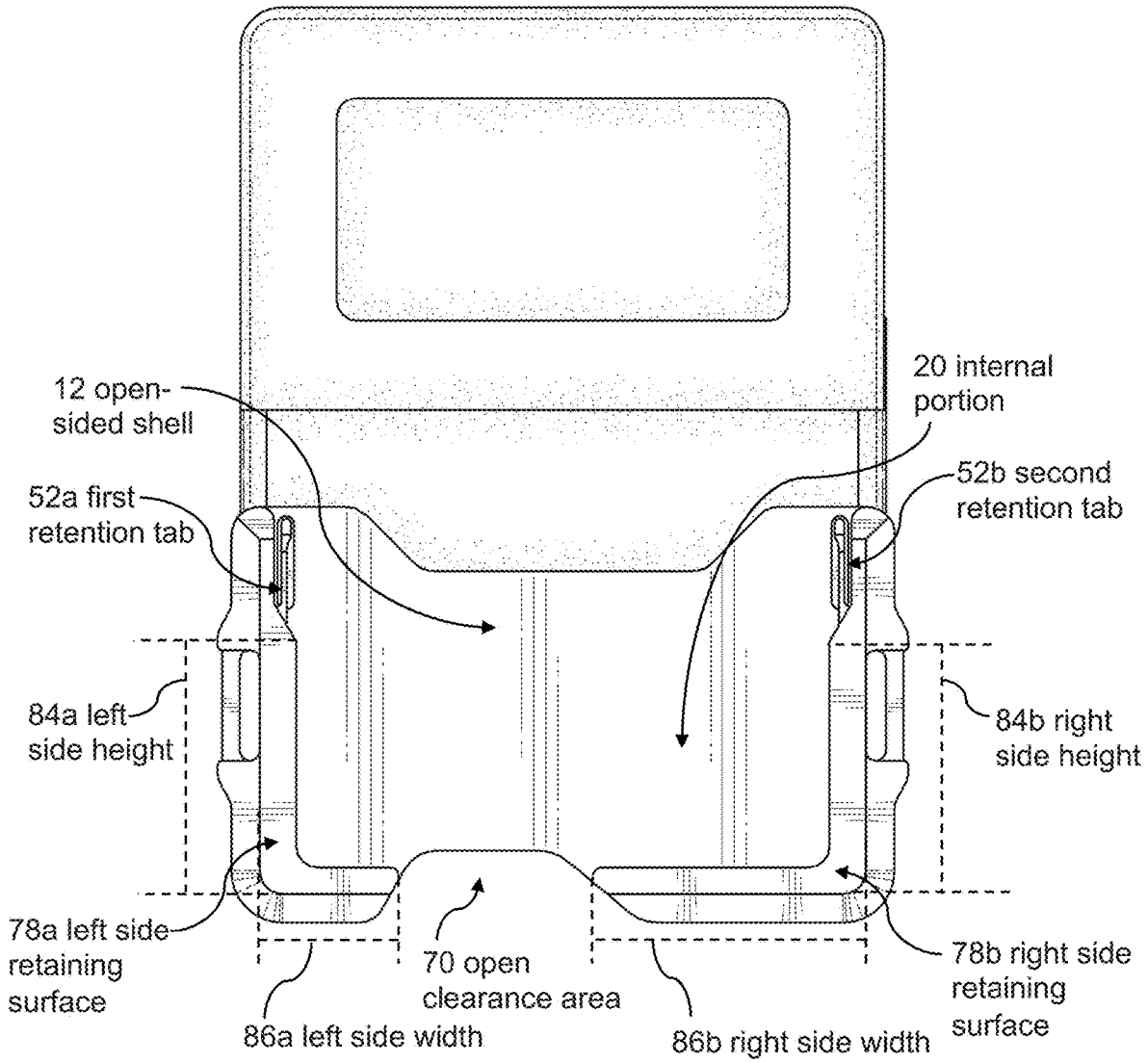
FIG. 24 illustrates a front interior view of a wallet, according to some embodiments.
Figure 25A:
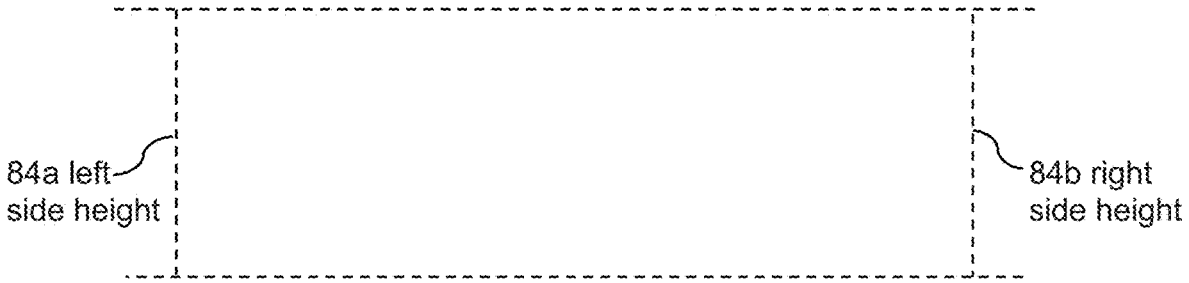
FIG. 25A illustrates a left side height and a right side height of a wallet, according to some embodiments.
Figure 25B:
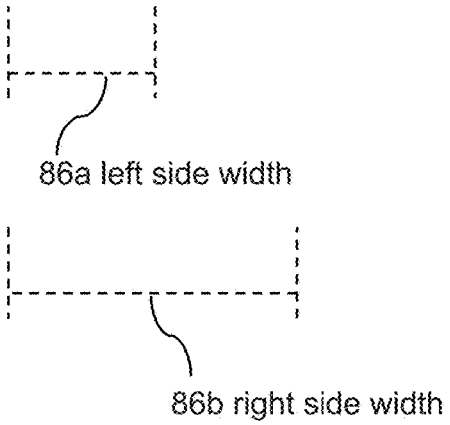
FIG. 25B illustrates a left side width and a right side width of a wallet, according to some embodiments.

In some embodiments, the front retaining surface 76 comprises a left side retaining surface 78*a* and a right side retaining surface 78*b*, as illustrated in FIG. 24. The left side retaining surface 78*a* may define a left side height 84*a* and a left side width 86*a*, and the right side retaining surface 78*b* may define a right side height 84*b* and a right side width 86*b*. In many embodiments, as shown in FIG. 25A, the left side height 84*a* and right side height 84*b* are substantially equal. FIG. 25B shows that, in some embodiments, the left side width 86*a* is less than the right side width 86*b*. The left side width 86*a* may be greater than the right side width 86*b*. In some embodiments, the left side width 86*a* and right side width 86*b* are substantially equal, and the open clearance area 70 is centered along the bottom side wall 50*c*.

Figure 26:
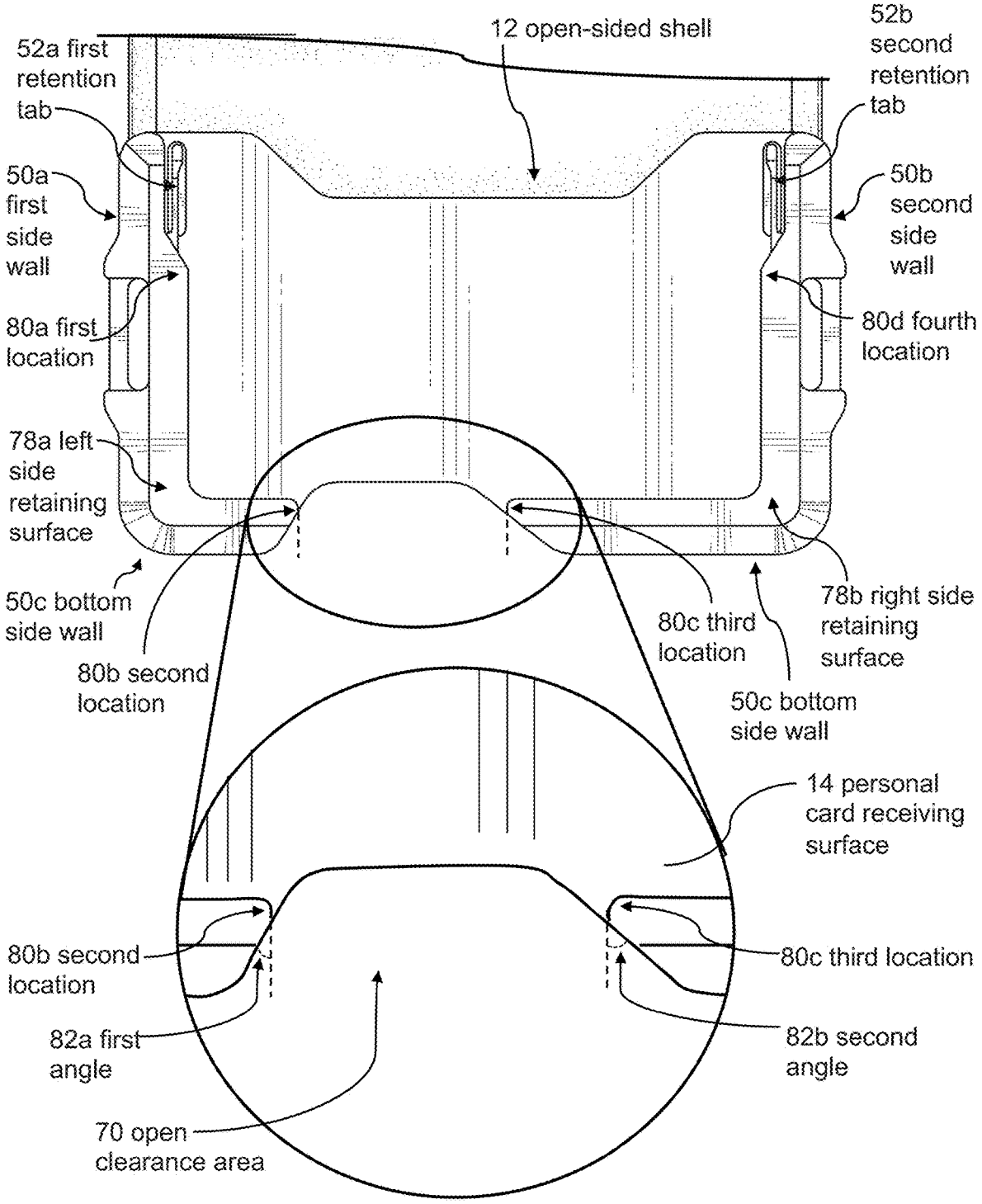
FIG. 26 illustrates a partial front view of a wallet, including an inset view of an open clearance area, according to some embodiments.

Referring now to FIG. 26, the open-sided shell 12 with an inset view of the open clearance area 70 is shown. In many embodiments, as illustrated in FIG. 26, the left side retaining surface 78*a* extends from a first location 80*a* located below the first retention tab 52*a* down along the first side wall 50*a* and along the bottom side wall 50*c* to a second location 80*b* adjacent the open clearance area 70. The right side retaining surface 78*b* may extend from a third location 80*c* adjacent the open clearance area 70 along the bottom side wall 50*c* and up along the second side wall 50*b* to a fourth location 80*d* located below the second retention tab 52*b*. The inset view of FIG. 26 shows the open clearance area 70 with the second location 80*b* on the left and the third location 80*c* on the right. As indicated by the inset view, in some embodiments, the second location 80*b* of the left side retaining surface 78*a* defines a first angle 82*a*, and the third location 80*c* of the right side retaining surface 78*b* defines a second angle 82*b*. The second angle 82*b* may be greater than the first angle 82*a*, as shown in FIG. 26. In some embodiments, the first angle 82*a* is greater than the second angle 82*b*. The first angle 82*a* and second angle 82*b* may be substantially equal, and the open clearance area 70 may define a symmetrical shape.

Figure 27:
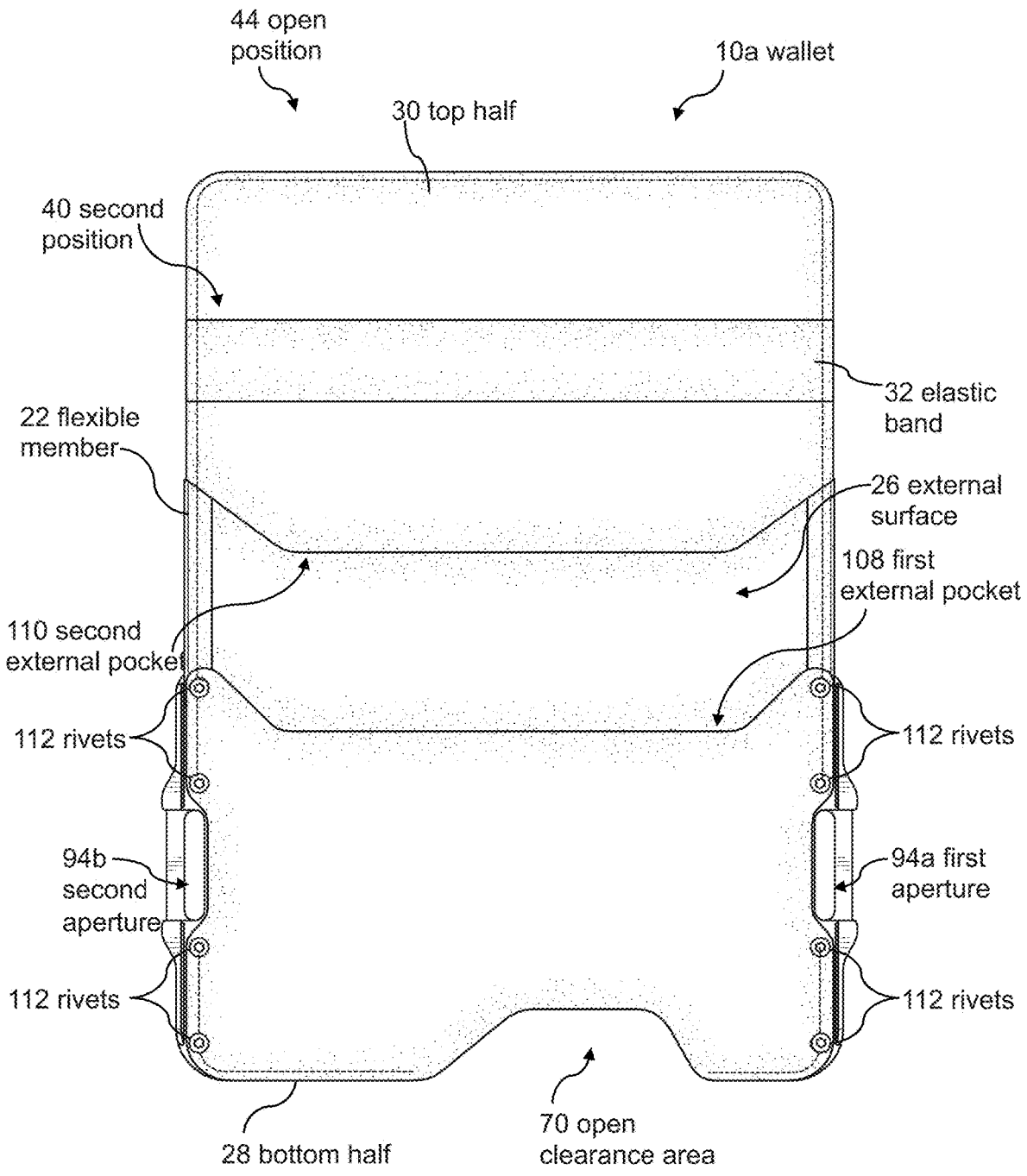
FIG. 27 illustrates a back exterior view of a wallet in an open position, according to some embodiments.

FIG. 27 shows a back view of the external surface 26 of the wallet 10*a* in the open position 44. As previously discussed, in many embodiments, the wallet 10*a* comprises a flexible member 22 having a top half 30 and a bottom half 28. FIG. 27 also includes the elastic band 32 coupled to the top half 30, and shows the band 32 in the second position 40 extending across the second external pocket 110. The first external pocket 108 is also included, as are the rivets 112 which, in many embodiments, couple the flexible member 22 and first external pocket 108 to a back surface of the open-sided shell 12. Though FIG. 27 shows the wallet 10*a* comprising eight total rivets 112, any number of rivets 112 may be used to couple the open-sided shell 12 to the flexible member 22. In addition, the rivets 112 are not limited to being located on opposite sides of the wallet 10*a* (e.g., the first and second side surfaces 96*a*, 96*b* of the bottom half 28), and may also be located along a bottom edge, as long as the rivets 112 do not interfere with the ability of the first external pocket 108 to hold at least one personal card 18. The rivets 112 may be evenly or unevenly distributed around the bottom half 28 of the flexible member 22. In some embodiments, the wallet 10*a* comprises another attachment mechanism (e.g., adhesive or the like) in addition to the rivets 112 in order to couple the flexible member 22 to the open-sided shell 12. The wallet 10*a* may comprise an alternative attachment mechanism(s) instead of the rivets 112.

FIG. 27 also illustrates that the first and second external pockets 108, 110 define complementary shapes. In some embodiments, the first external pocket 108 comprises a first piece of material coupled, along three edges, to the external surface 26 of the bottom half 28 of the flexible member 22. As previously mentioned, the coupling may comprise stitching 116, the use of rivets 112, or any other suitable method. In some embodiments, the coupling also comprises the use of rubber or a similar material to form a finished and/or fused edge along three edges of the first external pocket 108. It should be noted that the three coupled edges of the first external pocket 108 may include gaps or areas of non-coupling, for example, in the open clearance area 70. In some embodiments, the fourth edge of the first external pocket 108, or the non-coupled edge configured to receive the at least one personal card 18, defines a concave shape, as shown in FIG. 27. The non-coupled edge may define any shape including, but not limited to, a straight line, a convex shape, a concave shape, a scalloped shape, and the like. The non-coupled edge may be located adjacent a center portion of the flexible member 22.

In some embodiments, the second external pocket 110 comprises a second piece of material coupled, along three edges, to the external surface 26 of the top half 30 of the flexible member 22. As previously mentioned, the coupling may comprise stitching 116 or any other suitable method. In some embodiments, the coupling also comprises the use of rubber or a similar material to form a finished and/or fused edge along three edges of the second external pocket 110. Two side edges may include gaps where the elastic band 32 is coupled to the top half 30 of the flexible member 22. In some embodiments, the fourth edge of the second external pocket 110, or the non-coupled edge configured to receive the at least one personal card 18, defines a convex shape, as shown in FIG. 27. The non-coupled edge may define any shape including, but not limited to, a straight line, a convex shape, a concave shape, a scalloped shape, and the like. The non-coupled edge may be located adjacent a center portion of the flexible member 22.

Similar to the external pockets 108, 110, in some embodiments, the identification window 98 comprises a third piece of material coupled, along three edges, to the internal surface 24 of the top half 30 of the flexible member 22. As previously mentioned, the coupling may comprise stitching 116 or any other suitable method. In some embodiments, the coupling also comprises the use of rubber or a similar material to form a finished and/or fused edge along three edges of the identification window 98. It should be noted that, unlike the external pockets 108, 110, the third piece of material used to form the identification window 98 comprises more of a border than a solid piece, in order to create the aperture 100 in the window 98. In some embodiments, the fourth edge of the identification window 98, or the non-coupled edge configured to receive the at least one personal card 18, defines a straight edge, as shown in numerous previous Figures. The non-coupled edge may define any shape including, but not limited to, a straight line, a convex shape, a concave shape, a scalloped shape, and the like. The non-coupled edge may be located adjacent a center portion of the flexible member 22.

Figure 28:
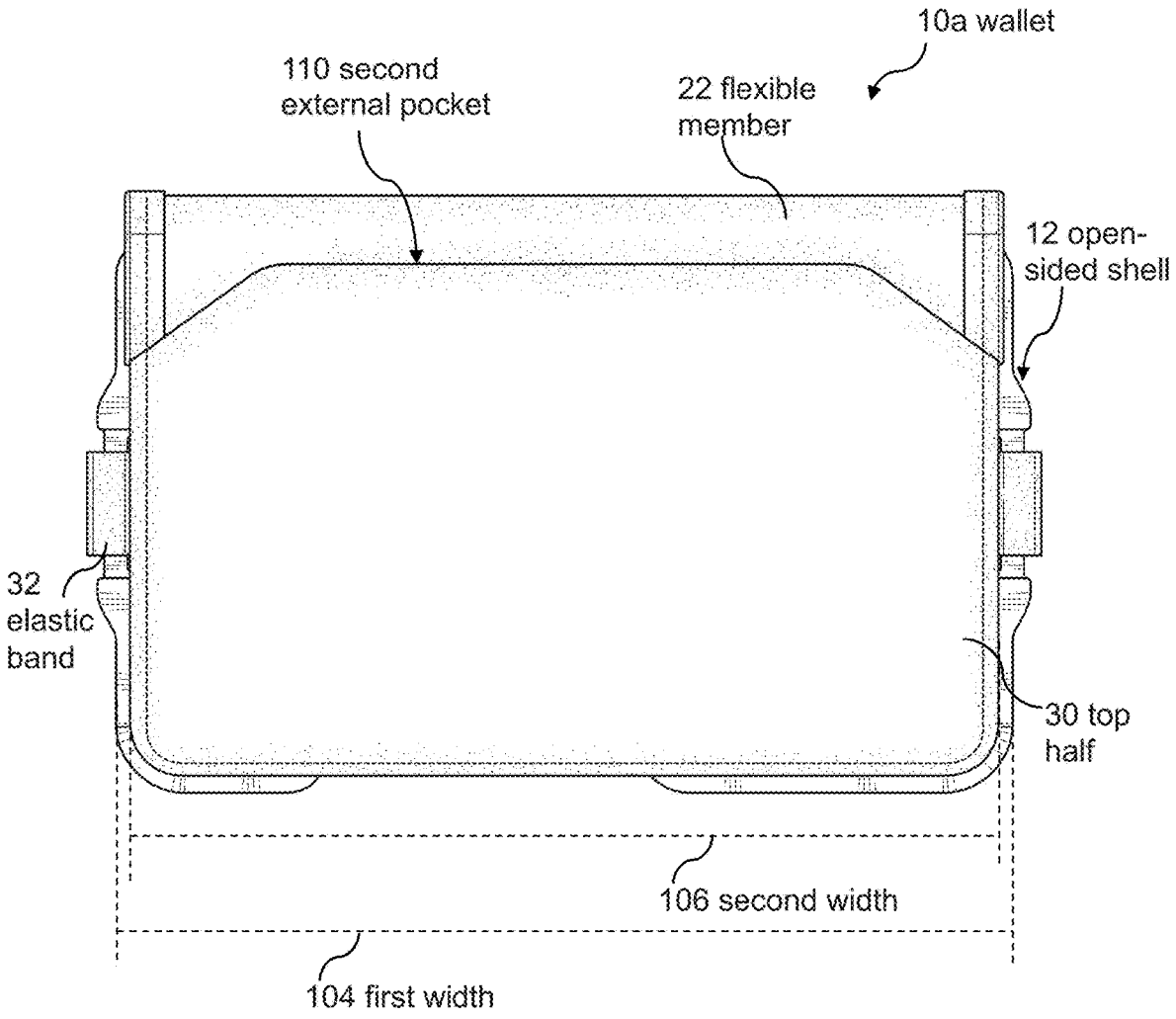
FIG. 28 illustrates a top half of a wallet, according to some embodiments.
Figure 29:
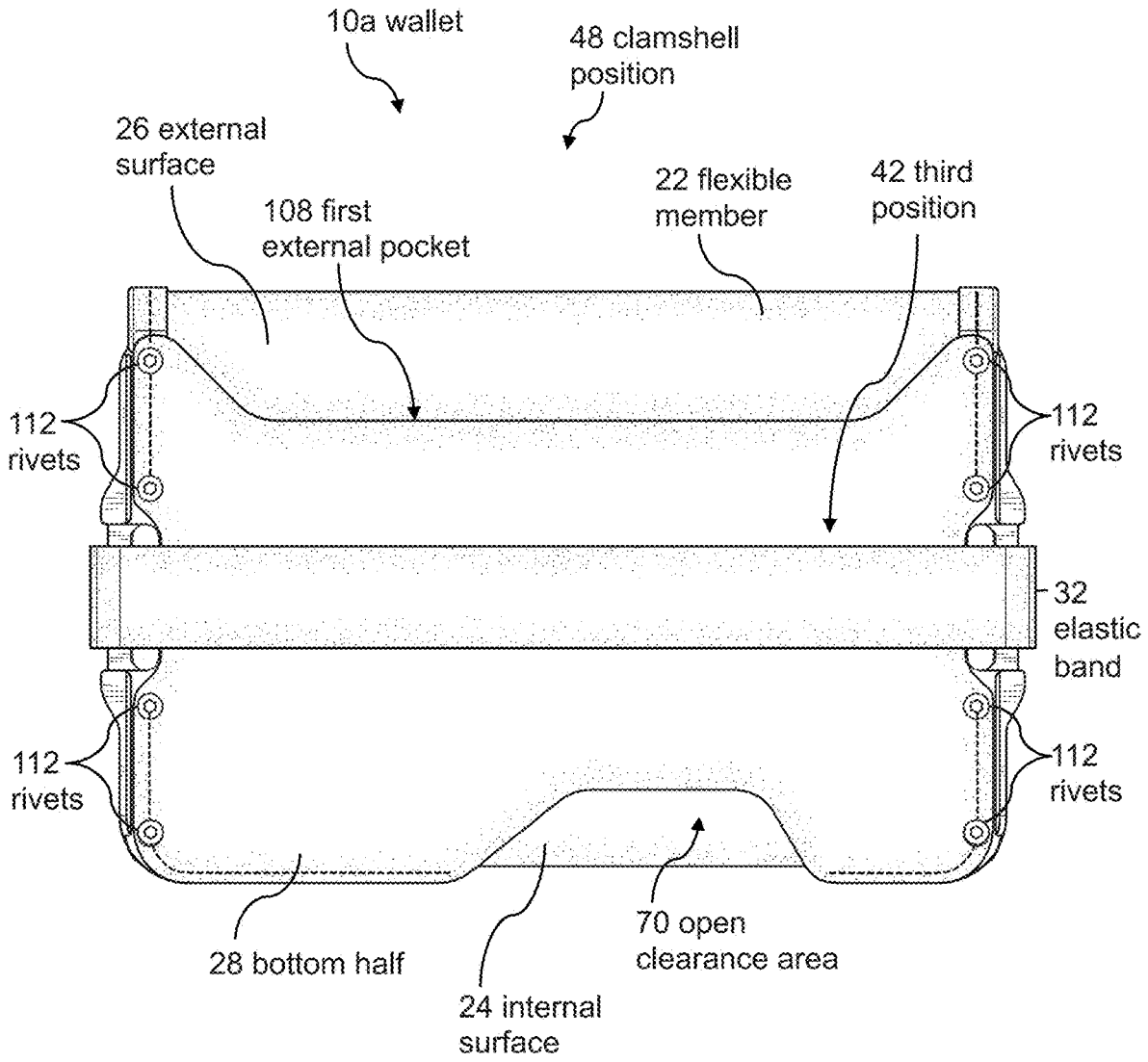
FIG. 29 illustrates a bottom half of a wallet, according to some embodiments.

Referring now to FIG. 28, the wallet 10*a* is shown in one of the closed position 46 and clamshell position 48, with a front view of the top half 30 of the flexible member 22. In many embodiments, the open-sided shell 12 defines a first width 104 and the flexible member 22 defines a second width 106. As indicated in FIG. 28, the first width 104 may be greater than the second width 106. In some embodiments, the first width 104 and the second width 106 are substantially the same. The first width 104 may be less than the second width 106. In many embodiments, the second width 106 is configured to be at least as wide as a standard credit card, such that the flexible member 22 is at least the same width, if not wider than, the at least one personal card 18. FIG. 29 illustrates a similar view as FIG. 28, but shows the bottom half 28 of the flexible member 22. In addition, FIG. 29 demonstrates that the wallet 10*a* is in the clamshell position 48, with the elastic band 32 in the third position 42. Similar to FIG. 27, FIG. 29 includes the rivets 112 coupling the open-sided shell 12 to the bottom half 28 of the flexible member 22. FIG. 29 also shows the open clearance area 70, and illustrates that, in many embodiments, the internal surface 24 of the top half 30 is visible through the open clearance area 70. The internal surface 24 may be visible both when no cards are coupled to the open-sided shell 12, as in FIG. 29, as well as when at least one personal card 18 is coupled to the open-sided shell 12. It should be noted that the first external pocket 108 may include an opening along the bottom edge of the pocket 108 corresponding to the open clearance area 70, such that at least one personal card 18 may be removed from the first external pocket 108 by pushing up on an exposed edge of the card 18 in the open clearance area 70.

Figure 30:
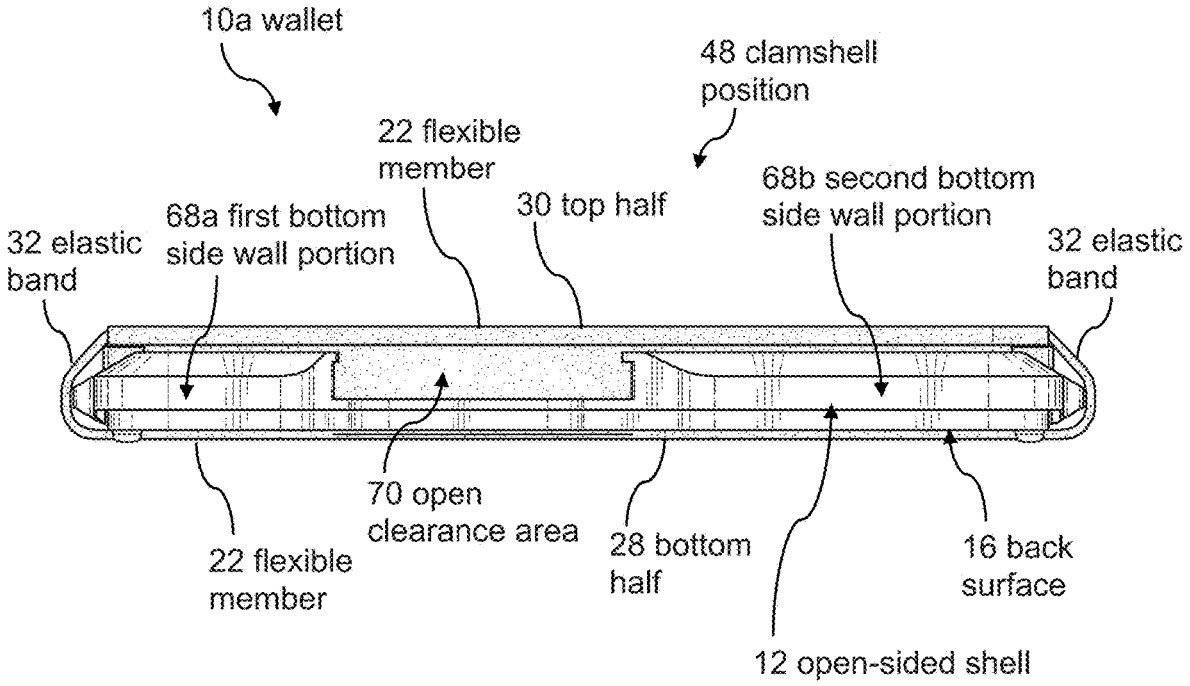
FIG. 30 illustrates a bottom view of a wallet in a clamshell position, according to some embodiments.

Turning now to FIG. 30, a bottom view of the wallet 10*a* in the clamshell position 48 is shown. The view includes the top half 30 of the flexible member 22, as well as the bottom half 28 of the flexible member 22. FIG. 30 also shows the back surface 16 of the open-sided shell 12, which is coupled to the bottom half 28 of the flexible member 22. The first and second bottom side wall portions 68*a*, 68*b* are shown with the open clearance area 70 located between the portions 68*a*, 68*b*. FIG. 30 also includes the elastic band 32 wrapped around each edge of the wallet 10*a*, thereby indicating that the wallet 10*a* is in the clamshell position 48.

Figure 31:
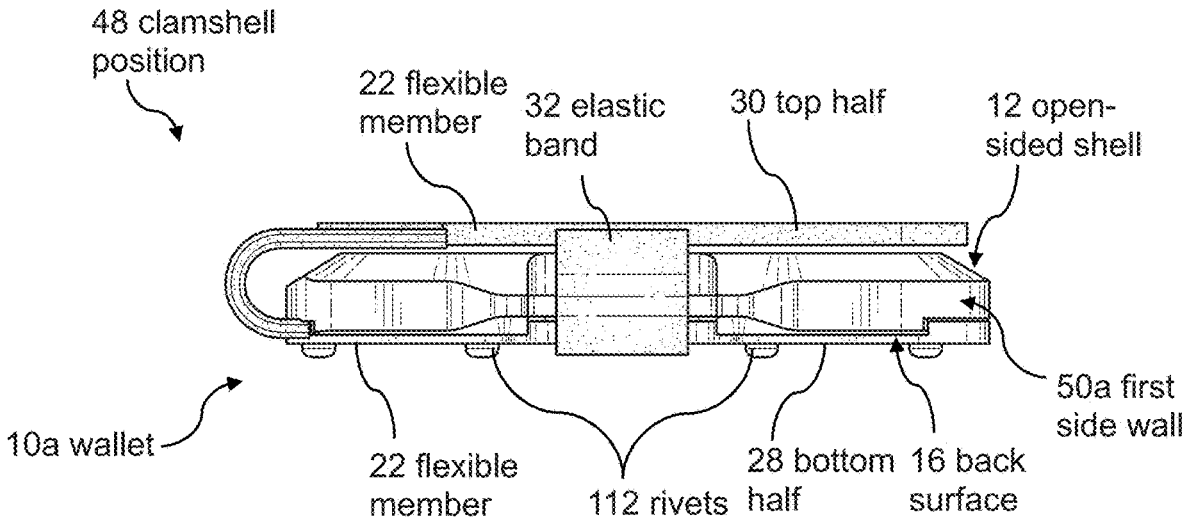
FIGS. 31 and 32 illustrate side views of a wallet in a clamshell position, according to some embodiments.
Figure 32:
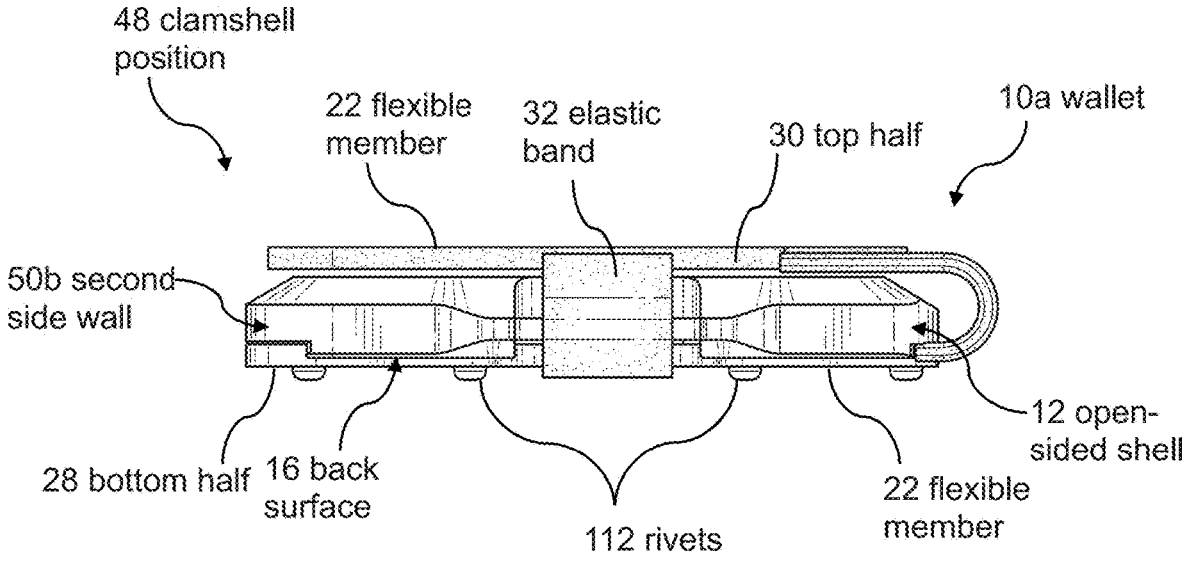

FIGS. 31 and 32 illustrate opposite side views of the wallet 10*a* again in the clamshell position 48, as shown in FIG. 30. FIG. 31 comprises a left side view of the wallet 10*a* and includes the first side wall 50*a* of the open-sided shell 12. In contrast, FIG. 32 comprises a right side view of the wallet 10*a* and includes the second side wall 50*b* of the open-sided shell 12. Both FIGS. 31 and 32 show the rivets 112 coupling the bottom half 28 of the flexible member 22 to the back surface 16 of the open-sided shell 12. The rivets 112 may have a shorter profile than shown in the Figures. For example, in some embodiments, the rivets 112 are flush with, or even embedded into, the bottom half 28 of the flexible member 22. As such, the rivets 112 may not always be visible in a side view of the wallet 10*a*. FIGS. 31 and 32 also both include the elastic band 32 wrapping around the wallet 10*a* from the top half 30 to the bottom half 28 of the flexible member 22, thereby indicating that the wallet 10*a* is in the clamshell position 48.

Figure 33:
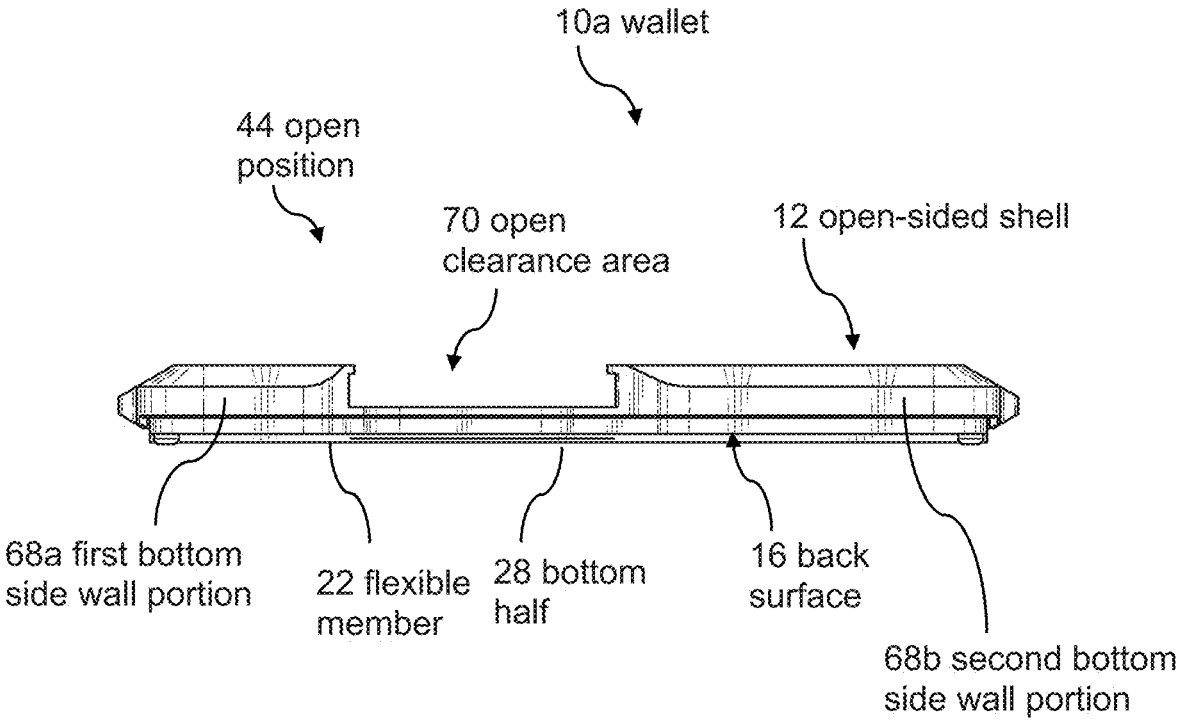
FIG. 33 illustrates a bottom view of a wallet in an open position, according to some embodiments.

FIG. 33 shows a bottom view of the wallet 10*a* in the open position 44. As such, FIG. 33 comprises mainly the open-sided shell 12 with the first and second bottom side wall portions 68*a*, 68*b*, as well as the bottom half 28 of the flexible member 22 coupled to the back surface 16 of the open-sided shell 12. FIG. 33 also shows the open clearance area 70 located between the first bottom side wall portion 68*a* and the second bottom side wall portion 68*b*.

Figure 34:
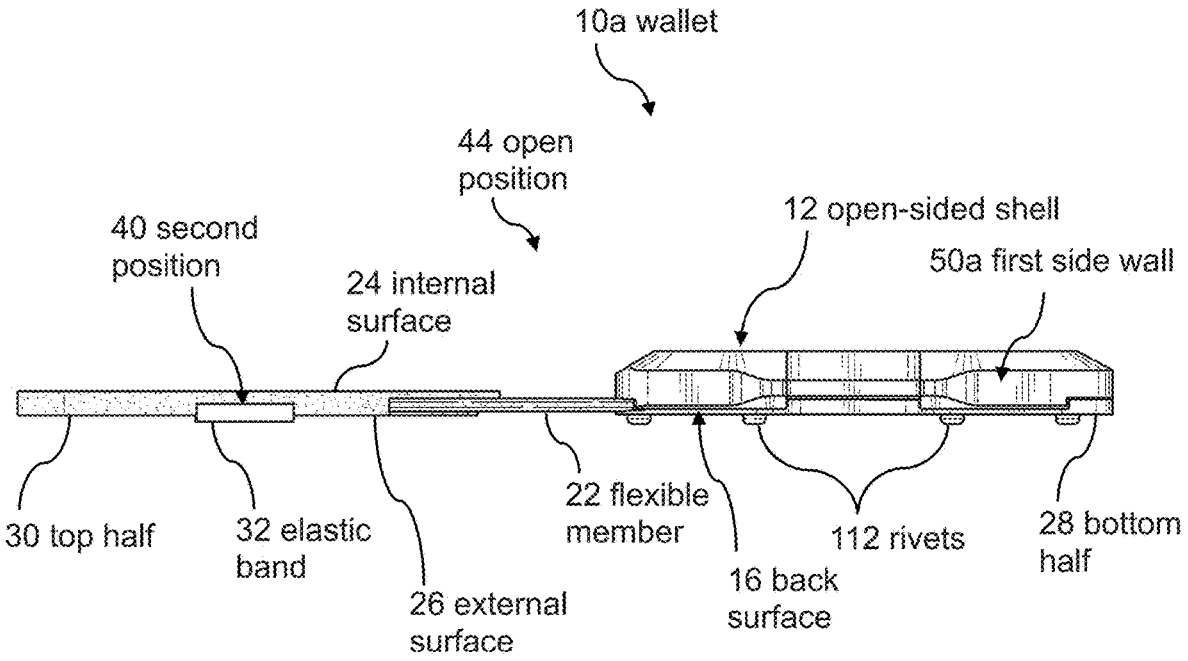
FIGS. 34 and 35 illustrate side views of a wallet in an open position, according to some embodiments.
Figure 35:
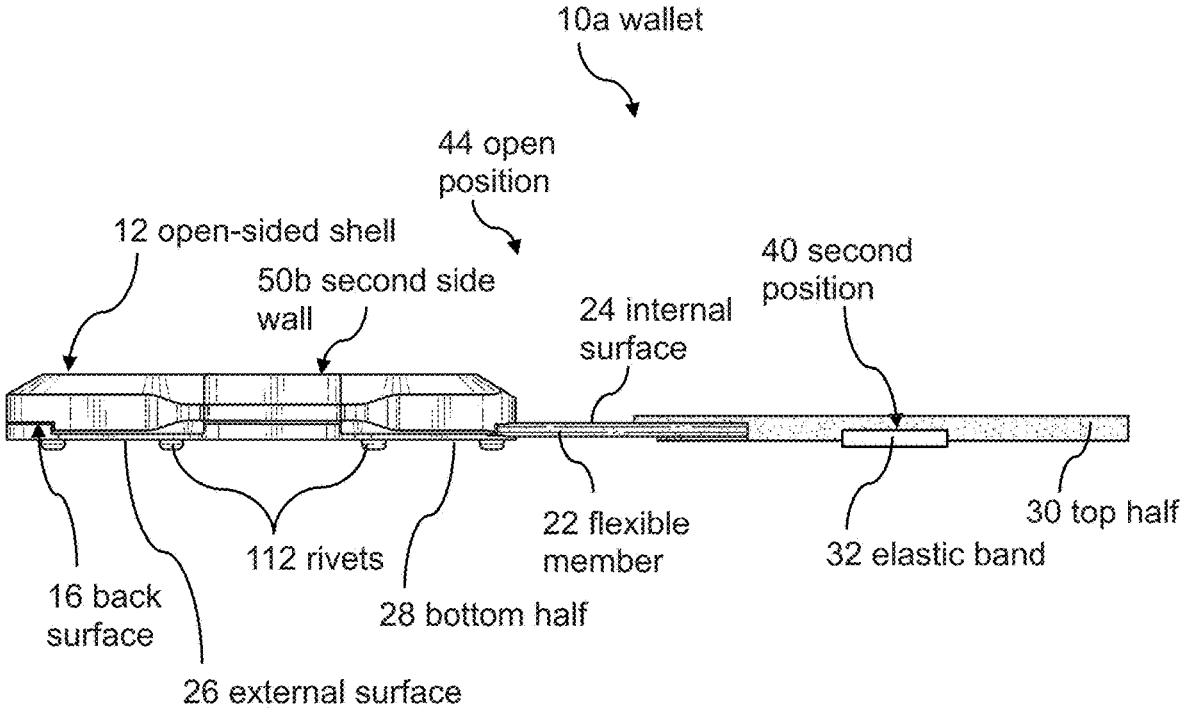

Similar to FIGS. 31 and 32, FIGS. 34 and 35 show opposite side views of the wallet 10*a*, but in the open position 44. FIG. 34 comprises a left side view including the first side wall 50*a* of the open-sided shell 12, and FIG. 35 comprises a right side view including the second side wall 50*b*. FIGS. 34 and 35 both show the wallet 10*a* facing up such that the internal surface 24 of the flexible member 22 is shown above the external surface 26. Both FIGS. 34 and 35 also illustrate the elastic band 32 in the second position 40, thereby wrapped around the external surface 26 of the flexible member 22. FIGS. 34 and 35 clearly illustrate the thickness of the top half 30 of the flexible member 22 compared to the thickness of the open-sided shell 12 coupled to the bottom half 28 of the flexible member 22.

Figure 36:
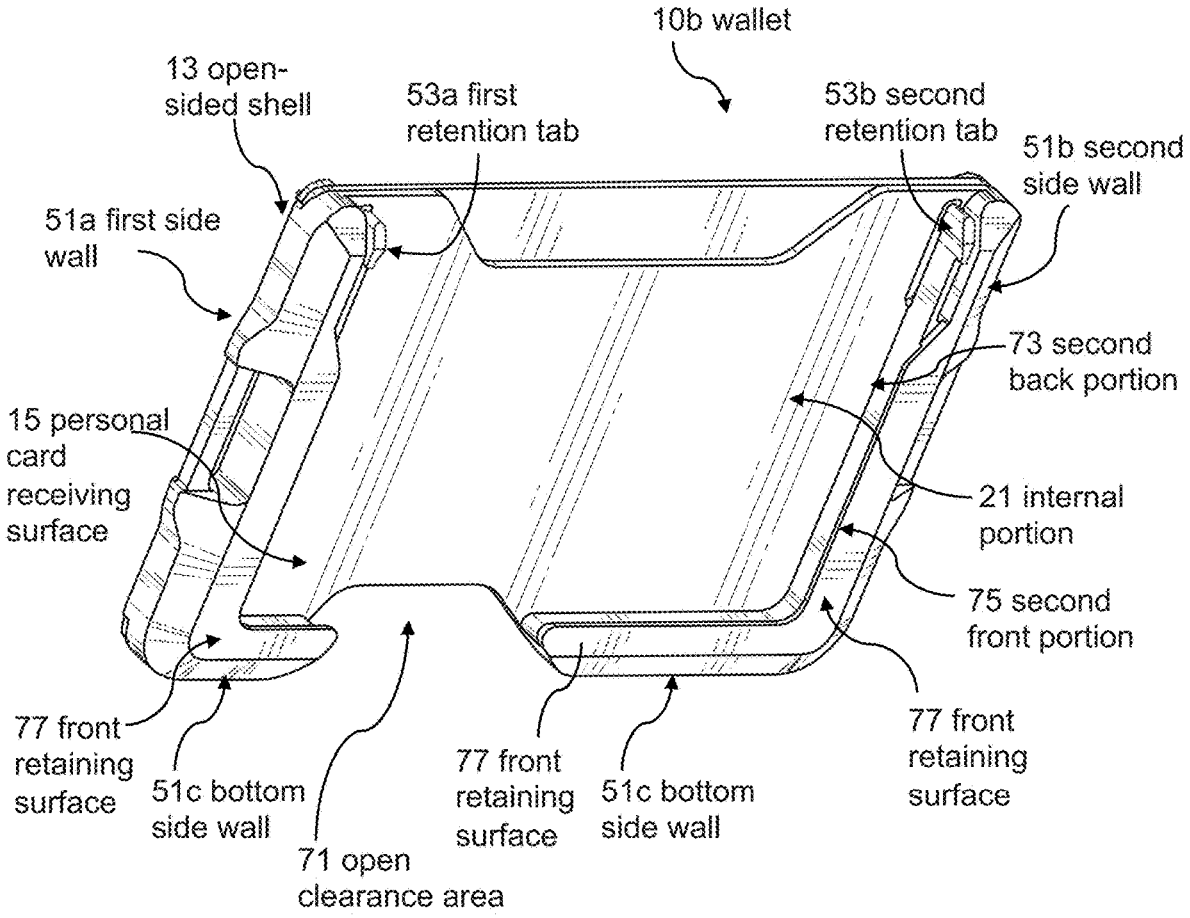
FIG. 36 illustrates a front perspective view of a wallet, according to some embodiments.
Figure 37:
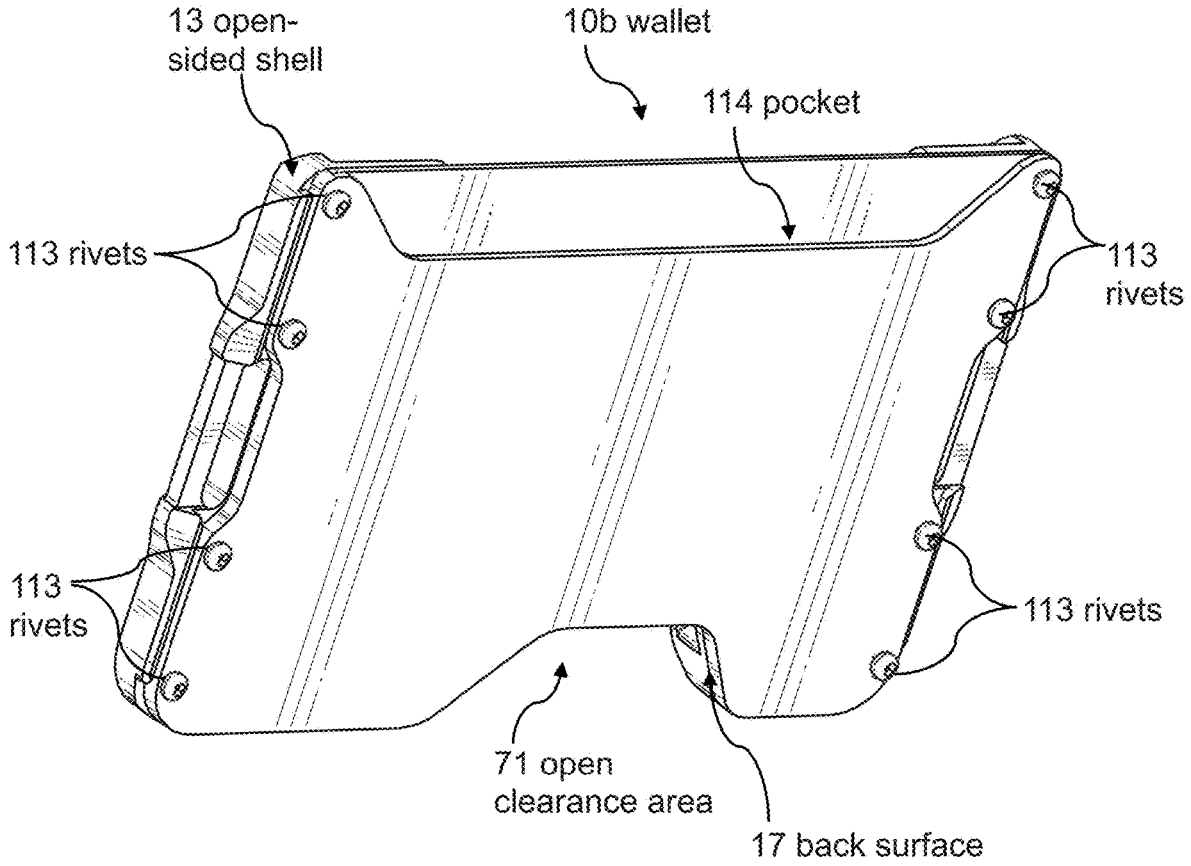
FIG. 37 illustrates a back perspective view of a wallet, according to some embodiments.

FIGS. 36-41 illustrate embodiments of a wallet 10*b*. The wallet 10*b* may be similar in some ways to the wallet 10*a*; for example, in some embodiments, the wallet 10*b* comprises an open-sided shell 13 that is substantially the same as the open-sided shell 12 of the wallet 10*a*. However, in many embodiments, the wallet 10*b* comprises a single pocket wallet design instead of the bifold design of the wallet 10*a*. As shown in FIG. 37, the wallet 10*b* may comprise a pocket 114 coupled to a back surface 17 of the open-sided shell 13, without the flexible member 22 and additional pockets 98, 110 of the wallet 10*a*.

FIG. 36 shows a front perspective view of the wallet 10*b*, including the open-sided shell 13. Similar to the open-sided shell 12 of the wallet 10*a*, the open-sided shell 13 may comprise a first side wall 51*a*, a second side wall 51*b*, and a bottom side wall 51*c*. The wallet 10*b* may also include a first retention tab 53*a* and a second retention tab 53*b*, which, in many embodiments, are substantially similar (in structure and function) to the first retention tab 52*a* and the second retention tab 52*b* of the wallet 10*a*. In some embodiments, the open-sided shell 13 comprises a front retaining surface 77 which, like the front retaining surface 76 of the wallet 10*a*, may be configured to extend down along the first side wall 51*a*, across the bottom side wall 51*c*, and up along the second side wall 51*b*. FIG. 36 also illustrates that, in some embodiments, the wallet 10*b* includes an open clearance area 71, which, similar to the other elements of the wallet 10*b*, may be substantially similar to the open clearance area 70 of the wallet 10*a*.

The angle of FIG. 36 includes an interior view of the second side wall 51*b* of the open-sided shell 13. It should be noted that though only illustrated and discussed in terms of the second side wall 51*b*, in many embodiments, both the first side wall 51*a* and the bottom side wall 51*c* comprise similar components as the second side wall 51*b*, which may all be similar to the first side wall 50*a*, second side wall 50*b*, and bottom side wall 50*c* of the wallet 10*a*. In many embodiments, the second side wall 51*b* defines a second back portion 73 and a second front portion 75 located opposite the second back portion 73, as illustrated in FIG. 36. The second front portion 75 and second back portion 73 may be considered to border a channel, or interior portion, in the second side wall 51*b*, wherein the at least one personal card 18 is received by the channel/interior portion. Stated differently, when the at least one personal card 18 is coupled to the open-sided shell 13, an edge of the card 18 may be located between the second back portion 73 and the second front portion 75, facing the interior portion, and kept in place (e.g., prevented from falling out of the wallet 10*b*) by the second front portion 75. In many embodiments, the open-sided shell 13 also includes a front retaining surface 77 that protrudes along the second direction from the second front portion 75 of the second side wall 51*b*.

As discussed with reference to the open-sided shell 12 of the wallet 10*a*, in some embodiments, the open-sided shell 13 comprises a beveled surface. In many embodiments, the front retaining surface 77 comprises the top, flat face of the open-sided shell 13 between the beveled surface and the internal portion 21 of the open-sided shell, as shown in FIG. 36. The second front portion 75 (and first and third front portions of the first and bottom side walls 51*a*, 51*c*) may be considered an inner edge of the front retaining surface 77 located opposite an edge of the front retaining surface 77 adjacent the beveled surface of the open-sided shell 13. The use of "flat" when describing the front retaining surface 77 is intended to convey that, in many embodiments, the front retaining surface 77 is parallel to the personal card receiving surface 15 of the open-sided shell 13.

FIG. 37 shows a back perspective view of the wallet 10*b*, including the pocket 114 coupled to the back surface 17 of the open-sided shell 13. Similar to the wallet 10*a*, in many embodiments, the open-sided shell 13 is coupled to the pocket 114 via rivets 113. Though FIG. 37 shows the wallet 10*b* comprising eight total rivets 113, any number of rivets 113 may be used to couple the open-sided shell 13 to the pocket 114. In addition, the rivets 113 are not limited to being located on opposite sides of the wallet 10*b*, and may also be located along a bottom edge, as long as the rivets 113 do not interfere with the ability of the pocket 114 to hold at least one personal card 18. The rivets 113 may be evenly or unevenly distributed around the pocket 114. In some embodiments, the wallet 10*b* comprises another attachment mechanism (e.g., adhesive or the like) in addition to the rivets 113 in order to couple the pocket 114 to the open-sided shell 13. The wallet 10*b* may comprise an alternative attachment mechanism(s) instead of the rivets 113.

Figure 38:
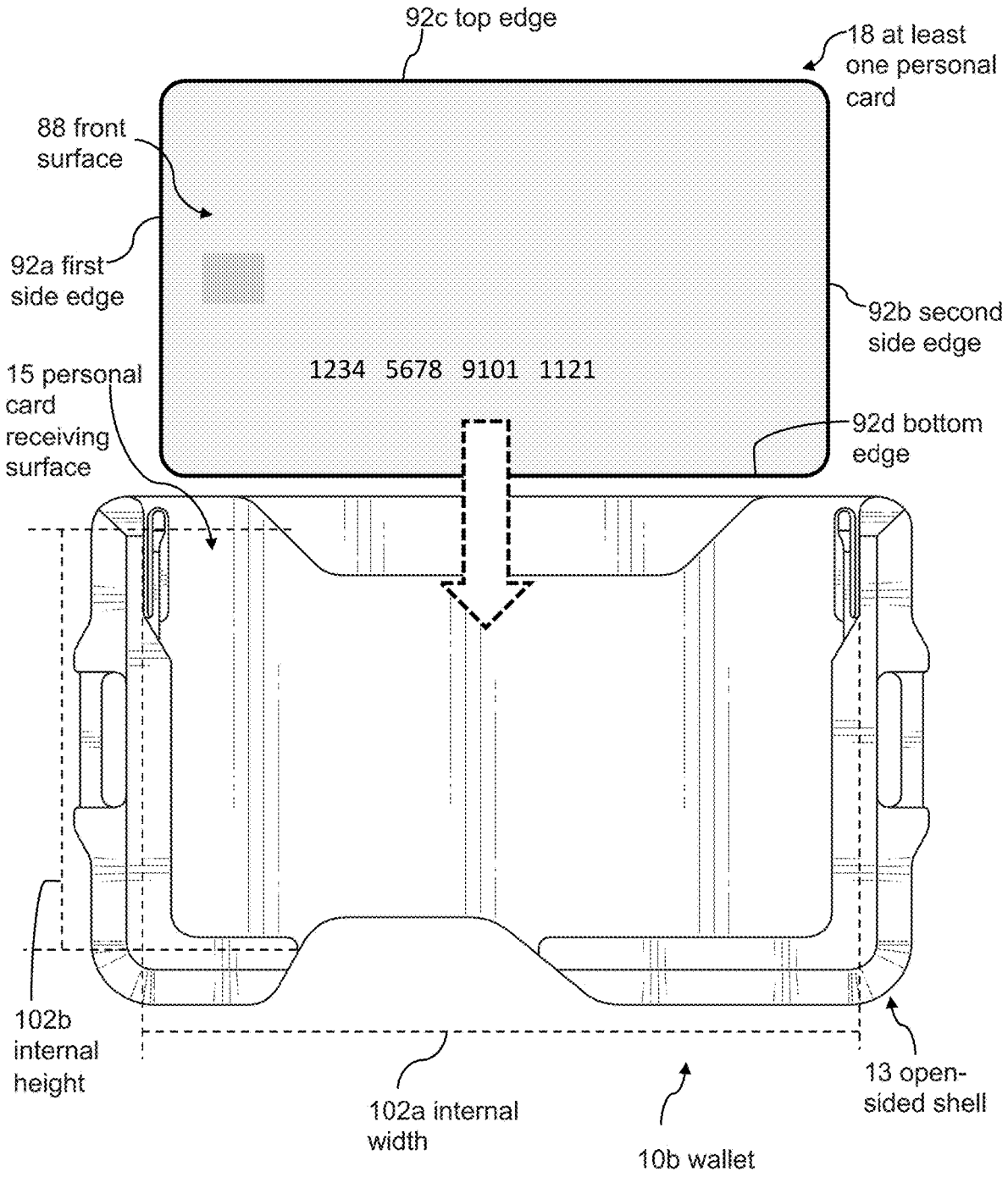
FIGS. 38, 39, and 40 illustrate front views of a wallet and at least one personal card, according to some embodiments.
Figure 39:
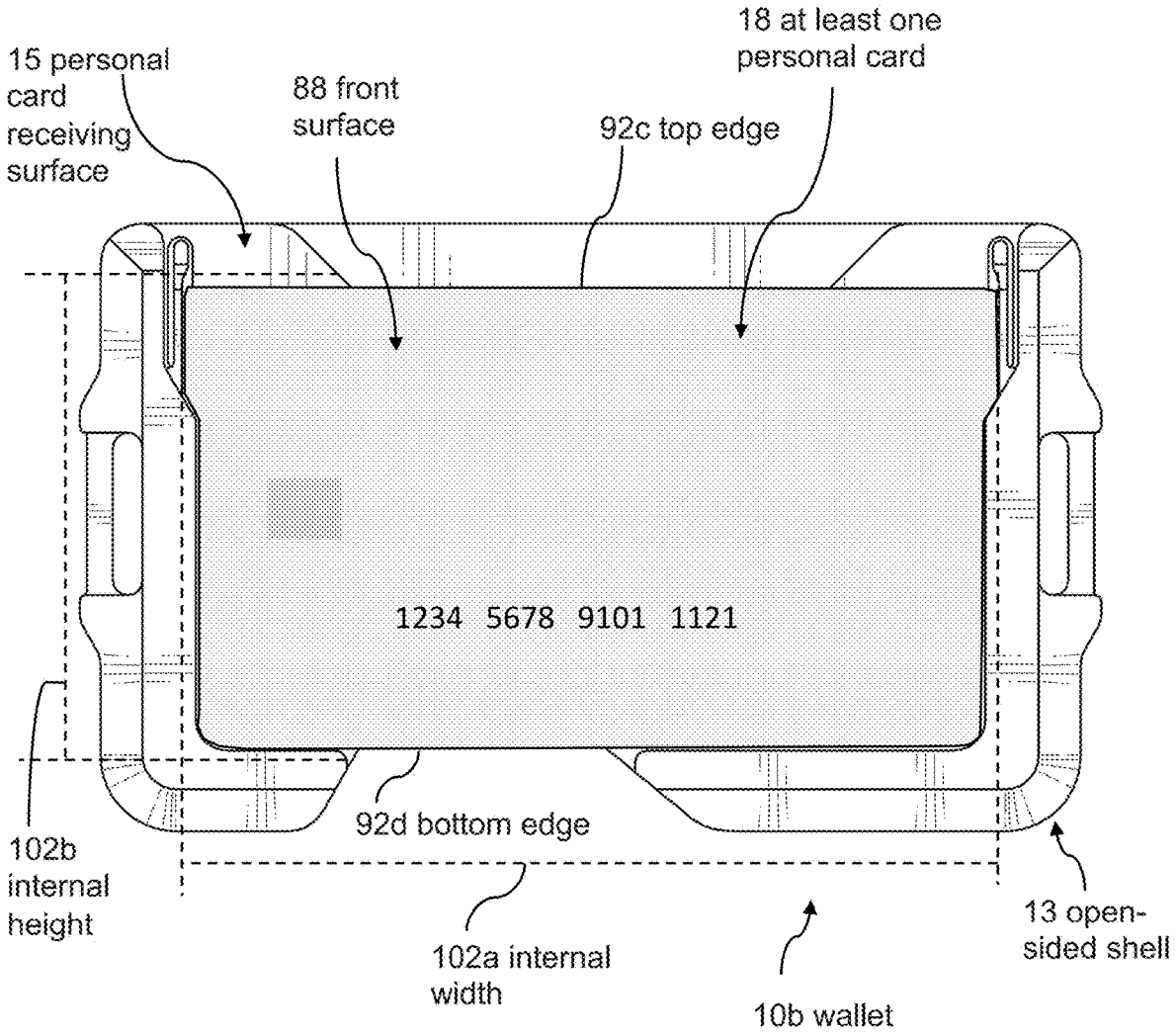

FIG. 38 shows a front view of the wallet 10*b* and at least one personal card 18 being inserted into the wallet 10*b*, as indicated by the dashed block arrow. In many embodiments, the at least one personal card 18 comprises a front surface 88, a back surface located opposite the front surface 88, a first side edge 92*a*, a second side edge 92*b* located opposite the first side edge 92*a*, a top edge 92*c*, and a bottom edge 92*d* located opposite the top edge 92*c*. When the at least one personal card 18 is securably coupled to the open-sided shell 13, as shown in FIG. 39, the back surface of the card 18 may be configured to face the personal card receiving surface 15. In many embodiments, the front retaining surface 77 of the open-sided shell 13 is configured to cover at least a portion of the front surface 88 along the first side edge 92*a*, the second side edge 92*b*, and the bottom edge 92*d*. FIG. 39 shows the at least one personal card 18 coupled to the open-sided shell 13 on top of the personal card receiving surface 15, and illustrates how the first side edge 92*a*, second side edge 92*b*, and bottom edge 92*d* are at least partially covered. In some embodiments, the front retaining surface 76 is configured to cover at least a portion of the front surface 88 of the at least one personal card 18 in a manner substantially the same as the front retaining surface 77.

FIGS. 38 and 39 also include an internal width 102*a* and internal height 102*b* of the open-sided shell 13. In many embodiments, the internal portion 21 of the open-sided shell 13 defines an internal width 102*a* measuring at least 3.375 inches and an internal height 102*b* measuring at least 2.125 inches. These measurements may correspond to the standard size of the at least one personal card 18 (e.g., standard credit card, gift card, identification card, and the like), which define a width of 3.375 inches and a height of 2.125 inches. In many embodiments, the internal width 102*a* is slight larger than 3.375 inches, such that the at least one personal card 18 has a small amount of "wiggle room" to move side-to-side while coupled to the open-sided shell 13. In some embodiments, the internal height 102*b* is slightly larger than 2.125 inches, such that the at least one personal card 18 rests below a top border of the open-sided shell 13. As shown in, and discussed with reference to, FIGS. 13 and 17, the at least one personal card 18 may be configured to fit just below the protruding portions of the first and second retention tabs 53*a*, 53*b*.

It should be noted that, in many embodiments, the internal width 102*a* and internal height 102*b* of the open-sided shell 13 also apply to the open-sided shell 12, such that the open-sided shell 12 and the open-sided shell 13 are substantially the same size. The internal width 102*a* may correspond to the width between the channels/interior portions of the first and second side walls 50, 51, as described with reference to FIGS. 21-23. The internal width 102*a* may also be defined as extending from the cantilever arm 66 of each retention tab 52, 53 down to the bottom side wall 50*c*, 51*c*.

Figure 40:
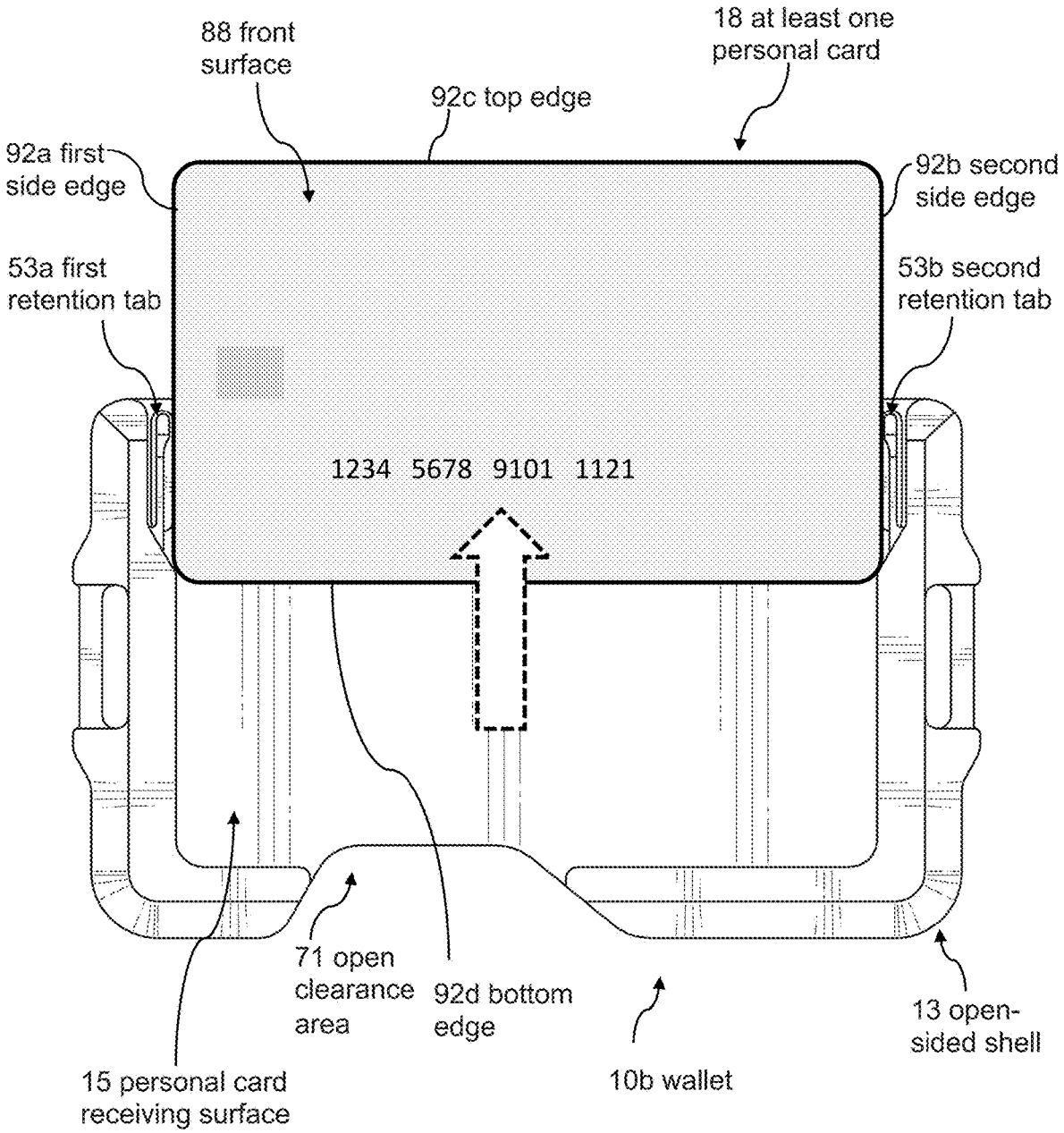

FIG. 40 is similar to FIG. 38, but shows the at least one personal card 18 being removed from the wallet 10*b*, as indicated by the dashed block arrow. Similar to removal of the at least one personal card 18 from the wallet 10*a*, the card 18 may be removed from the wallet 10*b* by a user accessing the card 18 via the open clearance area 71 and pushing on the bottom edge 92*d* of the card 18. Also similar to insertion/removal of the at least one personal card 18 from the wallet 10*a*, during insertion/removal of the at least one personal card 18 from the wallet 10*b*, the first and second retention tabs 53*a*, 53*b* may be configured to move away from one another in order to fit the at least one personal card 18 through the personal card receiving surface 15. In many embodiments, the process shown in, and described with reference to, FIGS. 12-15, is substantially the same as the process for inserting and/or removing the at least one personal card 18 from the open-sided shell 13 of the wallet 10*b*. The at least one personal card 18 may also be configured to be inserted into and/or removed from the open-sided shell 13 using substantially the same "angled" method shown in, and discussed with reference to, FIGS. 16-18.

Figure 41:
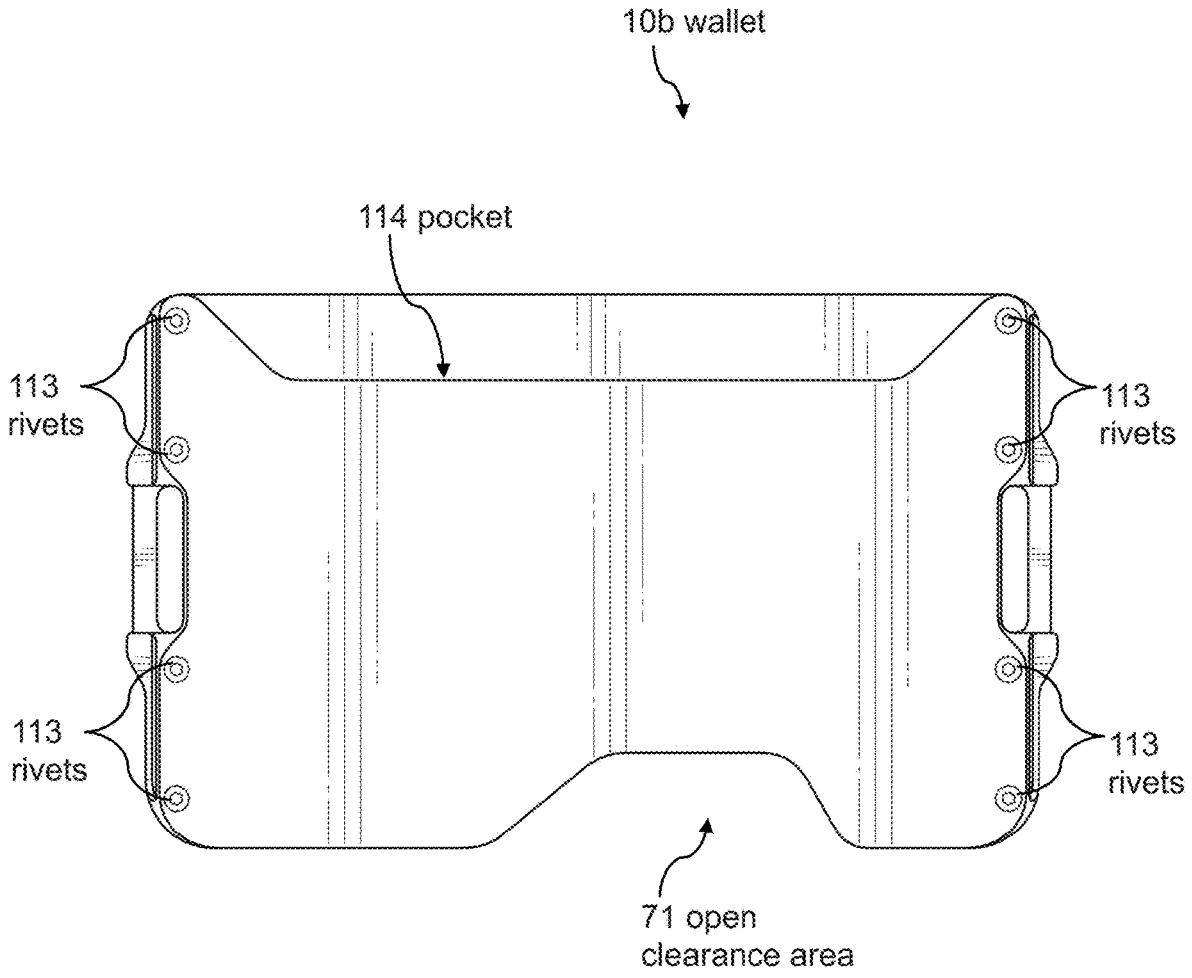
FIG. 41 illustrates a back view of a wallet, according to some embodiments.

FIG. 41 shows a back view of the wallet 10*b*, including the pocket 114 coupled to the open-sided shell 13 via the rivets 113. In some embodiments, like the open-sided shell 13, the pocket 114 includes an open clearance area 71 that exposes a bottom edge 92*d* of at least one personal card 18 coupled to the pocket 114. As such, a user may be able to remove the at least one personal card 18 by pushing on the exposed edge 92*d* in the open clearance area 71. It should also be noted that though not shown in the Figures depicting the wallet 10*b*, in many embodiments, the wallet 10*b* includes stitching similar to the stitching 116 shown on the wallet 10*a*. For example, the wallet 10*b* may include stitching on the pocket 114 between the rivets 113 and along at least a portion of a bottom edge of the pocket 114. Stitching may be used to couple the pocket 114 to an additional piece of material, wherein the additional piece of material is configured to face the back surface 17 of the open-sided shell 13. In this way, the additional piece of material may be considered a "backing piece" similar to the bottom half 28 of the flexible member 22 of the wallet 10*a*, where the bottom half 28 is coupled to the back surface 16 of the open-sided shell 12 and to the first external pocket 108.

In many embodiments, the flexible member 22, identification window 98, first external pocket 108, and second external pocket 110 of the wallet 10*a*, as well as the pocket 114 and "backing piece" of the wallet 10*b* are comprised of a flexible yet durable material, such as leather. The recited components may comprise a high-quality material, such as top grain genuine leather. In some embodiments, at least one of the flexible member 22, the identification window 98, the first external pocket 108, the second external pocket 110, and the pocket 114 comprise a tougher, yet still flexible, non-leather material, such as DTEX. In some embodiments, different elements of a wallet 10*a*, 10*b* comprise different materials. For example, one embodiment of the wallet 10*a* may comprise a leather flexible member 22 with DTEX external pockets 108, 110, and a DTEX identification window 98. In many embodiments, the elements other than the open-sided shell 12, 13 of a wallet 10*a*, 10*b* comprise substantially the same material. Any of the identification window 98, first external pocket 108, second external pocket 110, and pocket 114 may be configured to receive folded paper currency, in addition to or instead of at least one personal card 18.

The open-sided shell 12, 13 may comprise any metal material. In many embodiments, the open-sided shell 12, 13 comprises aluminum, and the personal card receiving surface 14, 15 comprises carbon fiber. The open-sided shell 12, 13 may comprise powder-coated aluminum. The open-sided shell 12, 13 and the personal card receiving surface 14, 15 may comprise the same material. The rivets 112, 113 may comprise any metal material, such as stainless steel. A person having ordinary skill in the art of wallet design and manufacturing may not see the use of CNC-machined metal as an obvious choice, and may instead look to plastic or other similar hard materials to create the open-sided shell 12, 13 and associated elements (personal card receiving surface 14, 15, rivets 112, 113, etc.). However, this disclosure includes metal material(s) for the open-sided shell 12, 13 in order to create a more durable and higher quality (in look and feel) product than what would be produced using plastic or a similar material.

Figure 42:
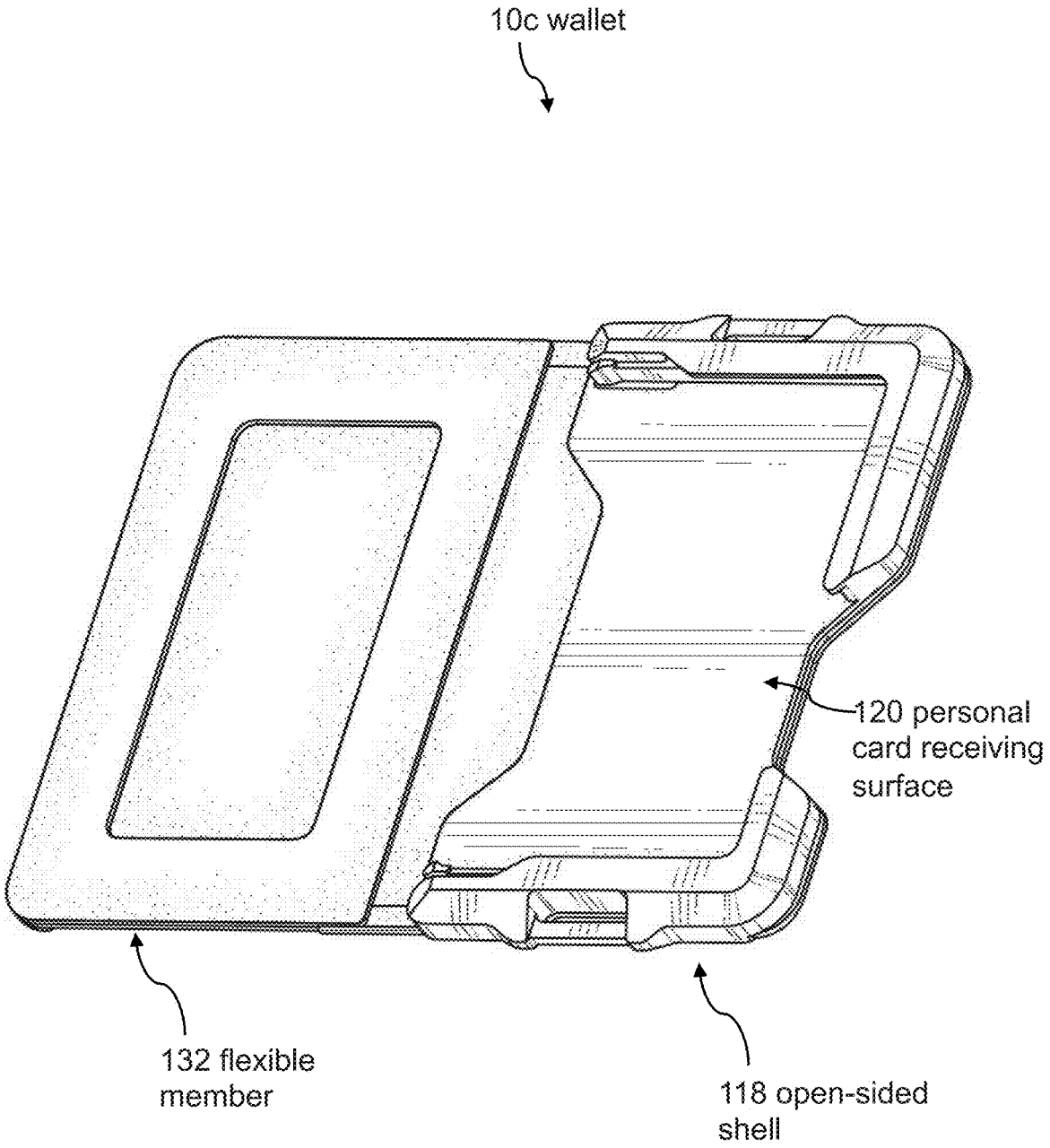
FIG. 42 illustrates a perspective view of an open wallet, according to some embodiments.

FIG. 42 illustrates a perspective view of a wallet 10*c*. As shown, the wallet 10*c* may include an open-sided shell 118 with a personal card receiving surface 120, as well as a flexible member 132. In some embodiments, the open-sided shell 118 is substantially the same as the open-sided shell 12, 13 shown in earlier Figures and previously discussed in this disclosure. In addition, the personal card receiving surface 120 may be substantially the same as the personal card receiving surface 14, 15 previously discussed in this disclosure. For example, the open-sided shell 118 and personal card receiving surface 120 may be configured to securably couple at least one personal card in a manner substantially the same as that shown in, and discussed with reference to, FIGS. 12-18 and 38-40. The flexible member 132 may differ from the flexible member 22, as will be discussed in greater detail with reference to FIGS. 45-47.

Figure 43:
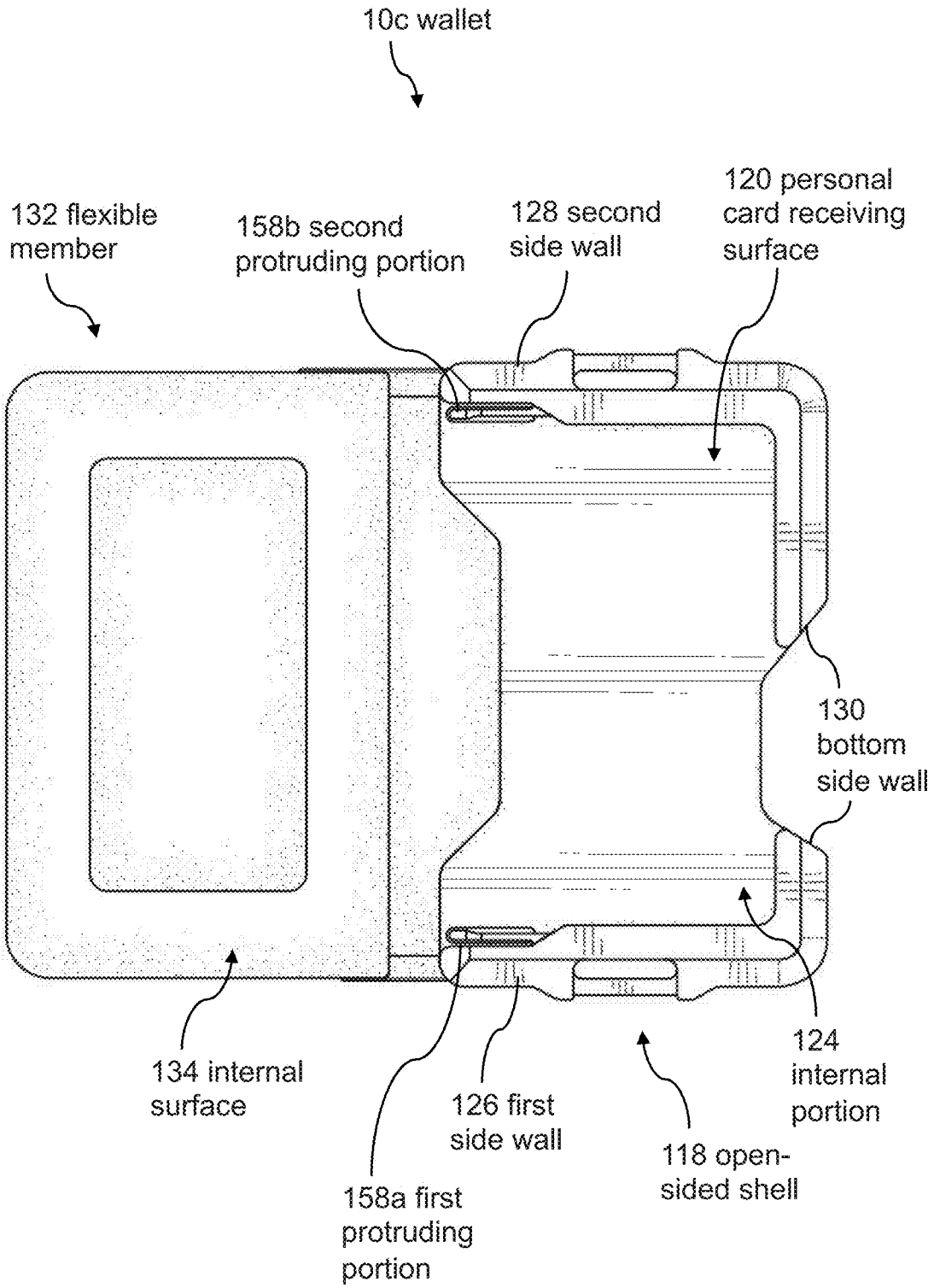
FIGS. 43 and 44 illustrate interior views of an open wallet, according to some embodiments.

FIG. 43 shows another interior view of the wallet 10*c*, and includes more detail about the elements of the wallet 10*c*. In some embodiments, as demonstrated in FIG. 43, the open-sided shell 118 comprises a first side wall 126, a second side wall 128 located opposite the first side wall 126, and a bottom side wall 130 extending between the first side wall 126 and the second side wall 128. In the same way that the open-sided shell 118 may be substantially the same as the open-sided shell 12, 13, it should be noted that the side walls 126, 128, 130 of the wallet 10*c* may be substantially the same as the corresponding side walls 50 (of the wallet 10*a*) and 51 (of the wallet 10*b*). In some embodiments, the first side wall 126, second side wall 128, and bottom side wall 130 are configured to retain the at least one personal card (not shown in FIG. 43) in place within the internal portion 124 of the open-sided shell 118 (i.e., adjacent and/or against the personal card receiving surface 120).

FIG. 43 also illustrates the first protruding portion 158*a* and the second protruding portion 158*b*. Similar to the other elements of the open-sided shell 118, the first and second protruding portions 158*a*, 158*b* may be substantially the same as the first and second protruding portions 58*a*, 58*b* of the first and second retention tabs 52*a*, 52*b* previously discussed in this disclosure. For example, the first and second protruding portions 158*a*, 158*b* may be configured to move between a locked position and a receiving position in order to receive and retain at least one personal card, as illustrated in FIGS. 12 and 13. Further, in order to couple to the open-sided shell 118, the at least one personal card may be inserted "over" the first and second protruding portions 158*a*, 158*b*, using the "angled" method as shown and discussed with reference to FIGS. 16-18.

Figure 44:
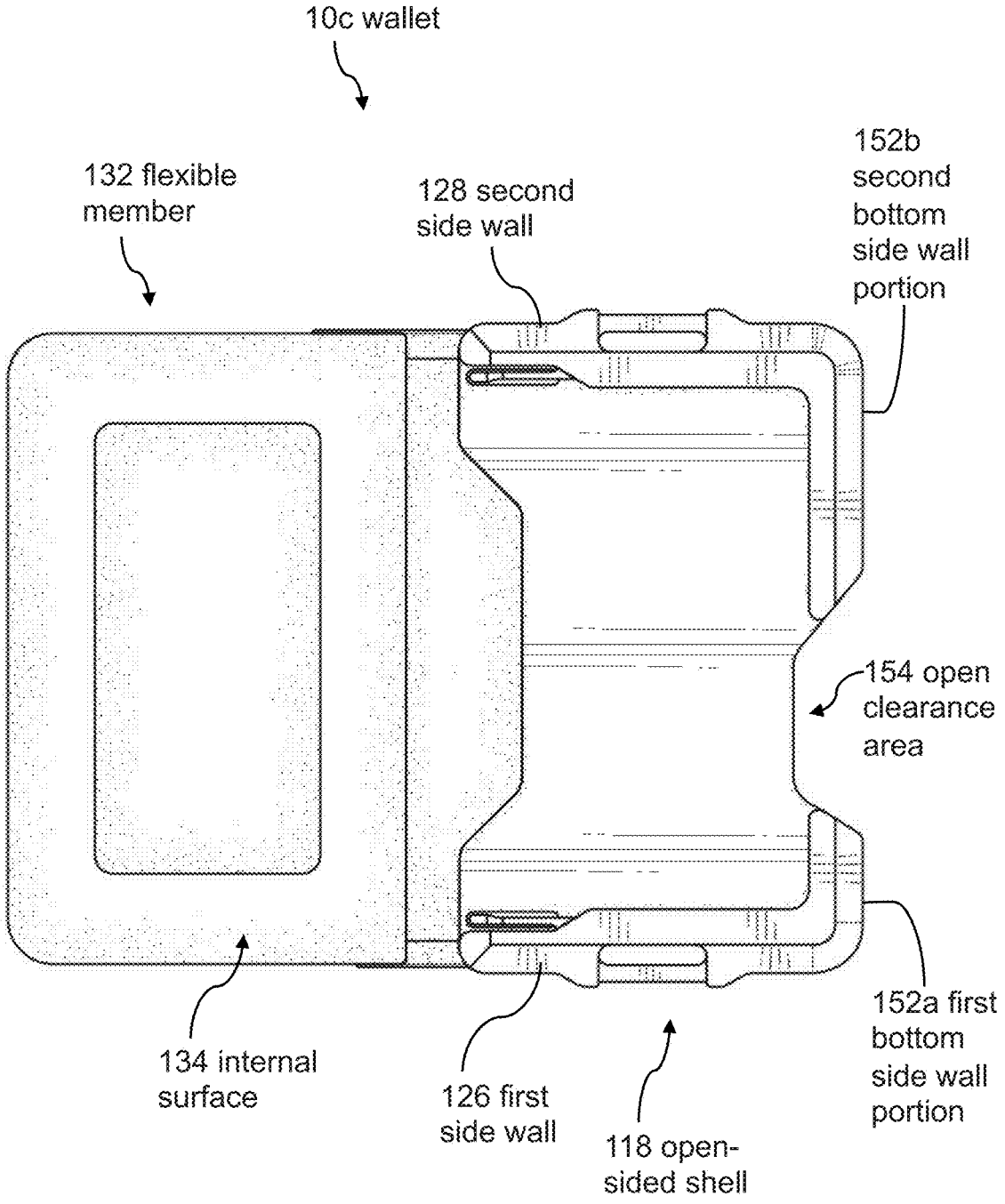

FIG. 44 shows the same view as FIG. 43 and illustrates that, in some embodiments, the bottom side wall 130 comprises a first bottom side wall portion 152*a* and a second bottom side wall portion 152*b*. The first bottom side wall portion 152*a* may define a first width and the second bottom side wall portion 152*b* may define a second width. In some embodiments, the first width is less than the second width. This is similar to the left and right side retaining surfaces 78*a*, 78*b* of the wallet 10*a*—illustrated in FIGS. 24 and 25B—where the left side retaining surface 78*a* defines a left side width 86*a* that is less than the right side width 86*b* of the right side retaining surface 78*b*. Further, and also similar to the wallets 10*a*, 10*b*, the wallet 10*c* may comprise an open clearance area 154 located between the first bottom side wall portion 152*a* and the second bottom side wall portion 152*b*, as illustrated in FIG. 44. In some embodiments, the open clearance area 154 is configured to receive a user's finger to thereby push at least one personal card away from the bottom side wall 130 so that the at least one personal card may be removed from the wallet 10*c*. The open clearance area 154 may be substantially the same as the open clearance area 70, 71 previously discussed in this disclosure.

As shown in FIGS. 43 and 44, the flexible member 132 may include an internal surface 134. In some embodiments, the flexible member 132 has an external surface 136 facing opposite the internal surface 134, shown in FIG. 45. The flexible member 132 may also define a bottom half 138 and a top half 140 located opposite the bottom half 138. In some embodiments, the internal surface 134 of the bottom half 138 is coupled to the back surface 122 of the open-sided shell 118, as shown. The internal surface 134 of the top half 140 may comprise a pocket configured to receive and retain at least one personal card. In some embodiments, the internal surface 134 of the top half 140 comprises a pocket configured to hold and display an identification card (i.e., an "identification window"), shown in FIGS. 42-44. Of course, any suitable personal card(s) and/or paper currency may be held and displayed in the pocket of the internal surface 134 of the top half 140.

Figure 45:
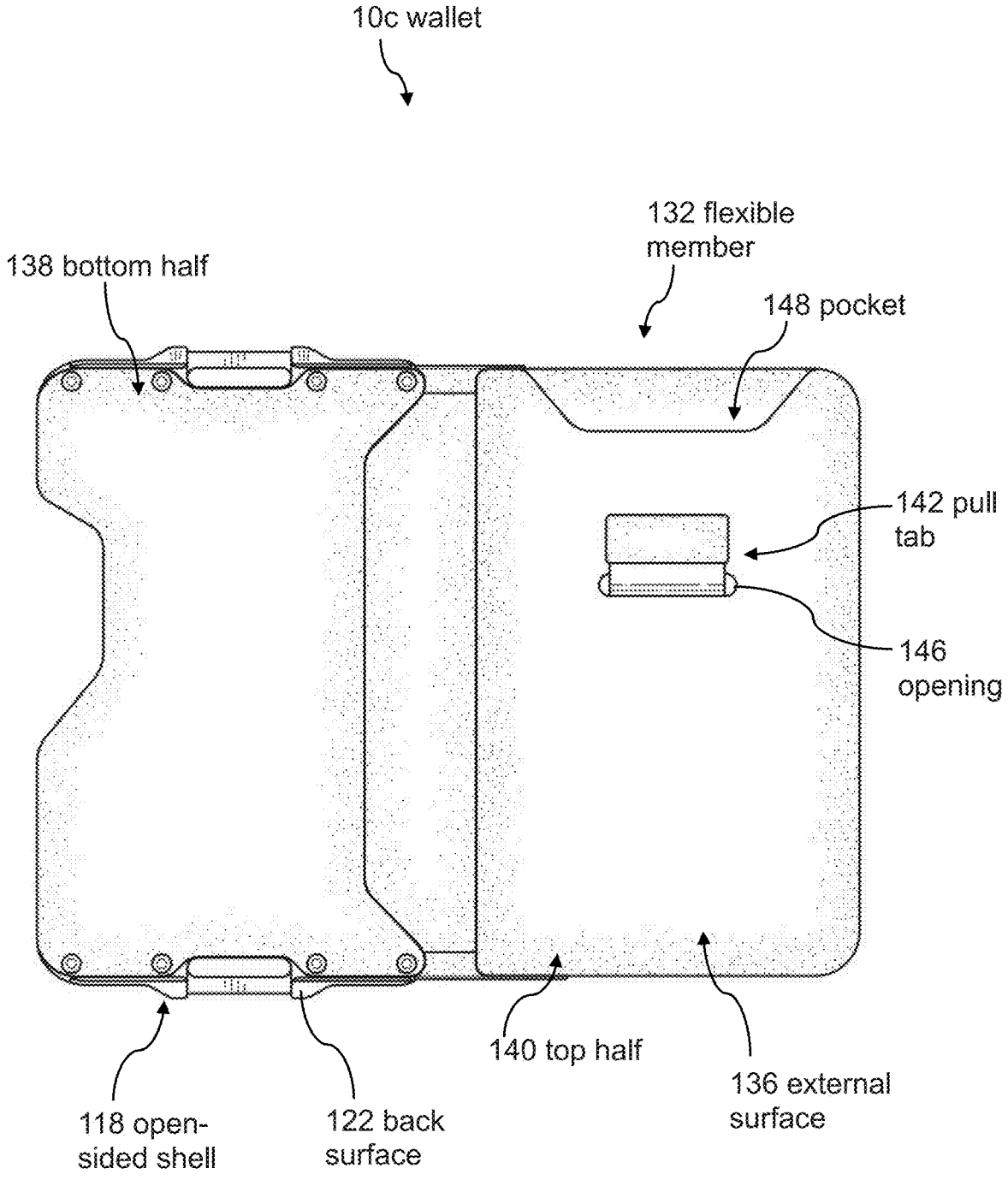
FIGS. 45, 46, and 47 illustrate exterior views of an open wallet including a pull tab, according to some embodiments.
Figure 46:
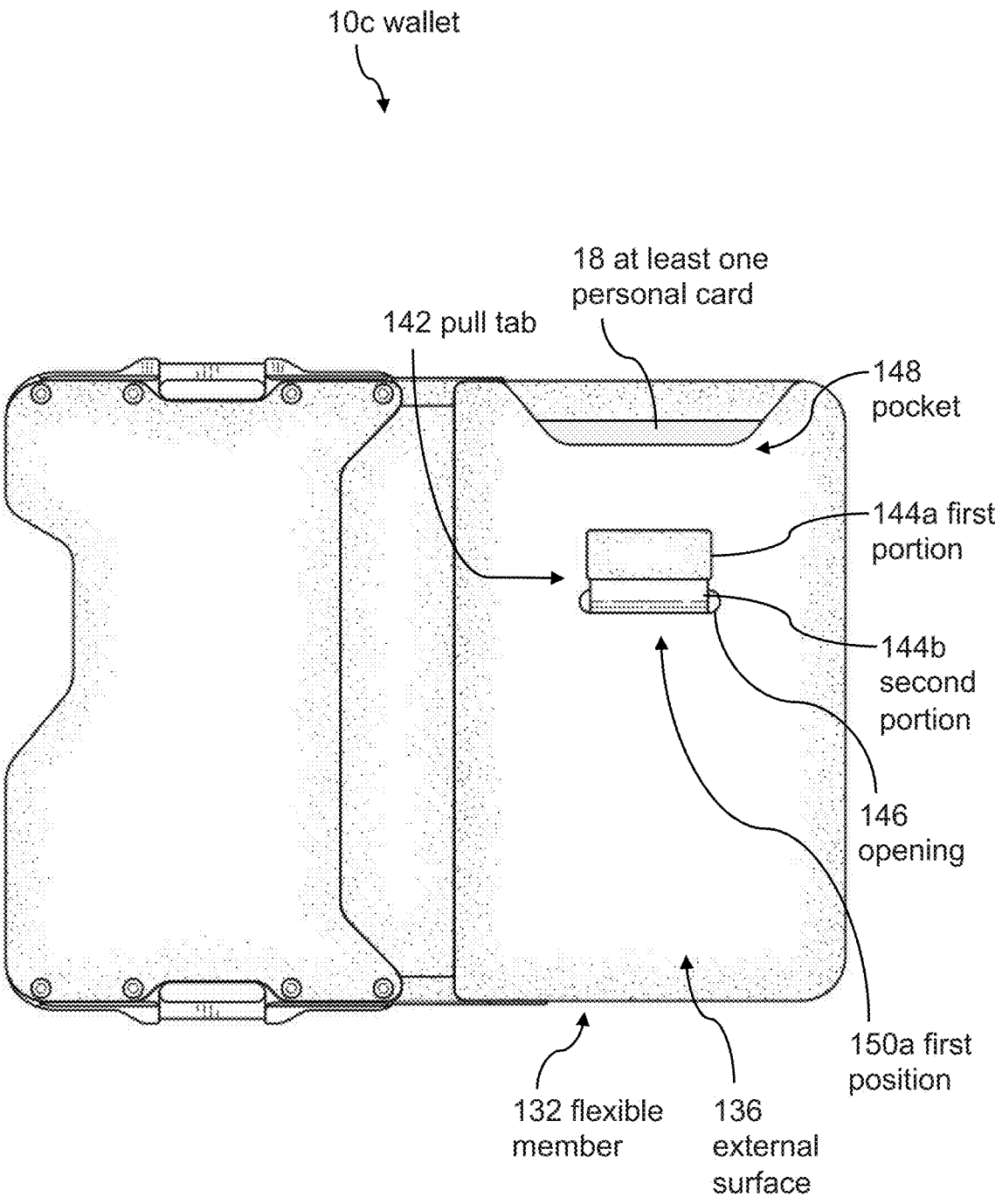
Figure 47:
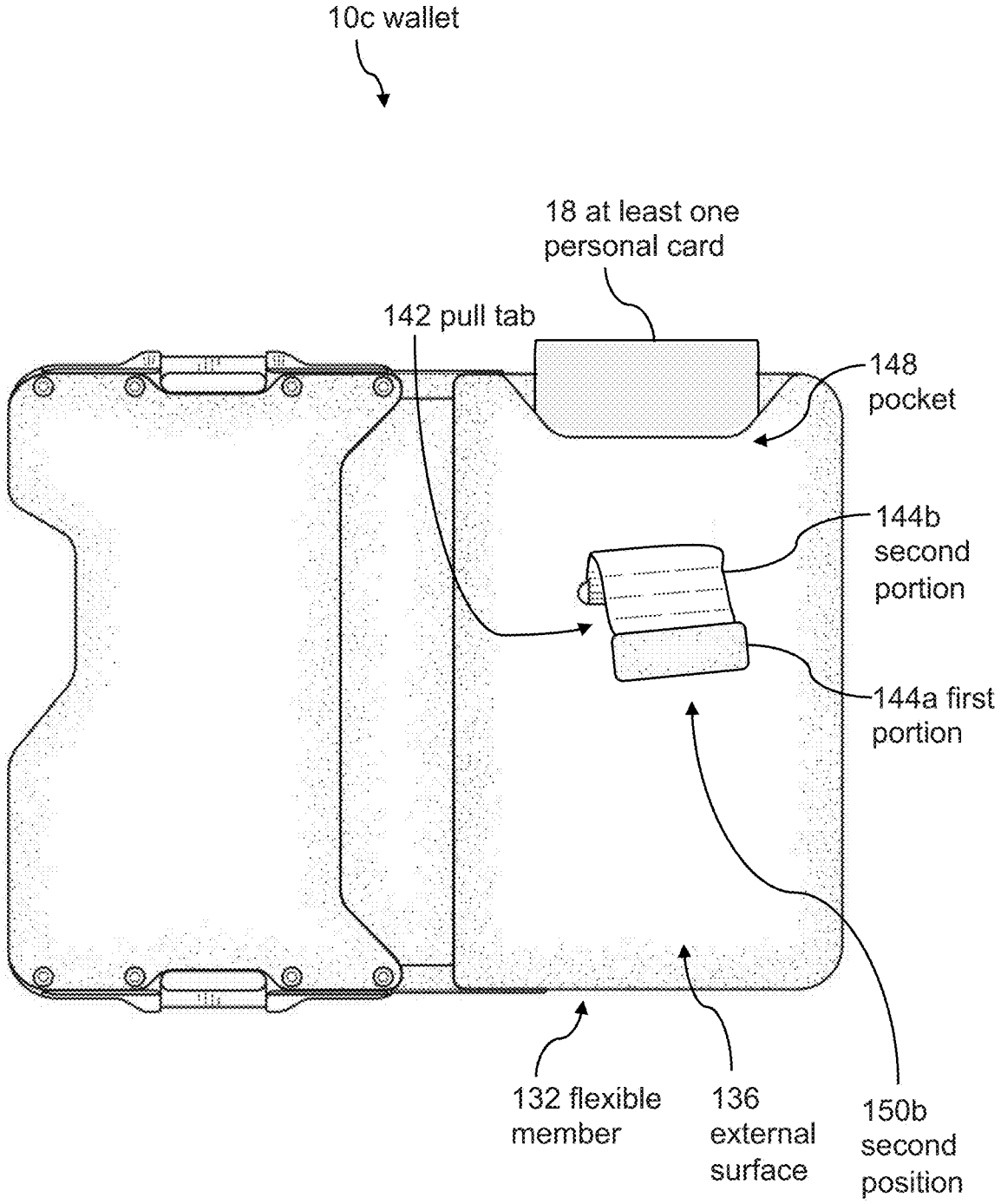

FIG. 45 further displays that, in some embodiments, the wallet 10*c* includes a pull tab 142 extending from an opening 146 in the external surface 136 of the flexible member 132. As shown in FIGS. 46 and 47, the pull tab 142 may be configured to facilitate removal of at least one personal card 18 from a pocket 148 coupled to the external surface 136. In some embodiments, the pull tab 142 defines a first portion 144*a* and a second portion 144*b*. The first portion 144*a* may comprise a material substantially similar to that of the flexible member 132 (e.g., leather, DTEX, or other suitable material), while the second portion 144*b* may comprise a more ribbon or strap-like structure. In some embodiments, the pull tab 142 is configured to move between a first position 150*a*, as shown in FIG. 46, and a second position 150*b*, as shown in FIG. 47.

In the first position 150*a*, the first portion 144*a* of the pull tab 142 may be configured to extend from the opening 146 in the external surface 136 of the flexible member 132, while the second portion 144*b* may be located at least partially within the flexible member 132. In some embodiments, in the first position 150*a*, the at least one personal card 18 is located within the pocket 148. The second portion 144*b* of the pull tab 142 may also be located within the pocket 148.

In the second position 150*b*, both the first portion 144*a* and the second portion 144*b* of the pull tab 142 may extend from the opening 146, and the at least one personal card 18 may be configured to extend from the pocket 148 for removal, as illustrated in FIG. 47. In order to move from the first position 150*a* to the second position 150*b*, a user may tug the pull tab 142 away from the opening 146, thereby extending the pull tab 142 from the opening 146 and partially removing the at least one personal card 18 from the pocket 148. In some embodiments, to restore the pull tab 142 back to the first position 150*a*, a user inserts the at least one personal card 18 back into the pocket 148, and the movement of the at least one personal card 18 within the pocket 148 is configured to retract the pull tab 142, particularly the second portion 144*b* of the pull tab 142, back into the opening 146.

Figure 48:
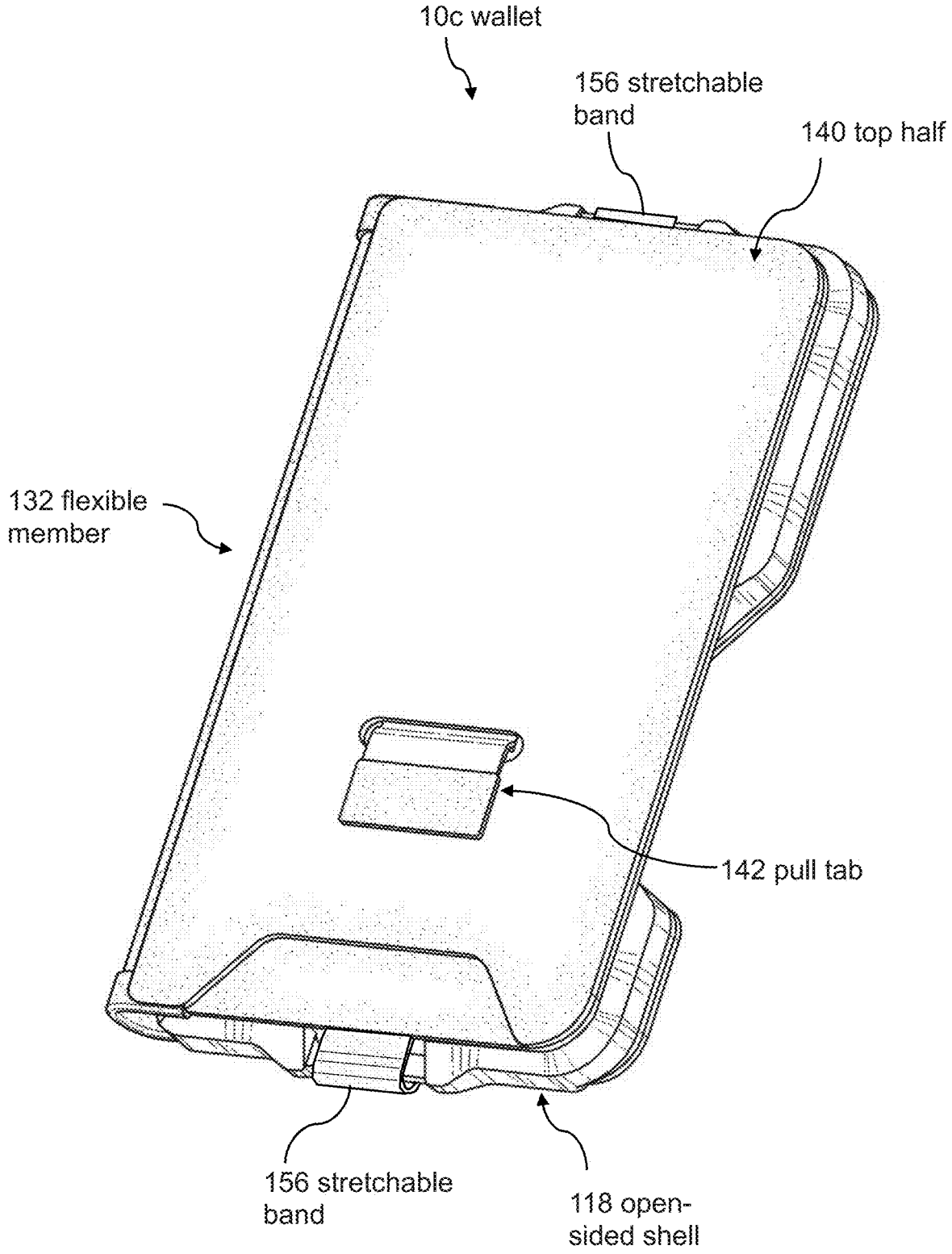
FIG. 48 illustrates a front perspective view of a wallet, according to some embodiments.
Figure 49:
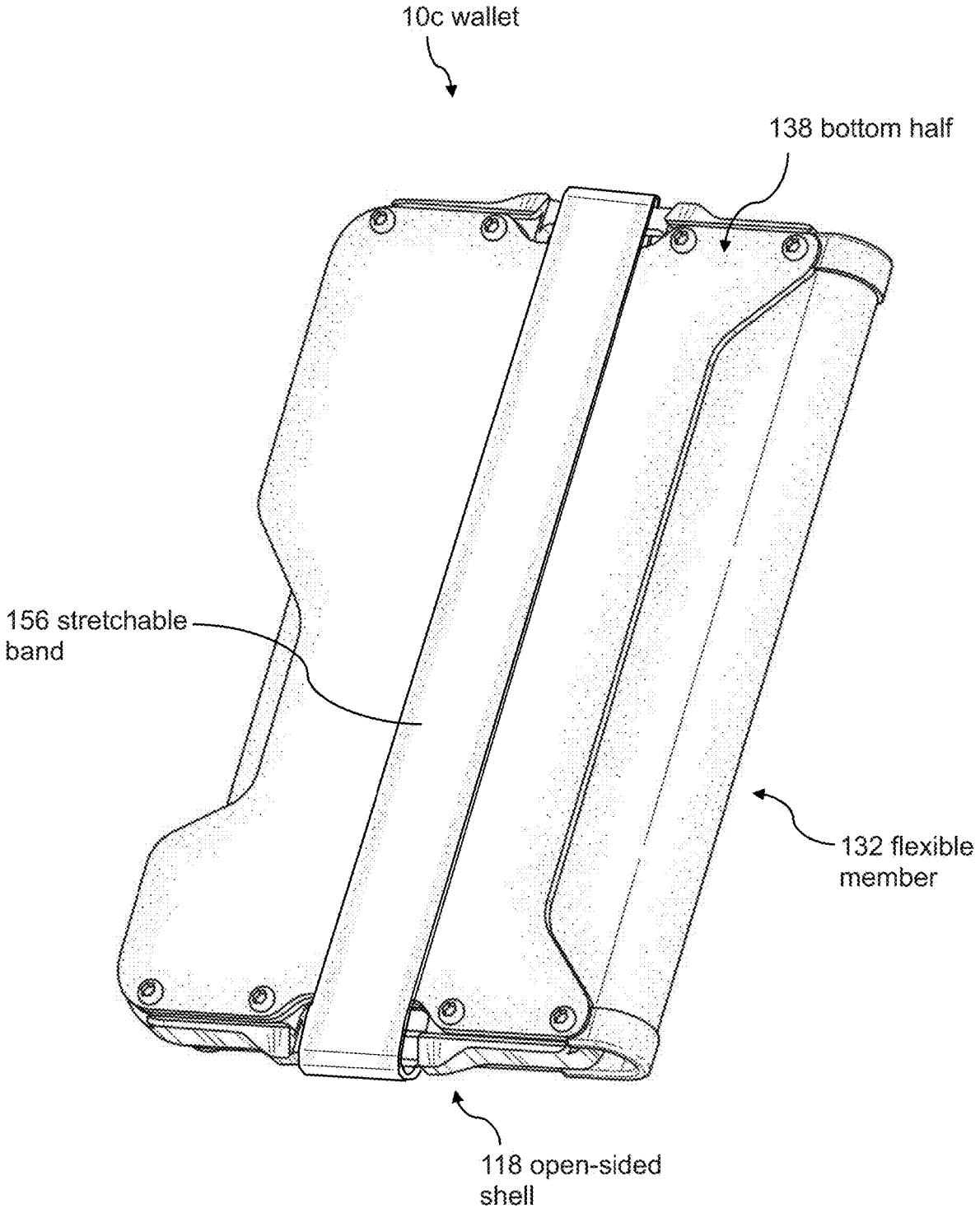
FIG. 49 illustrates a back perspective view of a wallet, according to some embodiments.

FIG. 48 shows a perspective view of the wallet 10*c* in a closed position, featuring the top half 140 of the flexible member 132 closed on top of the open-sided shell 118. FIGS. 48 and 49 illustrate that, in some embodiments, the wallet 10*c* includes a stretchable band 156 configured to wrap around the open-sided shell 118 and the bottom half 138 of the flexible member 132, as shown in FIG. 49. The stretchable band 156 may be configured to securably couple at least one personal card against at least one of the personal card receiving surface 120 and the external surface 136 of the flexible member 132. Depending on the configuration of the stretchable band 156 (e.g., if oriented as shown in FIGS. 3 and 5), it may also be configured to couple at least one personal card, paper currency, or other similar item(s) against the internal surface 134 of the flexible member 132. Similar to the elastic band 32, the stretchable band 156 may comprise two ends coupled to the top half 140 of the flexible member 132. It should also be noted that though not labeled in the figures, the wallet 10*c* may include a pocket located on the bottom half 138 of the external surface 136 of the flexible member 132, opposite the open-sided shell 118.

Figure 50:
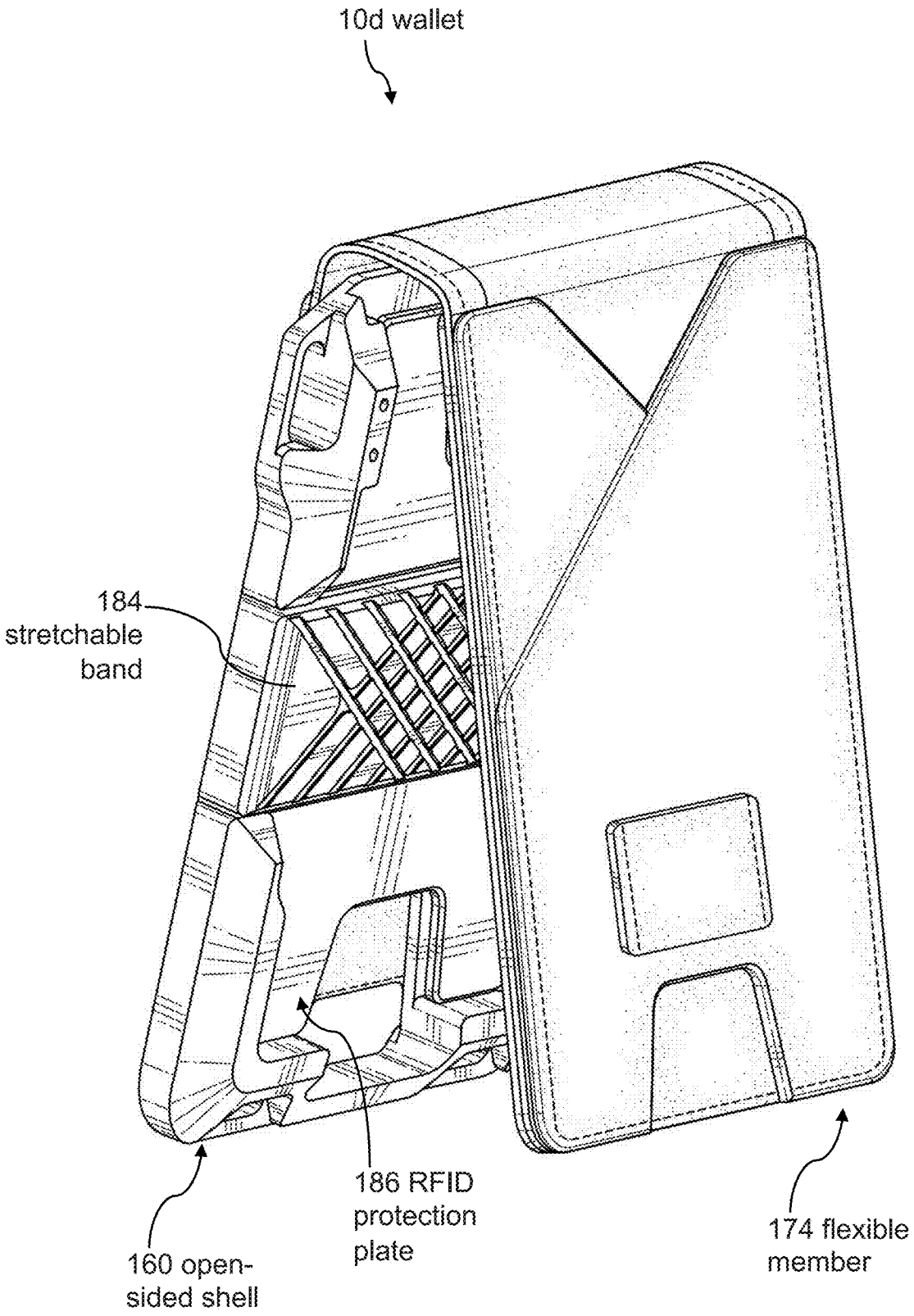
FIG. 50 illustrates an exterior and partial interior perspective view of a wallet, according to some embodiments.
Figure 51:
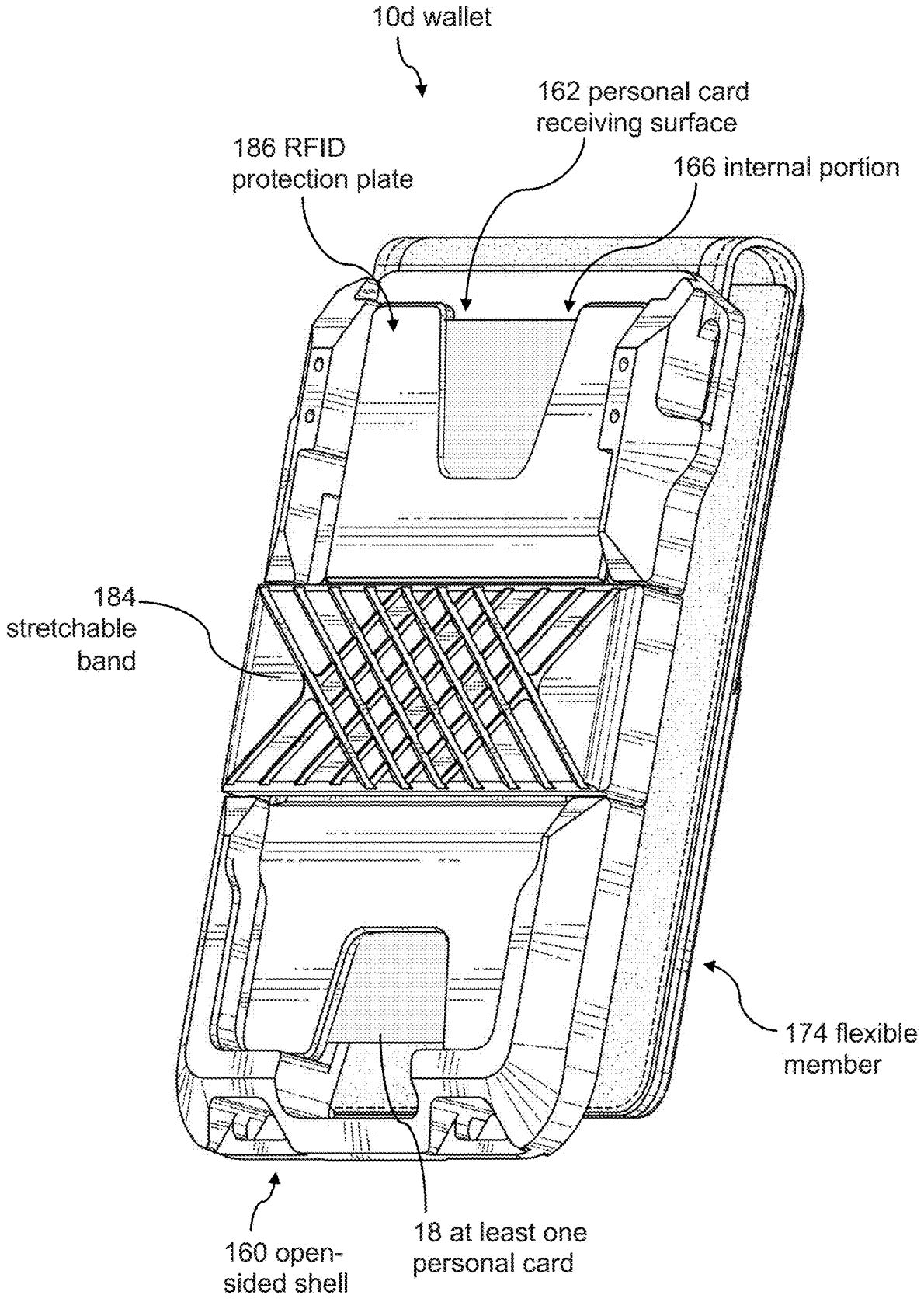
FIG. 51 illustrates an interior perspective view of a wallet, according to some embodiments.

FIG. 50 illustrates a wallet 10*d* comprising an open-sided shell 160, a flexible member 174, a stretchable band 184, and a radiofrequency identification (RFID) protection plate 186. It should be noted that the stretchable band 184 may resemble the stretchable band 156 (i.e., it may be a narrower band than shown in FIG. 50). In some embodiments, as shown in FIG. 51, the open-sided shell 160 has a personal card receiving surface 162, wherein the open-sided shell 160 is configured to securably couple at least one personal card 18 along the personal card receiving surface 162 within the internal portion 166 of the open-sided shell 160. The RFID protection plate 186 may be coupled to the open-sided shell 160 between the personal card receiving surface 162 and the stretchable band 184. In some embodiments, the tension applied to the RFID protection plate 186 by the stretchable band 184 is configured to retain at least one personal card 18 against the personal card receiving surface 162, as demonstrated in FIG. 51.

Figure 52:
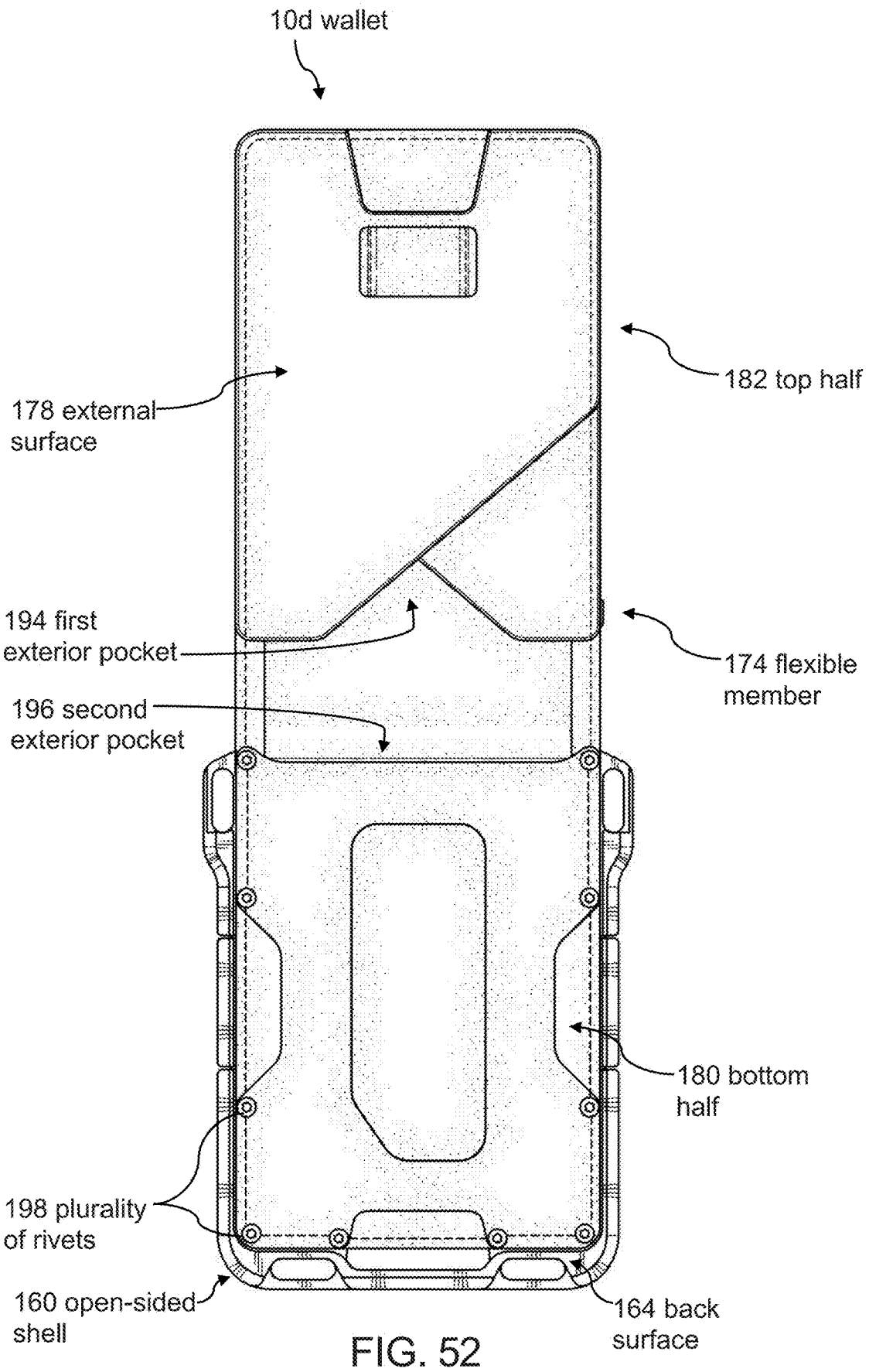
FIG. 52 illustrates an exterior view of a wallet, according to some embodiments.

FIG. 52 shows an exterior view of the wallet 10*d* in an open position. Similar to the flexible members 22, 132 previously discussed in this disclosure, the flexible member 174 may include an internal surface 176 (shown in FIG. 53) and an external surface 178 facing opposite the internal surface 176. In some embodiments, the flexible member 174 defines a bottom half 180 and a top half 182 located opposite the bottom half 180. The internal surface 176 of the bottom half 180 may be coupled to the back surface 164 of the open-sided shell 160.

Also illustrated in FIG. 52 are a first exterior pocket 194 and a second exterior pocket 196. In some embodiments, the wallet 10*d* comprises a first exterior pocket 194 coupled to the top half 182 of the flexible member 174 and located along the external surface 178 of the flexible member 174. The first exterior pocket 194 may be configured to receive and retain at least one personal card 18. In some embodiments, the wallet 10*d* also includes a second exterior pocket 196 coupled to the bottom half 180 of the flexible member 174 and located along the external surface 178 of the flexible member 174 opposite the open-sided shell 160. Like the first exterior pocket 194, the second exterior pocket 196 may be configured to receive and retain at least one personal card 18.

In some embodiments, the first exterior pocket 194 includes an open clearance area, shown in FIG. 52 as the "U" shaped element at the top of the wallet 10*d*. Similar to the open clearance areas 70, 71, 154 previously discussed in this disclosure, the open clearance area of the first exterior pocket 194 may be used to facilitate removal of at least one personal card 18 from the first exterior pocket 194. Likewise, the second exterior pocket 196 may include a smaller open clearance area, shown toward the bottom of FIG. 52. The second exterior pocket 196 may also include an aperture, represented by the five-sided element in the center of the bottom half 180 of the flexible member 174. In some embodiments, the aperture allows a user to view the at least one personal card 18 located within the second exterior pocket 196, and may also facilitate removal of the at least one personal card 18 by allowing a user to contact the card 18 through the aperture, and slide it toward the opening of the second exterior pocket 196. As shown in FIG. 52, the second exterior pocket 196 may also include two side cut-outs (e.g., where the arrow is pointing for the bottom half 180) for similar viewing and contact purposes as the center aperture.

The second exterior pocket 196 may be coupled to the flexible member 174 via stitching, indicated by the even broken lines shown in FIG. 52. Further, in some embodiments, the second exterior pocket 196 is coupled to the open-sided shell 160 via a plurality of rivets 198, also shown in FIG. 52. The plurality of rivets 198 may be substantially similar to the rivets 112, 113 previously discussed in this disclosure. The stitching and the plurality of rivets 198 may extend around a perimeter of the bottom half 180 of the flexible member 174, as shown. In some embodiments, the first exterior pocket 194 is coupled to the flexible member 174 via stitching extending along a perimeter of the top half 182 of the flexible member 174.

Figure 53:
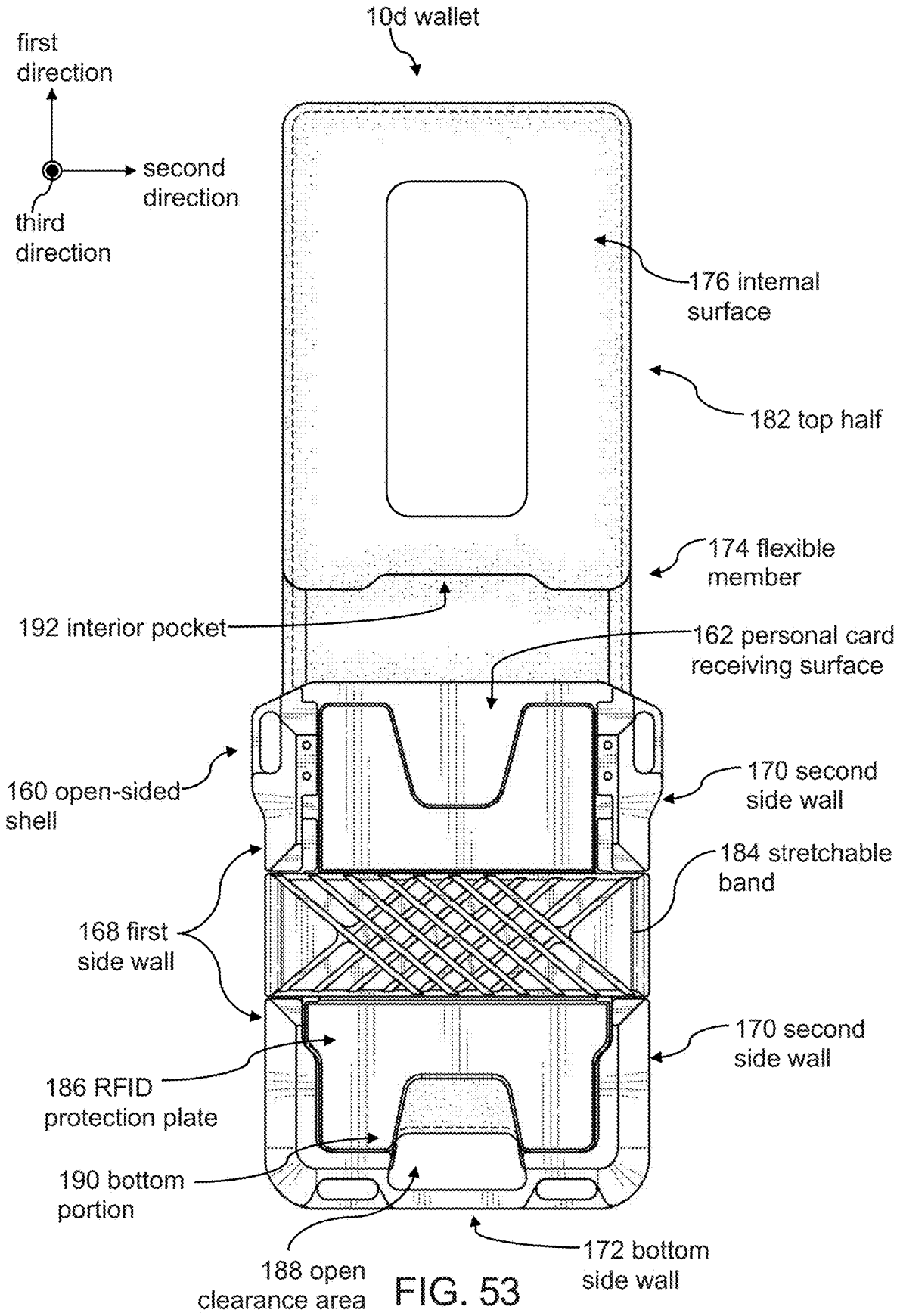
FIG. 53 illustrates an interior view of a wallet, according to some embodiments.

As illustrated in FIG. 53, the wallet 10*d* may further comprise an interior pocket 192 coupled to the top half 182 of the flexible member 174 and located along the internal surface 176 of the flexible member 174. In some embodiments, the interior pocket 192 is located opposite the first exterior pocket 194, and is configured to receive and retain at least one personal card 18. Similar to the second exterior pocket 196, the interior pocket 192 may include a central aperture for viewing and/or contacting the at least one personal card 18 located within the interior pocket 192. In some embodiments, the interior pocket 192 is coupled to the flexible member 174 via stitching extending along a perimeter of the top half 182 of the flexible member 174, in a manner similar to the first exterior pocket 194.

FIG. 53 also includes more details about the open-sided shell 160. In some embodiments, the open-sided shell 160 comprises a first side wall 168, a second side wall 170 located opposite the first side wall 168, and a bottom side wall 172 extending between the first side wall 168 and the second side wall 170. The first side wall 168, second side wall 170, and bottom side wall 172 may be configured to retain at least one personal card 18 with respect to the personal card receiving surface 162. FIG. 53 also shows the stretchable band 184. In some embodiments, the stretchable band 184 is configured to wrap around the open-sided shell 160 and is configured to securably couple at least one personal card 18 against the personal card receiving surface 162. Though not shown in the Figures, the stretchable band 184 may also be configured to wrap around the bottom half 180 of the flexible member 174, similar to the stretchable band 156 of the wallet 10*c* shown in FIG. 49. In some embodiments, when wrapped around the bottom half 180 of the flexible member 174, the stretchable band 184 is configured to securably couple at least one personal card 18 against the external surface 178 of the flexible member 174. In addition to securing the at least one personal card 18, the stretchable band 184 may also couple paper currency, receipts, or other similar items against at least one of the external surface 178, the RFID protection plate 186, and the personal card receiving surface 162.

FIG. 53 includes a directional indicator showing a first direction, a second direction, and a third direction. In some embodiments, the first side wall 168 and the second side wall 170 are elongate along the first direction, and the bottom side wall 172 is elongate along the second direction perpendicular to the first direction. The stretchable band 184 may wrap around the open-sided shell 160 along the second direction. In some embodiments, the RFID protection plate 186 is configured to move along the third direction perpendicular to the first direction and the second direction to securably couple at least one personal card 18 between the RFID protection plate 186 and the personal card receiving surface 162. In addition, the stretchable band 184 may be configured to extend along the third direction to couple at least one personal card and at least one paper bill between the stretchable band 184 and the flexible member 174 and/or the RFID protection plate 186.

In some embodiments, at least one of the open-sided shell 160 and the RFID protection plate 186 comprise an open clearance area 188. For example, as shown in FIG. 53, the open clearance area 188 may be located along a bottom portion 190 of the RFID protection plate 186. In some embodiments, similar to the open clearance areas previously discussed in this disclosure, the open clearance area 188 is configured to receive a user's finger to thereby push the at least one personal card 18 away from the bottom portion 190 such that the at least one personal card 18 may be removed from the wallet 10*d*.

Figure 54:
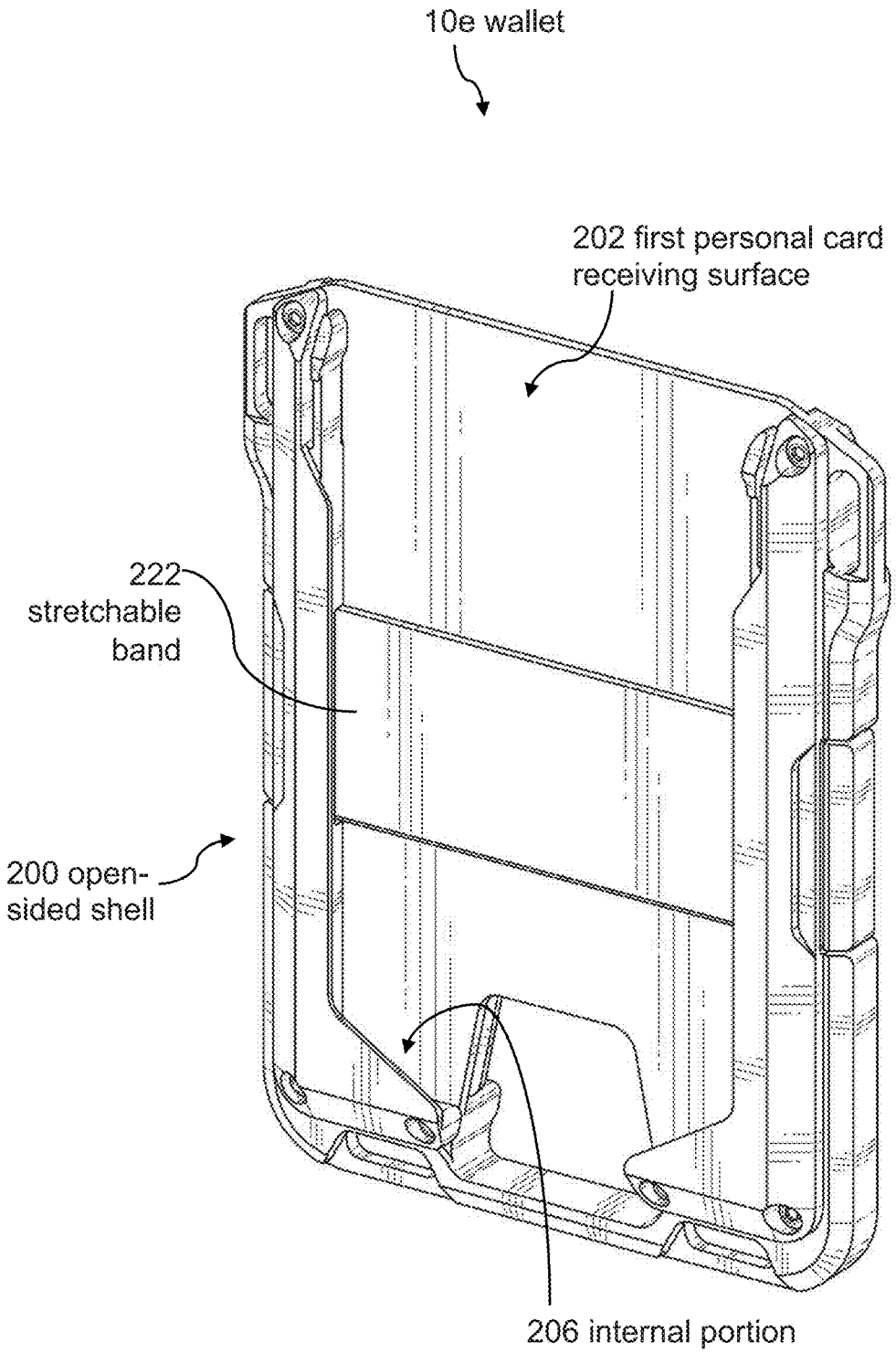
FIG. 54 illustrates a perspective view of one side of a wallet, according to some embodiments.

Turning now to FIG. 54, an embodiment of a wallet 10*e* is shown. The wallet 10*e* may comprise an open-sided shell 200 having a first personal card receiving surface 202 defining an internal portion 206, and a stretchable band 222. In some embodiments, the wallet 10*e* further comprises a second personal card receiving surface 204, shown in FIG. 55, facing opposite the first personal card receiving surface 202. The open-sided shell 200 may be configured to securably couple at least one personal card 18 along the first personal card receiving surface 202 and the second personal card receiving surface 204 within an internal portion 206 of the open-sided shell 200.

Figure 55:
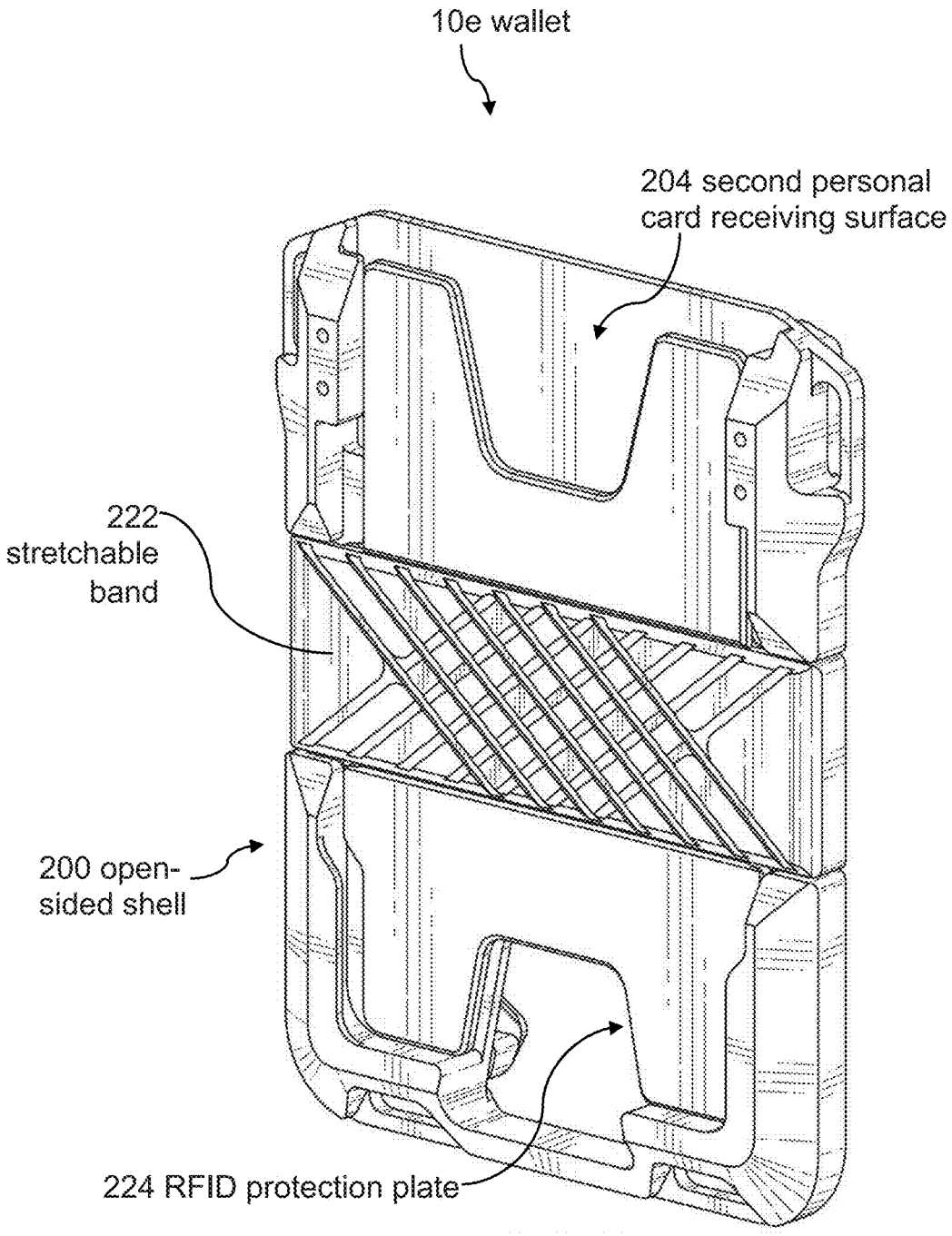
FIG. 55 illustrates a perspective view of another side of the wallet of FIG. 54, according to some embodiments.

As shown in FIGS. 54 and 55, the wallet 10*e* may comprise a stretchable band 222 configured to wrap around the open-sided shell 200. In some embodiments, the stretchable band 222 is configured to securably couple at least one personal card 18 against at least one of the first personal card receiving surface 202 and the second personal card receiving surface 204. As indicated in FIG. 55, the wallet 10*e* may also include an RFID protection plate 224 coupled to the open-sided shell 200. In some embodiments, the RFID protection plate 224 is located between the second personal card receiving surface 204 and the stretchable band 222, and is configured to securably couple at least one personal card 18 between the RFID protection plate 224 and the second personal card receiving surface 204. It should be noted that the RFID protection plate 224 may be substantially the same as the RFID protection plate 186 of the wallet 10*d*. In some embodiments, both RFID protection plates 186, 224 are composed of a material sufficient to block RFID signals, such as aluminum or another suitable metallic material. In addition, as discussed with reference to FIG. 53, the stretchable band 222 may be configured to securably couple at least one personal card 18, at least one paper bill, etc. against the RFID protection plate 224 between the stretchable band 222 and the RFID protection plate 224.

Figure 56:
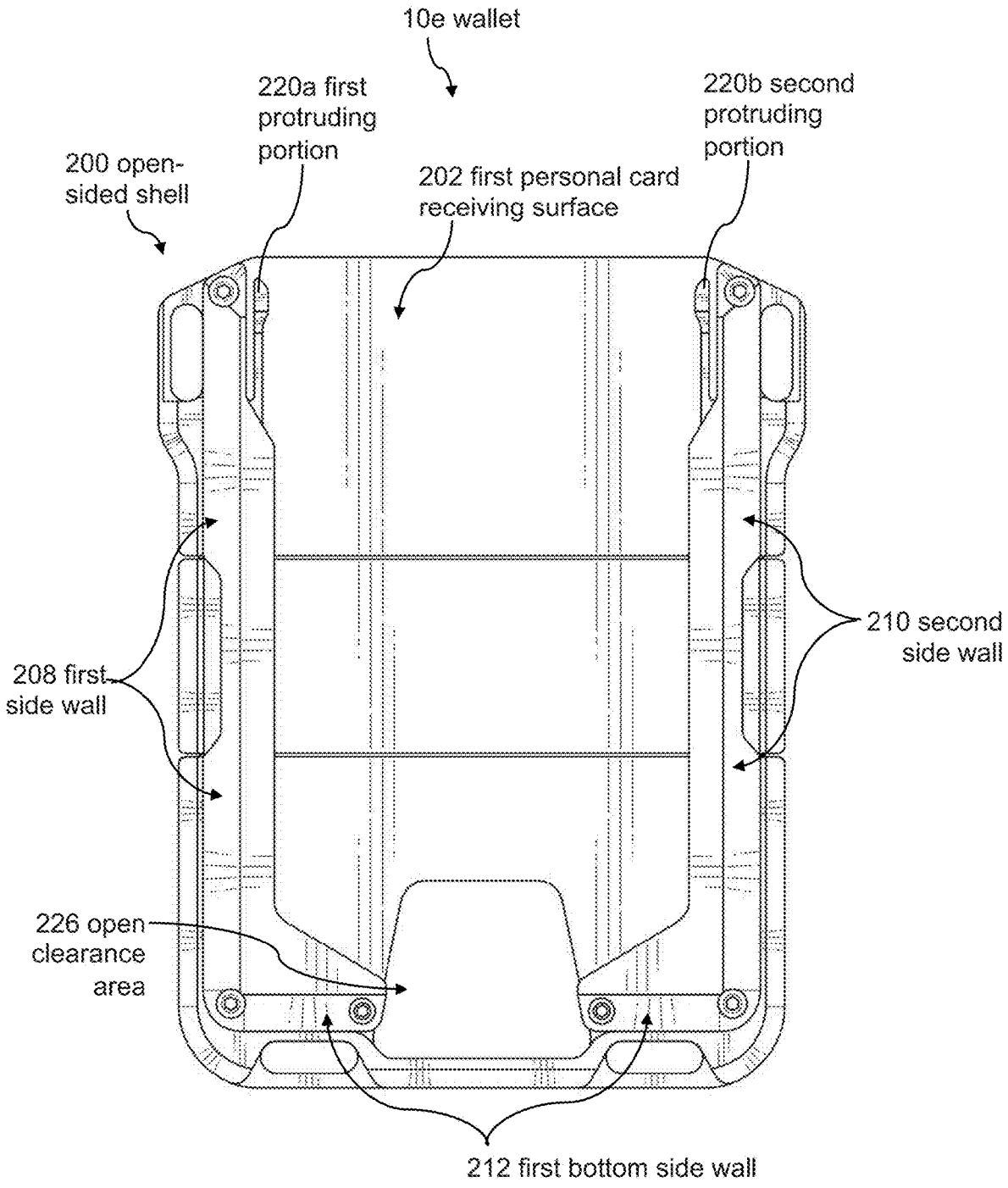
FIG. 56 illustrates the side of the wallet shown in FIG. 54, according to some embodiments.

FIG. 56 illustrates the side of the open-sided shell 200 including the first personal card receiving surface 202. In some embodiments, the first personal card receiving surface 202 comprises a first side wall 208, a second side wall 210 located opposite the first side wall 208, and a first bottom side wall 212 extending between the first side wall 208 and the second side wall 210. The first side wall 208, second side wall 210, and first bottom side wall 212 may be configured to retain at least one personal card 18 in place with respect to the first personal card receiving surface 202. In some embodiments, as shown in FIG. 56, the wallet 10*e* includes an open clearance area 226 located along a bottom portion of the open-sided shell 200, adjacent the first bottom side wall 212. Like the other open clearance areas 70, 71, 154, and 188 previously discussed in this disclosure, the open clearance area 226 may be configured to receive a user's finger to push at least one personal card 18 away from the bottom portion of the open-sided shell 200 to facilitate removal of the at least one personal card 18.

In some embodiments, as shown in FIG. 56, the wallet 10*e* further comprises a first protruding portion 220*a* and a second protruding portion 220*b*. As discussed with reference to the wallet 10*c* of FIG. 43, the first and second protruding portions 220*a*, 220*b* may be substantially the same as the first and second protruding portions 58*a*, 58*b* of the first and second retention tabs 52*a*, 52*b* previously discussed in this disclosure. For example, the first and second protruding portions 220*a*, 220*b* may be configured to move between a locked position and a receiving position in order to receive and retain at least one personal card, as illustrated in FIGS. 12 and 13. Further, in order to couple to the open-sided shell 200, the at least one personal card may be inserted "over" the first and second protruding portions 220*a*, 220*b*, using the "angled" method as shown and discussed with reference to FIGS. 16-18.

Figure 57:
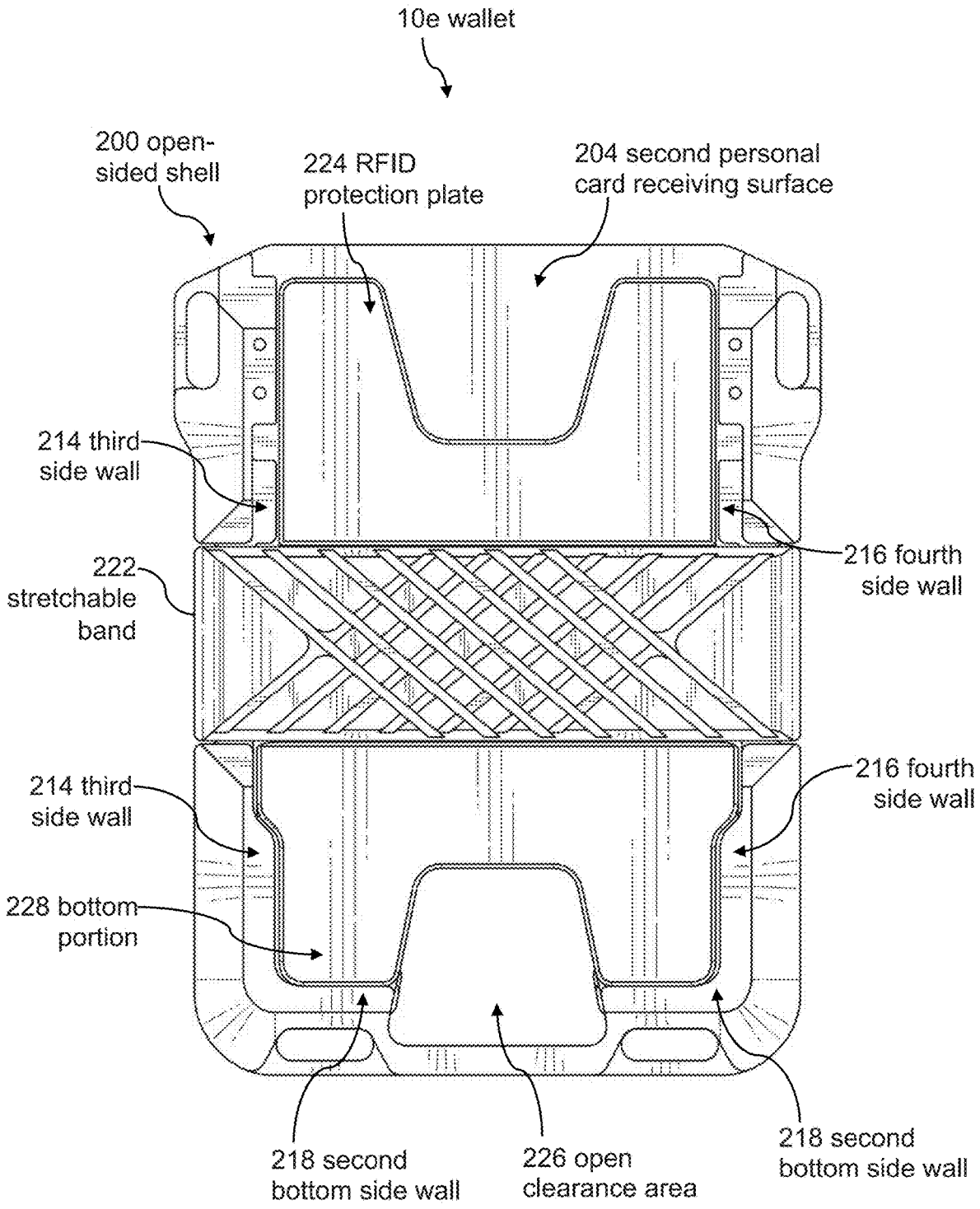
FIG. 57 illustrates the side of the wallet shown in FIG. 55, according to some embodiments.

FIG. 57 shows a view of the wallet 10*e* including the second personal card receiving surface 204. In some embodiments, the second personal card receiving surface 204 comprises a third side wall 214, a fourth side wall 216 located opposite the third side wall 214, and a second bottom side wall 218 extending between the third side wall 214 and the fourth side wall 216. The third side wall 214, fourth side wall 216, and second bottom side wall 218, along with the RFID protection plate 224 and stretchable band 222, may be configured to securably couple at least one personal card 18 in place with respect to the second personal card receiving surface 204. FIG. 57 also shows the open clearance area 226 located along the bottom portion 228 of the RFID protection plate 224.

Figure 58:
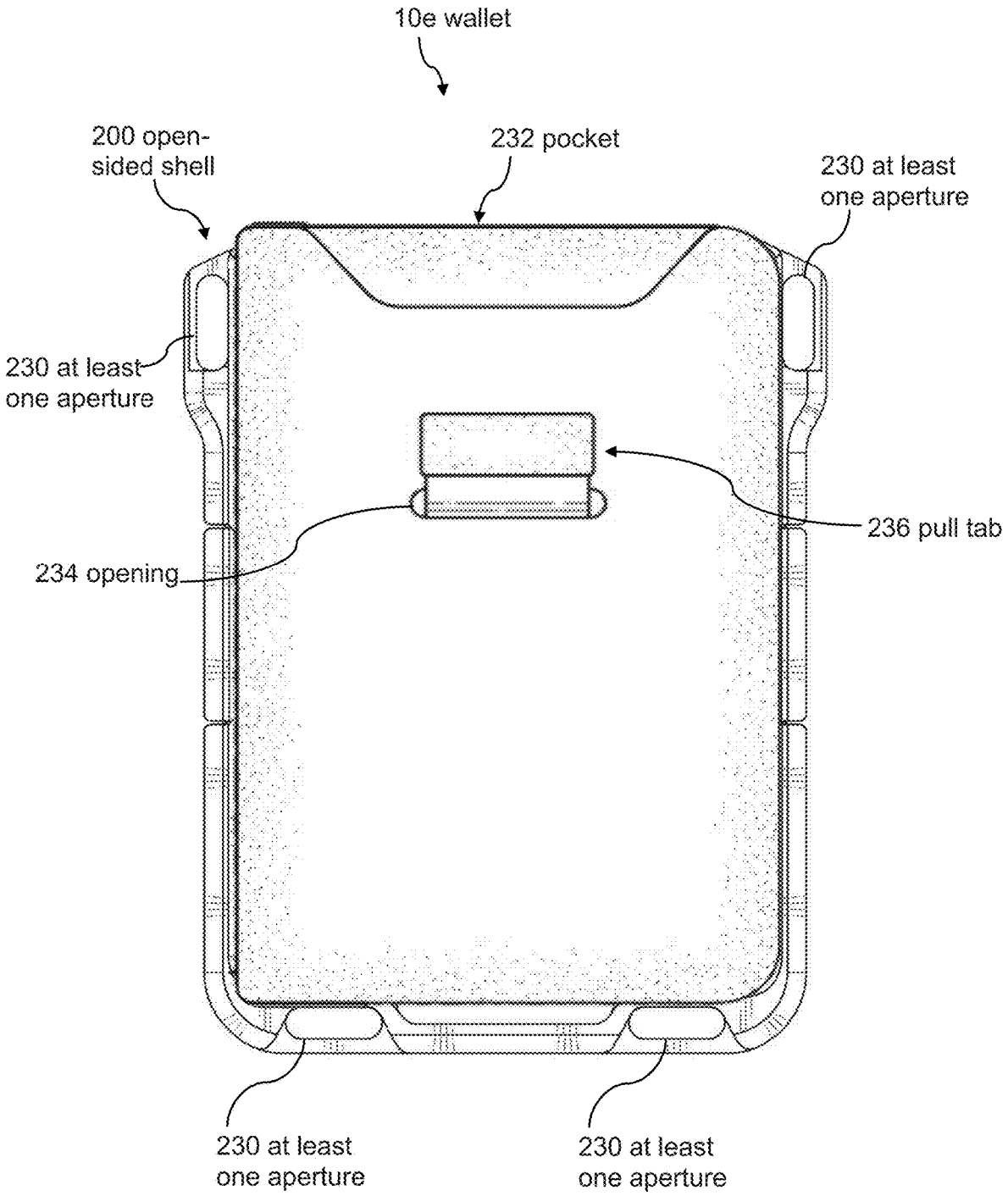
FIG. 58 illustrates a wallet including a pocket, according to some embodiments.

FIG. 58 illustrates another embodiment of the wallet 10*e*. In some embodiments, as shown in FIG. 58, the wallet 10*e* further comprises a pocket 232 detachably coupled to the open-sided shell 200. The pocket 232 may be coupled adjacent the second personal card receiving surface 204 and may be configured to receive at least one personal card 18. In some embodiments, as demonstrated in FIG. 58, the pocket 232 comprises an opening 234 configured to receive a pull tab 236. It should be noted that the pocket 232, opening 234, and pull tab 236 may be substantially similar to the pocket 148, opening 146, and pull tab 142 of the wallet 10*c*. Accordingly, the pull tab 236 may be configured move between a first position and second position, as illustrated in and discussed with reference to FIGS. 46 and 47, in order to facilitate removal of the at least one personal card 18 from the pocket 232. The pocket 232 may be configured to detachably couple to the open-sided shell 200 adjacent the first personal card receiving surface 202, rather than the second personal card receiving surface 204.

FIG. 58 also includes at least one aperture 230. In some embodiments, the wallet 10*e* further comprises at least one aperture 230 located along a perimeter of the open-sided shell 200. The at least one aperture 230 may be configured to receive an attaching mechanism to thereby couple the wallet 10*e* to at least one of a key, a lanyard, and a tether. Example attaching mechanisms include, but are not limited to, a keyring, a carabiner, a clasp, and any other suitable mechanism to facilitate coupling of the wallet 10*e* to an external element, such as a key, chain, belt loop, lanyard, etc.

It should be noted that the wallets 10*a*, 10*b*, and 10*c* may be considered as defining a "landscape" or "horizontal" orientation, with regard to how the at least one personal card 18 couples to the open-sided shell 118. Stated differently, when the wallets 10*a*, 10*b*, and/or 10*c* are held open to read information on the at least one personal card 18, the height of the open-sided shells 12, 13, 118 is less than the width. In contrast, FIGS. 50-58 illustrate embodiments of a wallet 10*d* and a wallet 10*e*, which have "portrait" or "vertical" orientations such that a typical credit card, gift card, business card, or the like, is rotated 90° for insertion. It is not the intention of the Figures or the disclosure to limit the wallets 10*a-e* to these specific orientations. For example, the open-sided shell 118 of the wallet 10*c* may be configured to resemble the open-sided shell 200 of the wallet 10*e*, as shown in FIG. 54, and remain suitable to securely retain at least one personal card 18.

Further, some elements, like the at least one aperture 230 shown in FIG. 58, may also be found in embodiments of the wallets 10*a*, 10*b*, and/or 10*c* not explicitly shown in the Figures. For example, in some embodiments, first side wall 126 of the wallet 10*c* comprises a first aperture and a second aperture. The first aperture may be configured to receive an attaching mechanism to thereby couple the wallet 10*c* to at least one of a key, lanyard, tether, or other similar mechanism. In some embodiments, the second side wall 128 comprises a third aperture, and the second and third apertures are configured to receive the stretchable band 156.

INTERPRETATION

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments include A, B, and C. The term "and/or" is used to avoid unnecessary redundancy.

The term "about" is used to mean "approximately." For example, the disclosure includes, "In some embodiments, the difference between the first distance 64*a* and second distance 64*b* is about a few millimeters." In this context, "about a few millimeters" is used to mean "approximately" a few millimeters. A range of 1-10 millimeters falls into an acceptable range and interpretation of "about a few millimeters," as used in this disclosure.

The term "substantially" is used to mean "completely" or "nearly completely." For example, the disclosure includes, "When the wallet is in the open position, the flexible member may be configured to lay substantially flat . . . " In this context, "substantially flat" is used to mean that the flexible member may lay "completely" flat or "nearly completely" flat, and fall into the understanding of "substantially" as used in this disclosure. It is understood that the flexible member may or may not lay "completely" flat, depending on a number of factors, including position of the elastic band and number of cards coupled to the identification window and/or second external pocket. In many embodiments, when the wallet is in the open position, the flexible member may be considered to lay substantially flat.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

What is claimed is:

1. A wallet, comprising:

an open-sided shell having a personal card receiving surface and a back surface facing opposite the personal card receiving surface, the open-sided shell configured to securably couple at least one personal card along the personal card receiving surface within an internal portion of the open-sided shell, the open-sided shell further comprising a first side wall, a second side wall located opposite the first side wall, and a bottom side wall extending between the first side wall and the second side wall, whereby the first side wall, the second side wall, and the bottom side wall are configured to retain the at least one personal card in place with respect to the personal card receiving surface;

a flexible member including an internal surface and an external surface facing opposite the internal surface, the flexible member defining a bottom half and a top half located opposite the bottom half, wherein the internal surface of the bottom half is coupled to the back surface of the open-sided shell, and wherein the internal surface of the top half is configured to retain and receive an identification card; and a pull tab coupled to the external surface of the flexible member and configured to extend from an opening in the external surface of the flexible member, the pull tab configured to facilitate removal of the at least one personal card from a pocket coupled to the external surface of the flexible member.

2. The wallet of claim 1, wherein the bottom side wall comprises a first bottom side wall portion and a second bottom side wall portion, wherein the first bottom side wall portion defines a first width and the second bottom side wall portion defines a second width, wherein the second width is greater than the first width.

3. The wallet of claim 2, further comprising an open clearance area located along a bottom portion of the open-sided shell, the open clearance area configured to receive a user's finger to thereby push the at least one personal card away from the bottom portion such that the at least one personal card may be removed from the wallet.

4. The wallet of claim 3, where the open clearance area is located between the first bottom side wall portion and the second bottom side wall portion.

5. The wallet of claim 1, further comprising a stretchable band configured to wrap around the open-sided shell and the bottom half of the flexible member, the stretchable band configured to securably couple at least one personal card against at least one of the personal card receiving surface and the external surface of the flexible member.

6. The wallet of claim 5, wherein the first side wall comprises a first aperture and a second aperture, the first aperture configured to receive an attaching mechanism to thereby couple the wallet to at least one of a key, a lanyard, and a tether, and wherein the second side wall comprises a third aperture, the second aperture and the third aperture configured to receive the stretchable band.

7. The wallet of claim 1, further comprising:

a first protruding portion coupled to the first side wall and configured to move away from the second side wall to thereby receive the at least one personal card, the first side wall defining a first top portion and a first bottom portion located adjacent the bottom side wall, the first protruding portion located adjacent the first top portion; and a second protruding portion coupled to the second side wall and configured to move away from the first side wall to thereby receive the at least one personal card, the second side wall defining a second top portion and a second bottom portion located adjacent the bottom side wall, the second protruding portion located adjacent the second top portion.

8. The wallet of claim 7, wherein the first protruding portion and the second protruding portion are configured to move between a locked position and a receiving position, wherein when the first protruding portion and the second protruding portion are in the locked position the first protruding portion and the second protruding portion are located a first distance from each other, wherein when the first protruding portion and second protruding portion are in the receiving position the first protruding portion and the second protruding portion are located a second distance from each other, and wherein the first distance is less than the second distance.

9. The wallet of claim 1, wherein the pull tab defines a first portion and a second portion, the pull tab configured to move between a first position and a second position, wherein in the first position the first portion of the pull tab is configured to extend from the opening in the external surface of the flexible member and the second portion of the pull tab is located at least partially within the flexible member, and the at least one personal card is located within the pocket, and wherein in the second position the first portion of the pull tab and the second portion of the pull tab are configured to extend from the opening in the external surface of the flexible member, and the at least one personal card is configured to at least partially extend from the pocket.

10. A wallet, comprising:

an open-sided shell having a personal card receiving surface and a back surface facing opposite the personal card receiving surface, the open-sided shell configured to securably couple at least one personal card along the personal card receiving surface within an internal portion of the open-sided shell, the open-sided shell comprising a first side wall, a second side wall located opposite the first side wall, and a bottom side wall extending between the first side wall and the second side wall, whereby the first side wall, the second side wall, and the bottom side wall are configured to retain the at least one personal card in place with respect to the personal card receiving surface;

a flexible member including an internal surface and an external surface facing opposite the internal surface, the flexible member defining a bottom half and a top half located opposite the bottom half, wherein the internal surface of the bottom half is coupled to the back surface of the open-sided shell;

a stretchable band configured to wrap around the open-sided shell and the bottom half of the flexible member, the stretchable band configured to securably couple at least one personal card against at least one of the personal card receiving surface and the external surface of the flexible member; and a radio frequency identification (RFID) protection plate coupled to the open-sided shell, wherein the RFID protection plate is located between the personal card receiving surface and the stretchable band, wherein the first side wall and the second side wall are elongate along a first direction, and the bottom side wall is elongate along a second direction perpendicular to the first direction, and wherein the stretchable band wraps around the open-sided shell and the bottom half of the flexible member along the second direction, wherein the RFID protection plate is configured to move along a third direction perpendicular to the first direction and the second direction to securably couple the at least one personal card between the RFID protection plate and the personal card receiving surface, and wherein the stretchable band is configured to extend along the third direction to couple at least one of at least one personal card and at least one paper bill between the stretchable band and the bottom half of the flexible member.

11. The wallet of claim 10, wherein at least one of the open-sided shell and the RFID protection plate comprises an open clearance area located along a bottom portion of at least one of the open-sided shell and the RFID protection plate, the open clearance area configured to receive a user's finger to thereby push the at least one personal card away from the bottom portion such that the at least one personal card may be removed from the wallet.

12. The wallet of claim 10, further comprising:

an interior pocket coupled to the top half of the flexible member and located along the internal surface of the flexible member, the interior pocket configured to receive and retain the at least one personal card;

a first exterior pocket coupled to the top half of the flexible member and located along the external surface of the flexible member opposite the interior pocket, the first exterior pocket configured to receive and retain the at least one personal card; and a second exterior pocket coupled to the bottom half of the flexible member and located along the external surface of the flexible member opposite the open-sided shell, the second exterior pocket configured to receive and retain the at least one personal card.

13. The wallet of claim 12, wherein the interior pocket and the first exterior pocket are coupled to the top half of the flexible member via stitching extending along a perimeter of the top half of the flexible member, and wherein the second exterior pocket is coupled to the flexible member via stitching and is coupled to the open-sided shell via a plurality of rivets, wherein the stitching and the plurality of rivets extend around a perimeter of the bottom half of the flexible member.

14. A wallet, comprising:

an open-sided shell having a first personal card receiving surface and a second personal card receiving surface facing opposite the first personal card receiving surface, the open-sided shell configured to securably couple at least one personal card along the first personal card receiving surface and the second personal card receiving surface within an internal portion of the open-sided shell, wherein the first personal card receiving surface comprises a first side wall, a second side wall located opposite the first side wall, and a first bottom side wall extending between the first side wall and the second side wall, whereby the first side wall, the second side wall, and the first bottom side wall are configured to retain the at least one personal card in place with respect to the first personal card receiving surface;

a first protruding portion coupled to the first side wall and configured to move away from the second side wall to thereby receive the at least one personal card, the first side wall defining a first top portion and a first bottom portion located adjacent the first bottom side wall, the first protruding portion located adjacent the first top portion; and a second protruding portion coupled to the second side wall and configured to move away from the first side wall to thereby receive the at least one personal card, the second side wall defining a second top portion and a second bottom portion located adjacent the bottom side wall, the second protruding portion located adjacent the second top portion.

15. The wallet of claim 14, wherein the second personal card receiving surface comprises a third side wall, a fourth side wall located opposite the third side wall, and a second bottom side wall extending between the third side wall and the fourth side wall.

16. The wallet of claim 15, further comprising a stretchable band configured to wrap around the open-sided shell, the stretchable band configured to securably couple at least one personal card against at least one of the first personal card receiving surface and the second personal card receiving surface.

17. The wallet of claim 16, further comprising a radio frequency identification (RFID) protection plate coupled to the open-sided shell, wherein the RFID protection plate is located between the second personal card receiving surface and the stretchable band, and wherein the RFID protection plate is configured to securably couple the at least one personal card between the RFID protection plate and the second personal card receiving surface.

18. The wallet of claim 17, wherein at least one of the open-sided shell and the RFID protection plate comprises an open clearance area located along a bottom portion of at least one of the open-sided shell and the RFID protection plate, the open clearance area configured to receive a user's finger to thereby push the at least one personal card away from the bottom portion such that the at least one personal card may be removed from the wallet.

19. The wallet of claim 18, further comprising at least one aperture located along a perimeter of the open-sided shell, the at least one aperture configured to receive an attaching mechanism to thereby couple the wallet to at least one of a key, a lanyard, and a tether.

20. The wallet of claim 14, further comprising a pocket configured to receive the at least one personal card, the pocket configured to detachably couple to the open-sided shell adjacent the second personal card receiving surface and comprising an opening configured to receive a pull tab, wherein the pull tab is configured to facilitate removal of the at least one personal card from the pocket.

* * * * *